US007624600B2

(12) United States Patent
Sunshine et al.

(10) Patent No.: US 7,624,600 B2
(45) **Date of Patent: *Dec. 1, 2009**

(54) MODULAR LAUNDRY SYSTEM WITH HORIZONTALLY ARRANGED CABINET MODULE

(75) Inventors: Richard A. Sunshine, Granger, IN (US); Lorraine L. Achterberg, St. Joseph, MI (US); James William Kendall, Stevensville, MI (US); Colleen Marie Doyle, Stevensville, MI (US); Joel A. Luckman, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 506 days.

This patent is subject to a terminal disclaimer.

(21) Appl. No.: 11/323,221

(22) Filed: Dec. 30, 2005

(65) Prior Publication Data

US 2006/0156765 A1 Jul. 20, 2006
US 2007/0266743 A9 Nov. 22, 2007

Related U.S. Application Data

(63) Continuation-in-part of application No. 10/971,671, filed on Oct. 22, 2004, now Pat. No. 7,513,132.

(51) Int. Cl.
*D06F 29/00* (2006.01)

(52) U.S. Cl. ..... 68/3 R; 68/20

(58) Field of Classification Search ..... 68/3 R, 68/30

See application file for complete search history.

(56) References Cited

U.S. PATENT DOCUMENTS

| | | | |
|---|---|---|---|
| 315,725 | A | 4/1885 | Caughy |
| 380,949 | A | 4/1888 | Shannon |
| 496,655 | A | 5/1893 | Hilton |
| 502,237 | A | 7/1893 | Proctor |
| 602,494 | A | 4/1898 | Briggs |
| 699,922 | A | 5/1902 | Hyson et al. |
| 707,409 | A | 8/1902 | Guitar |
| 870,805 | A | 11/1907 | Trager |
| 900,347 | A | 10/1908 | Berry |
| 916,849 | A | 3/1909 | Darrow |
| 970,174 | A | 9/1910 | Booton |
| 1,000,933 | A | 8/1911 | North |
| 1,255,399 | A | 2/1918 | Ferren |
| 1,278,072 | A | 9/1918 | Ossry |

(Continued)

FOREIGN PATENT DOCUMENTS

BE 1013066 8/2001

(Continued)

OTHER PUBLICATIONS

WIPO WO 98/29595 Jul. 1998.*

(Continued)

*Primary Examiner*—Frankie L Stinson
(74) *Attorney, Agent, or Firm*—Clifton G. Green; McGarry Bair P.C.

(57) ABSTRACT

A modular laundry system comprises a first laundry appliance, a second laundry appliance horizontally or vertically arranged relative to the first laundry appliance, and a cabinet module horizontally arranged relative to the first and second laundry appliances.

39 Claims, 67 Drawing Sheets

U.S. PATENT DOCUMENTS

| | | | | | |
|---|---|---|---|---|---|
| 1,317,829 | A | | 10/1919 | Shroyer | |
| 1,369,933 | A | | 3/1921 | Nelson | |
| 1,482,742 | A | * | 2/1924 | Gilchrist | 108/158 |
| 1,485,991 | A | | 3/1924 | Mulley | |
| 1,532,973 | A | | 4/1925 | Adelson | |
| 1,590,390 | A | | 6/1926 | Miller | |
| 1,665,118 | A | | 4/1928 | Thompson et al. | |
| 1,691,042 | A | | 11/1928 | Bell | |
| 1,720,165 | A | | 7/1929 | Bloom et al. | |
| 1,728,458 | A | | 9/1929 | Verduce | |
| 1,767,157 | A | | 6/1930 | Steele | |
| 1,900,793 | A | * | 3/1933 | Broughton | 312/201 |
| 1,994,044 | A | | 3/1935 | Michelet | |
| 2,102,449 | A | | 12/1937 | Zimmerman | |
| 2,140,961 | A | | 12/1938 | Lendle | |
| D113,031 | S | | 1/1939 | Baer et al. | |
| 2,202,811 | A | | 6/1940 | Carney et al. | |
| 2,230,793 | A | | 2/1941 | Borah | |
| 2,256,425 | A | | 9/1941 | Damiano | |
| 2,279,984 | A | | 4/1942 | Goodwin | |
| 2,284,572 | A | | 5/1942 | Holder | |
| 2,287,646 | A | | 6/1942 | Steele | |
| D132,963 | S | | 7/1942 | Salomon | |
| 2,295,718 | A | | 9/1942 | Dahlberg | |
| 2,312,220 | A | | 2/1943 | Snyder | |
| 2,326,062 | A | * | 8/1943 | Parker | 38/139 |
| 2,339,495 | A | | 1/1944 | McMann | |
| 2,355,835 | A | | 8/1944 | Whalen | |
| 2,369,366 | A | | 2/1945 | O'Neill | |
| 2,402,477 | A | | 6/1946 | Williams | |
| 2,412,270 | A | | 12/1946 | Johnston | |
| 2,419,319 | A | | 4/1947 | Lankton | |
| 2,422,825 | A | | 6/1947 | Davis, Jr. | |
| 2,434,404 | A | | 1/1948 | Goodwin | |
| 2,434,886 | A | | 1/1948 | Pugh | |
| 2,435,439 | A | | 2/1948 | Goodwin et al. | |
| 2,447,480 | A | | 8/1948 | Stubbs | |
| 2,463,518 | A | | 3/1949 | Travis | |
| 2,475,106 | A | | 7/1949 | Mohr et al. | |
| 2,478,531 | A | * | 8/1949 | Harris et al. | 312/28 |
| 2,482,412 | A | | 9/1949 | Gershon | |
| 2,486,058 | A | | 10/1949 | Patterson et al. | |
| 2,499,455 | A | | 3/1950 | Brochu | |
| 2,526,030 | A | | 10/1950 | Kagan | |
| 2,543,579 | A | | 2/1951 | Kauffmann, II | |
| 2,547,238 | A | | 4/1951 | Tremblay | |
| 2,547,382 | A | | 4/1951 | Freeman | |
| 2,548,437 | A | | 4/1951 | Mantagas | |
| 2,566,488 | A | * | 9/1951 | Gould | 68/20 |
| 2,570,529 | A | | 10/1951 | Dolan | |
| 2,576,067 | A | | 11/1951 | Chandler | |
| 2,587,111 | A | | 2/1952 | Cashen | |
| 2,602,315 | A | | 7/1952 | Shoop et al | |
| 2,624,137 | A | | 1/1953 | Gysin | |
| 2,641,072 | A | * | 6/1953 | Maher | 211/195 |
| 2,645,863 | A | | 7/1953 | Morrison | |
| 2,650,442 | A | | 9/1953 | Johnson | |
| D170,556 | S | | 10/1953 | Sterling | |
| 2,654,386 | A | | 10/1953 | Wotring | |
| 2,657,566 | A | | 11/1953 | Richterkessing | |
| 2,664,646 | A | | 1/1954 | Bourner | |
| 2,665,183 | A | | 1/1954 | Battles | |
| 2,668,091 | A | | 2/1954 | Clark | |
| 2,687,566 | A | | 8/1954 | Hall | |
| 2,707,837 | A | | 5/1955 | Robinson et al. | |
| 2,707,874 | A | | 5/1955 | Glover | |
| 2,719,422 | A | | 10/1955 | Golden | |
| 2,728,481 | A | | 12/1955 | Robinson et al. | |
| 2,731,316 | A | | 1/1956 | Cohen | |
| 2,732,700 | A | | 1/1956 | Dunn | |
| 2,737,573 | A | | 3/1956 | Olthuis | |
| 2,742,708 | A | | 4/1956 | McCormick | |
| 2,773,373 | A | | 12/1956 | Corson | |
| D179,475 | S | | 1/1957 | Emile et al. | |
| 2,778,705 | A | | 1/1957 | Barker | |
| 2,786,730 | A | | 3/1957 | Thurston | |
| 2,799,948 | A | | 7/1957 | Morrison | |
| 2,807,503 | A | | 9/1957 | Buterbaugh | |
| 2,813,353 | A | | 11/1957 | McMillan | |
| 2,813,534 | A | | 11/1957 | Low | |
| 2,817,157 | A | | 12/1957 | McCormick | |
| 2,817,501 | A | | 12/1957 | Schubert | |
| 2,843,945 | A | | 7/1958 | Whyte | |
| 2,861,355 | A | | 11/1958 | Douglas | |
| 2,893,807 | A | | 7/1959 | Earle | |
| 2,895,618 | A | | 7/1959 | Nathan | |
| 2,895,782 | A | | 7/1959 | Fragale | |
| 2,903,711 | A | | 9/1959 | Kesling | |
| 2,919,340 | A | | 12/1959 | Jacobs | |
| 2,967,670 | A | | 1/1961 | Roberts | |
| 2,979,932 | A | | 4/1961 | Hughes | |
| 2,983,050 | A | | 5/1961 | Alaback | |
| 2,985,967 | A | | 5/1961 | Pataillot et al. | |
| 3,000,108 | A | | 9/1961 | Jones et al. | |
| 3,001,844 | A | | 9/1961 | Spring | |
| 3,022,589 | A | * | 2/1962 | Kleinman | 38/104 |
| 3,026,699 | A | | 3/1962 | Rhodes | |
| 3,030,792 | A | | 4/1962 | Bader | |
| 3,031,871 | A | | 5/1962 | Bailey | |
| 3,059,653 | A | | 10/1962 | Ingolia | |
| 3,061,942 | A | | 11/1962 | Scofield | |
| 3,086,657 | A | | 4/1963 | Myers et al. | |
| D195,518 | S | | 6/1963 | Bullock et al. | |
| 3,170,417 | A | * | 2/1965 | Avidiya | 108/42 |
| 3,173,730 | A | | 3/1965 | Collins | |
| 3,197,886 | A | | 8/1965 | Brame et al. | |
| 3,209,560 | A | | 10/1965 | Shelton | |
| 3,220,230 | A | | 11/1965 | Jacobs et al. | |
| 3,220,790 | A | | 11/1965 | White | |
| 3,230,961 | A | | 1/1966 | Benkert et al. | |
| 3,245,161 | A | | 4/1966 | Adiletta et al. | |
| 3,256,616 | A | | 6/1966 | McGoldrick | |
| 3,316,659 | A | | 5/1967 | Lauck | |
| 3,320,780 | A | | 5/1967 | Frahm | |
| 3,331,226 | A | * | 7/1967 | Fink | 68/20 |
| 3,344,532 | A | | 10/1967 | Bigler | |
| 3,399,783 | A | | 9/1968 | Injeski | |
| 3,402,477 | A | * | 9/1968 | Hubbard | 34/543 |
| 3,417,481 | A | | 12/1968 | Rumsey, Jr | |
| 3,427,831 | A | | 2/1969 | Frauendorf | |
| 3,432,939 | A | | 3/1969 | Eichholz | |
| 3,469,603 | A | | 9/1969 | Nagel | |
| 3,490,254 | A | | 1/1970 | Mason | |
| 3,500,666 | A | | 3/1970 | Calcaterra | |
| 3,506,321 | A | * | 4/1970 | Hampel | 312/107 |
| 3,512,379 | A | | 5/1970 | Buckley et al. | |
| 3,522,817 | A | * | 8/1970 | Raymond | 137/489 |
| 3,527,352 | A | | 9/1970 | Lapa | |
| 3,537,110 | A | | 11/1970 | Horie | |
| 3,555,701 | A | | 1/1971 | Hubbard | |
| 3,559,427 | A | | 2/1971 | Baker | |
| 3,563,624 | A | | 2/1971 | Stice | |
| 3,579,851 | A | | 5/1971 | Elmy | |
| 3,606,506 | A | * | 9/1971 | Ungaro | 312/111 |
| 3,619,830 | A | | 11/1971 | Harris et al. | |
| 3,670,425 | A | | 6/1972 | Benjamin et al. | |
| 3,688,706 | A | | 9/1972 | Merryweather | |
| 3,717,173 | A | | 2/1973 | Nyberg et al. | |
| 3,724,095 | A | | 4/1973 | Laue et al. | |
| 3,739,496 | A | | 6/1973 | Buckley et al. | |
| 3,743,372 | A | * | 7/1973 | Ruggerone | 312/108 |
| 3,744,402 | A | | 7/1973 | Piegza et al. | |
| 3,744,435 | A | | 7/1973 | Tracy et al. | |
| 3,745,676 | A | | 7/1973 | Dikoff | |

3,774,742 A 11/1973 Magnanelli
3,793,744 A 2/1974 Saita
3,811,198 A 5/1974 Baltes
3,840,998 A 10/1974 Marcussen
3,866,336 A 2/1975 Bereza
3,926,315 A 12/1975 Bernard
3,958,586 A * 5/1976 Schnelle ..... 134/68
3,981,404 A 9/1976 Goeke
3,983,583 A 10/1976 Herman et al.
4,002,383 A 1/1977 Holloway, Jr.
4,086,709 A 5/1978 Jackson
4,094,414 A 6/1978 Thiot et al.
4,109,397 A 8/1978 Daily
4,120,180 A 10/1978 Jedora
D251,165 S 2/1979 Moody
4,171,545 A 10/1979 Kann
4,180,919 A 1/1980 Baltes
4,221,441 A 9/1980 Bain
4,243,197 A * 1/1981 Wright ..... 248/678
D258,293 S 2/1981 Macowski
4,262,605 A * 4/1981 Sokol ..... 108/91
4,342,197 A 8/1982 Matthews
4,510,778 A * 4/1985 Cotton ..... 68/12.15
4,557,058 A 12/1985 Ozawa et al.
D283,474 S 4/1986 Appel
4,617,743 A 10/1986 Barnard
4,621,003 A * 11/1986 O'Kane ..... 428/71
D286,958 S 12/1986 Gualtieri
4,625,432 A 12/1986 Baltes
4,637,321 A 1/1987 Hasler et al.
4,653,200 A 3/1987 Werner
4,663,538 A 5/1987 Cotton et al.
4,682,424 A 7/1987 Irving
4,713,949 A 12/1987 Wilcox
4,723,583 A 2/1988 Lowe et al.
4,734,826 A 3/1988 Wilson et al.
4,760,929 A 8/1988 Fedorchak
4,799,743 A 1/1989 Kikuchi et al.
4,819,341 A 4/1989 Gayso
4,856,206 A * 8/1989 Klein ..... 34/619
4,857,703 A 8/1989 Wilkins
4,863,222 A * 9/1989 Posso ..... 312/107
4,894,935 A 1/1990 Kretz
D306,240 S 2/1990 Newhouse
4,901,871 A 2/1990 Ohm et al.
4,908,957 A 3/1990 Acosta, Sr. et al.
4,919,368 A 4/1990 Garrett
4,926,514 A 5/1990 Leuenberger
4,995,681 A 2/1991 Parnell
D315,068 S 3/1991 Miller
5,018,628 A 5/1991 Schenck et al.
5,019,126 A 5/1991 Post
5,046,844 A 9/1991 Milton
5,058,403 A 10/1991 Barnes
5,062,219 A 11/1991 Harris et al.
5,121,698 A 6/1992 Kelley
D328,171 S 7/1992 Hikawa
5,136,792 A 8/1992 Janecke
5,147,090 A 9/1992 Mandell et al.
5,152,077 A 10/1992 Liang
D331,257 S 11/1992 Breen et al.
5,165,181 A 11/1992 Acosta, Sr. et al.
5,181,685 A 1/1993 Ostapowicz
5,203,044 A 4/1993 Jung, Jr.
D336,706 S 6/1993 Lechman et al.
5,241,766 A 9/1993 Walz et al.
5,253,378 A 10/1993 Jung, Jr.
5,253,493 A 10/1993 Ohashi
5,253,932 A 10/1993 Nesovic
5,279,047 A 1/1994 Janecke
5,290,998 A 3/1994 Couch et al.
5,294,009 A 3/1994 Maurer et al.
5,301,376 A 4/1994 Herbert
5,305,484 A 4/1994 Fitzpatrick et al.
5,315,726 A 5/1994 Borenstein
5,315,773 A 5/1994 Iwami et al.
5,337,905 A 8/1994 Gast
D350,646 S 9/1994 Bescher et al.
5,369,892 A 12/1994 Dhaemers
5,381,574 A 1/1995 VonPless
5,402,657 A 4/1995 Henry, Jr.
5,411,164 A 5/1995 Smith et al.
5,452,531 A 9/1995 Graville et al.
5,461,887 A 10/1995 VonPless
5,466,058 A 11/1995 Chan
D365,224 S 12/1995 Pohlman
5,486,041 A 1/1996 Sykes
5,518,309 A 5/1996 St-Pierre
5,528,912 A 6/1996 Weber
5,546,678 A 8/1996 Dhaemers
5,555,640 A 9/1996 Ou
D374,954 S 10/1996 Katz et al.
5,568,691 A * 10/1996 Rubin ..... 34/98
5,570,598 A 11/1996 Haven
5,609,047 A 3/1997 Hellman, Jr. et al.
5,653,221 A 8/1997 Luken et al.
5,664,339 A 9/1997 Swanson et al.
5,666,743 A 9/1997 Dawson
5,702,010 A 12/1997 Liang
5,706,678 A 1/1998 Sasaki
5,733,022 A 3/1998 Whetstone
5,743,025 A 4/1998 Jordan, Jr.
5,755,040 A 5/1998 Ou
D395,639 S 6/1998 Ham et al.
5,778,573 A 7/1998 Nottingham et al.
5,787,615 A 8/1998 Hensel et al.
D398,906 S 9/1998 Fynn et al.
5,806,207 A 9/1998 Merrigan
5,815,961 A 10/1998 Estes et al.
5,836,486 A 11/1998 Ohsugi
D401,782 S 12/1998 Mitchell
5,858,521 A 1/1999 Okuda et al.
5,900,258 A * 5/1999 Engler ..... 424/684
D410,351 S 6/1999 Magnusson et al.
5,951,127 A 9/1999 Smith
5,957,557 A 9/1999 Langer et al.
5,967,342 A 10/1999 Steffine
5,974,980 A 11/1999 Kent
5,983,808 A 11/1999 Weil
D417,701 S 12/1999 Jack
6,000,158 A 12/1999 Zoellner
6,016,610 A 1/2000 Sears
6,036,150 A 3/2000 Lehrman
6,082,841 A 7/2000 Smith et al.
6,101,741 A 8/2000 Sears
D431,130 S 9/2000 Thompson et al.
D431,934 S 10/2000 Chininis
6,131,929 A 10/2000 Haley
6,134,806 A 10/2000 Dhaemers
6,135,583 A 10/2000 Simon et al.
6,138,979 A 10/2000 Morman
D433,248 S 11/2000 Hellwig et al.
6,151,795 A 11/2000 Hoffman et al.
D435,741 S 1/2001 Schlereth
D436,952 S 1/2001 Goto
D438,047 S 2/2001 Chavez
6,189,346 B1 2/2001 Chen et al.
6,219,876 B1 4/2001 Blum
6,253,472 B1 * 7/2001 Gast ..... 38/137
6,263,591 B1 7/2001 La Porte
6,263,708 B1 7/2001 Yarmosky
6,267,462 B1 7/2001 Krause et al.
D446,891 S 8/2001 Kim
6,279,876 B1 8/2001 Massie
6,311,945 B1 11/2001 D'Angelo
6,353,954 B1 3/2002 Dunsbergen et al.

| | | | |
|---|---|---|---|
| 6,374,644 | B1 | 4/2002 | Rhode et al. |
| 6,375,686 | B1 | 4/2002 | Kim |
| D457,749 | S | 5/2002 | Doane |
| D457,991 | S | 5/2002 | Baldwin et al. |
| D457,992 | S | 5/2002 | Baldwin et al. |
| 6,386,378 | B1 | 5/2002 | Scharing |
| 6,397,502 | B1 | 6/2002 | Chen |
| D459,844 | S | 7/2002 | Baldwin et al. |
| 6,427,259 | B1 | 8/2002 | Cawthon |
| D463,631 | S | 9/2002 | Baldwin et al. |
| 6,448,306 | B1 | 9/2002 | Lever et al. |
| D465,308 | S | 11/2002 | Resuello et al. |
| 6,475,594 | B2 | 11/2002 | Johnston et al. |
| 6,482,242 | B2 | 11/2002 | Yarmosky |
| 6,484,645 | B2 | 11/2002 | Allen |
| 6,510,280 | B1 | 1/2003 | Chen |
| D474,566 | S | 5/2003 | Baldwin et al. |
| 6,572,208 | B2 | 6/2003 | Albaizar et al. |
| 6,585,225 | B1 | 7/2003 | Lake |
| 6,588,238 | B1 | 7/2003 | Reason |
| 6,604,473 | B2 | 8/2003 | Felsenthal |
| 6,611,972 | B2 | 9/2003 | Underbrink et al. |
| 6,618,887 | B2 | 9/2003 | Kim et al. |
| D489,496 | S | 5/2004 | Sneddon |
| 6,732,552 | B2 | 5/2004 | Kim et al. |
| D492,073 | S | 6/2004 | Sneddon |
| 6,745,496 | B2 | 6/2004 | Cassella |
| D492,507 | S | 7/2004 | Moon et al. |
| D495,453 | S | 8/2004 | Baldwin et al. |
| 6,793,991 | B2 * | 9/2004 | Thuma et al. ..... 428/34.1 |
| 6,796,055 | B2 | 9/2004 | Baltes |
| D497,162 | S | 10/2004 | Neal et al. |
| 6,845,569 | B1 | 1/2005 | Kim |
| 6,846,871 | B2 | 1/2005 | Patel et al. |
| D501,615 | S | 2/2005 | Chen |
| D502,577 | S | 3/2005 | Baldwin et al. |
| 6,860,032 | B2 | 3/2005 | Meyer |
| 6,866,336 | B2 | 3/2005 | De Gaillard |
| 6,868,621 | B1 | 3/2005 | Grimm et al. |
| D504,038 | S | 4/2005 | Perella et al. |
| 6,883,257 | B2 | 4/2005 | Couch et al. |
| 6,886,373 | B2 | 5/2005 | Carrubba et al. |
| 6,889,399 | B2 | 5/2005 | Steiner et al. |
| 6,889,449 | B2 | 5/2005 | Silver |
| D506,090 | S | 6/2005 | Ben-Or |
| 6,910,292 | B2 | 6/2005 | Prows |
| D508,346 | S | 8/2005 | Petruccelli |
| D519,692 | S | 4/2006 | Jun |
| 7,036,243 | B2 | 5/2006 | Doh et al. |
| 7,062,871 | B1 * | 6/2006 | Smidt ..... 38/104 |
| 7,065,904 | B2 | 6/2006 | Lee et al. |
| D524,079 | S | 7/2006 | Grosfillex |
| D526,453 | S | 8/2006 | Jun |
| 7,100,316 | B2 | 9/2006 | Obileye |
| D532,455 | S | 11/2006 | Beardslee |
| D534,215 | S | 12/2006 | Nakata |
| 7,171,761 | B1 | 2/2007 | Hunts |
| 7,191,546 | B2 | 3/2007 | Maruca |
| 7,207,197 | B2 | 4/2007 | North |
| D541,563 | S | 5/2007 | LaBonia, Jr. et al. |
| 7,213,792 | B2 | 5/2007 | Choi |
| 7,251,905 | B2 | 8/2007 | Doh et al. |
| 2002/0017117 | A1 | 2/2002 | Sunshine et al. |
| 2002/0043604 | A1 | 4/2002 | Cooper et al. |
| 2002/0137631 | A1 * | 9/2002 | Falder et al. ..... 504/150 |
| 2003/0019798 | A1 | 1/2003 | Capps et al. |
| 2003/0074105 | A1 | 4/2003 | Capps et al. |
| 2003/0196460 | A1 | 10/2003 | Lyu et al. |
| 2003/0222085 | A1 | 12/2003 | Kaczmarek |
| 2004/0022405 | A1 | 2/2004 | Caron et al. |
| 2004/0034924 | A1 | 2/2004 | Underbrink et al. |
| 2004/0040084 | A1 | 3/2004 | Underbrink et al. |
| 2004/0040476 | A1 | 3/2004 | Diers |
| 2004/0134237 | A1 | 7/2004 | Sunshinet et al. |
| 2004/0144140 | A1 | 7/2004 | Lee |
| 2004/0160150 | A1 | 8/2004 | Hay et al. |
| 2004/0181979 | A1 | 9/2004 | Compeau et al. |
| 2004/0182288 | A1 | 9/2004 | Goldberg et al. |
| 2004/0194339 | A1 | 10/2004 | Johnson et al. |
| 2004/0221411 | A1 | 11/2004 | Blum et al. |
| 2004/0221624 | A1 | 11/2004 | Fumagalli |
| 2004/0226320 | A1 | 11/2004 | Bongini |
| 2004/0245899 | A1 | 12/2004 | Cho |
| 2004/0263032 | A1 | 12/2004 | Cho |
| 2005/0017605 | A1 | 1/2005 | Bauer |
| 2005/0035076 | A1 | 2/2005 | Schober et al. |
| 2005/0040070 | A1 | 2/2005 | Adams |
| 2005/0040184 | A1 | 2/2005 | Noyes et al. |
| 2005/0056059 | A1 | 3/2005 | Usherovich |
| 2005/0072194 | A1 | 4/2005 | Ryohke et al. |
| 2005/0120585 | A1 | 6/2005 | Lee et al. |
| 2005/0120757 | A1 | 6/2005 | Jackson |
| 2005/0126035 | A1 | 6/2005 | Lee et al. |
| 2005/0132593 | A1 | 6/2005 | Doh et al. |
| 2005/0132594 | A1 | 6/2005 | Doh et al. |
| 2005/0132604 | A1 | 6/2005 | Hong et al. |
| 2005/0275325 | A1 | 12/2005 | Yang |
| 2005/0284867 | A1 | 12/2005 | Sander et al. |
| 2007/0051864 | A1 | 3/2007 | Bartell et al. |
| 2007/0113419 | A1 | 5/2007 | Belgard |

FOREIGN PATENT DOCUMENTS

| | | | |
|---|---|---|---|
| CA | 2 330 236 | * | 1/2001 |
| DE | 662984 | | 7/1938 |
| DE | 945683 | | 7/1956 |
| DE | 2402065 | | 7/1975 |
| DE | 8033429 | | 5/1982 |
| DE | 3211316 | | 9/1983 |
| DE | 3213420 | | 10/1983 |
| DE | 3409972 | | 9/1985 |
| DE | 3417481 | | 11/1985 |
| DE | 3904423 | | 8/1990 |
| DE | 4228469 | | 8/1990 |
| DE | 9104422 | | 7/1991 |
| DE | 4105112 | | 8/1992 |
| DE | 4228469 | | 5/1993 |
| DE | 9419048 | | 3/1995 |
| DE | 19514821 | | 11/1995 |
| DE | 29606946 | | 8/1996 |
| DE | 19604370 | | 6/1997 |
| DE | 29704672 | | 7/1997 |
| DE | 19716825 | | 4/1998 |
| DE | 19750946 | | 10/1998 |
| DE | 19832675 | | 1/2000 |
| DE | 19838630 | | 3/2000 |
| DE | 19922647 | | 11/2000 |
| DE | 20101254 | | 4/2001 |
| DE | 10055918 | | 5/2002 |
| DE | 20302572 | | 4/2003 |
| DE | 10223539 | | 12/2003 |
| EP | 0050395 | | 4/1982 |
| EP | 0265704 | | 5/1988 |
| EP | 355701 | | 2/1990 |
| EP | 0449060 | | 10/1991 |
| EP | 1146161 | A1 | 4/2000 |
| EP | 1205129 | | 5/2002 |
| EP | 1227182 | | 7/2002 |
| EP | 1288367 | | 3/2003 |
| EP | 1371307 | | 12/2003 |
| EP | 1431442 | | 6/2004 |
| EP | 1444922 | | 8/2004 |
| EP | 1467015 | | 10/2004 |
| EP | 1495697 | | 1/2005 |
| EP | 1731654 | | 12/2006 |
| FR | 1116286 | | 5/1956 |

| | | | |
|---|---|---|---|
| FR | 2510881 | | 2/1983 |
| FR | 2595937 | | 9/1987 |
| FR | 2604196 | | 3/1988 |
| FR | 2626016 | | 7/1989 |
| FR | 2646674 | | 11/1990 |
| FR | 2760761 | | 9/1998 |
| GB | 326511 | | 3/1930 |
| GB | 336679 | | 10/1930 |
| GB | 384352 | | 12/1932 |
| GB | 442615 | | 2/1936 |
| GB | 582959 | | 12/1946 |
| GB | 617965 | | 2/1949 |
| GB | 618803 | | 2/1949 |
| GB | 855965 | | 12/1960 |
| GB | 1355656 | | 6/1974 |
| GB | 1399827 | | 7/1975 |
| GB | 2164552 | | 3/1986 |
| GB | 2221970 | | 2/1990 |
| GB | 2297982 | | 8/1996 |
| GB | 2407860 | | 5/2005 |
| JP | 64009000 | | 1/1989 |
| JP | 01223998 | | 9/1989 |
| JP | 02307414 | | 12/1990 |
| JP | 03012196 | | 1/1991 |
| JP | 03275099 | | 12/1991 |
| JP | 426455 | | 1/1992 |
| JP | 04187194 | | 7/1992 |
| JP | 04220210 | | 8/1992 |
| JP | 04220211 | | 8/1992 |
| JP | 04220212 | | 8/1992 |
| JP | 04220213 | | 8/1992 |
| JP | 04220214 | | 8/1992 |
| JP | 04237000 | | 8/1992 |
| JP | 05277298 | | 10/1993 |
| JP | 671100 | | 3/1994 |
| JP | 06343794 | | 12/1994 |
| JP | 07116395 | | 5/1995 |
| JP | 07194661 | | 8/1995 |
| JP | 07213792 | | 8/1995 |
| JP | 07227495 | | 8/1995 |
| JP | 08047599 | | 2/1996 |
| JP | 8-192000 | * | 7/1996 |
| JP | 8191998 | | 7/1996 |
| JP | 08299070 | | 11/1996 |
| JP | 09010492 | | 1/1997 |
| JP | 09149826 | | 6/1997 |
| JP | 10057699 | | 3/1998 |
| JP | 11146995 | | 6/1999 |
| JP | 200218093 | | 8/2000 |
| JP | 2000218095 | | 8/2000 |
| JP | 2000225299 | | 8/2000 |
| JP | 2001157800 | | 6/2001 |
| JP | 2002000997 | | 1/2002 |
| JP | 2002126395 | | 5/2002 |
| JP | 22002136799 | | 5/2002 |
| JP | 2002-233693 | * | 8/2002 |
| JP | 2002322702 | | 11/2002 |
| JP | 2003019382 | | 1/2003 |
| JP | 2003114611 | | 4/2003 |
| JP | 2003311097 | | 11/2003 |
| KR | 200201898 | | 11/2000 |
| KR | 1020040009401 | | 1/2004 |
| WO | 8803579 | | 5/1988 |
| WO | 9317601 | | 9/1993 |
| WO | 9627309 | | 9/1996 |
| WO | 9629458 | | 9/1996 |
| WO | 9829595 | | 7/1998 |
| WO | 03035961 | | 5/2003 |
| WO | 2004063452 | | 9/2004 |
| WO | 2004099308 | | 11/2004 |
| WO | 2004109021 | | 12/2004 |
| WO | 2005001191 | | 1/2005 |
| WO | 2005045121 | | 5/2005 |
| WO | 2006073885 | | 7/2006 |

OTHER PUBLICATIONS

WIPO WO 00/26463 May 2000.*

WIPO WO 03/035961 May 2003.*

WIPO WO 2004/110214 Dec. 2004.*

BOSCH; BOSCH Laundry Vertical Stacking Kit with Pull-Out Tray; Jul. 26, 2005; http://www.boschappliances.com/customer_care/1492_423.asp.

Better Lifesyle Products; Rolling Mobile Laundry Ironing Center; Jul. 28, 2005; http://www.betterlifestyleproducts.com/mobile-laundry-center.html.

Thor Appliance Company; Washing Machine—APEX by Thor; Jul. 26, 2005 http://thorappliances.com/apex/index.php http://thorappliances.com/apex/images/apexzoom2.jpg http://thorappliances.com/apex/apexAnatomy.php.

* cited by examiner

MODULAR LAUNDRY SYSTEM WITH HORIZONTALLY ARRANGED CABINET MODULE

CROSS-REFERENCE TO RELATED APPLICATION

This application is a continuation-in-part of U.S. patent application Ser. No. 10/971,671, filed Oct. 22, 2004, now U.S. Pat. No. 7,513,132.

BACKGROUND OF THE INVENTION

1. Field of the Invention

The invention relates to a modular laundry system comprising laundry appliances and modules that can be configured to spatially and functionally optimize a household laundry area.

2. Description of the Related Art

Most homeowners utilize laundry appliances, such as a washer and a dryer, to clean clothing and other fabric items. The laundry appliances are located in a household laundry area that can be a dedicated laundry room, a laundry closet, or part of another room or hallway of the home. A common complaint of homeowners is that the laundry area tends to be an afterthought when the home is designed. Many feel that the laundry area is small, poorly arranged, and inefficient.

Regardless of size, the laundry area is not optimized for performing functions other than the conventional washing and drying done in the washer and dryer, such as flat drying, hang drying, ironing, hand steaming, spot pre-treatment, stain removal, and the like. Laundry areas contain, at most, the washer and dryer and possibly a built-in sink and storage cabinets. This configuration meets the basic needs of doing laundry but neither provides facilities for performing other functions nor optimizes the process of doing laundry. Examples of functional deficiencies of the laundry area follow.

For example, different types of clothing require different care; some items need to be washed in a delicate cycle while others are intended for the normal cycle or the heavy duty cycle. With only the washing machine and the dryer, only one clothes load can be run at a time, and if the cycles for the clothes loads are different, i.e., delicate and heavy duty, then the loads must be washed one after another, thereby lengthening the laundry process. Additionally, some clothes need to be hung or laid flat to dry after washing, but there is usually no dedicated space for these items. Consequently, some people hang clothes along the top of doors, on door knobs, on hooks attached to the washer, and in other creative locations.

Another example of the deficiencies of household laundry area is the inability to refresh clothes that don't require a complete washing before wearing. Rather than wear a slightly soiled garment, people tend to put the clothing through a wash cycle in the washer, which can prematurely wear out the garment, or take the item to a dry cleaner, which can be costly. Furthermore, to touch up a wrinkled clothing item, people have to set up the ironing board and the iron, usually outside the laundry room, and then let the iron cool and return the ironing board and the iron to its storage location after ironing. This process is extremely inconvenient and time consuming, especially if only one garment needs to be touched up. In addition, when laundry areas do not have a built-in sink, people must travel between the laundry area and another area when a sink is needed, such as for soaking garments or removing stains. Finally, storage is a common shortcoming in laundry areas; detergents, fabric softeners, stain pre-treatment aids, delicate garment bags, and the like are often stored in locations distant from where they are actually used. These examples are only a few of the many deficiencies of the laundry area.

To address some of these problems, a hodgepodge of different gadgets, such as sweater racks, accordion hanging racks, rolling shelves, and rolling laundry carts that store ironing boards and the like, have been made commercially available. However, these solutions are not ideal; some are inconvenient to store when not in use, others are not dimensioned to optimize the space of the laundry area, and all are not aesthetically coherent with the laundry appliances.

SUMMARY OF THE INVENTION

A modular laundry system according to one embodiment of the invention comprises a first laundry appliance, a second laundry appliance horizontally or vertically arranged relative to the first laundry appliance, and a cabinet module horizontally arranged relative to the first and second laundry appliances.

The cabinet module can be one of a single height cabinet module, an intermediate height cabinet module, and a double height cabinet module.

The cabinet module can comprise a functional element having an associated at least one of a laundry care function and a non-laundry care function. The laundry care function can be selected from a group comprising washing, drying, refreshing, sanitizing, stain removal, ironing, hand steaming, and sink. The non-laundry care function can be selected from a group comprising storage, garbage and recycling collection, shelving, laundry sorting, bulk dispensing, resource management, resource supply, resource recovery/reclamation, resource treatment, lighting, refrigeration, entertainment, pet care, data collection, data communication, home automation, home security, home safety, power outlet, and power supply.

The modular laundry system can further comprise a vertical module horizontally arranged relative to the first and second laundry appliances and the cabinet module.

The modular laundry system can further comprise a first single width horizontal module vertically arranged with at least one of the first laundry appliance, the second laundry appliance, and the cabinet module. The first single width horizontal module can be vertically arranged with one of the first laundry appliance, the second laundry appliance, and the cabinet module, and the modular laundry system can further comprise a double width horizontal module vertically arranged with the other two of the first laundry appliance, the second laundry appliance, and the cabinet module. The modular laundry system can further comprise second and third single width horizontal modules, wherein each of the first laundry appliance, the second laundry appliance, and the cabinet module can be vertically arranged with one of the first, second, and third single width horizontal modules.

The modular laundry system can further comprise one of a horizontal module and a second cabinet module vertically arranged with at least one of the first and second laundry appliances to form a vertically arranged unit having a height that is about the same as a height of the cabinet module.

The modular laundry system can further comprise a work surface extending across at least one of the first laundry appliance, the second laundry appliance, and the cabinet module. The work surface can be removably mounted to at least one of the first laundry appliance, the second laundry appliance, and the cabinet module. The work surface can comprise opposing sides with each side configured for performing an associated function. The work surface can comprise a non-skid surface. The work surface can comprise an ironing surface. The work surface can comprise a hygienic material. The work surface can comprise a hanging bar.

The first and second laundry appliances can be horizontally arranged. The cabinet module can be one of a single height cabinet module, an intermediate height cabinet module, and a double height cabinet module. The cabinet module can comprise a functional element having an associated at least one of a laundry care function and a non-laundry care function.

The first and second laundry appliances can be vertically arranged. The cabinet module can be one of a single height cabinet module, an intermediate height cabinet module, and a double height cabinet module. The cabinet module can comprise a functional element having an associated at least one of a laundry care function and a non-laundry care function.

The first laundry appliance can be a washing machine, and the second laundry appliance can be a dryer.

A modular laundry system according to another embodiment of the invention comprises a washing machine, a dryer, and a cabinet module configured to be vertically or horizontally arranged relative to either of the washing machine and dryer.

The cabinet module can be one of a single height cabinet module, an intermediate height cabinet module, and a double height cabinet module.

The cabinet module can comprise a functional element having an associated at least one of a laundry care function and a non-laundry care function. The laundry care function can be selected from a group comprising washing, drying, refreshing, sanitizing, stain removal, ironing, hand steaming, and sink. The non-laundry care function can be selected from a group comprising storage, garbage and recycling collection, shelving, laundry sorting, bulk dispensing, resource management, resource supply, resource recovery/reclamation, resource treatment, lighting, refrigeration, entertainment, pet care, data collection, data communication, home automation, home security, home safety, power outlet, and power supply.

The modular laundry system can further comprise a vertical module configured to be horizontally arranged relative to the washing machine, the dryer, and the cabinet module.

The modular laundry system can further comprise a first single width horizontal module configured to be vertically arranged with at least one of the washing machine, the dryer, and the cabinet module.

The modular laundry system can further comprise a double width horizontal module configured to be vertically arranged with at least two of the washing machine, the dryer, and the cabinet module.

The modular laundry system can further comprise second and third single width horizontal modules, each configured to be vertically arranged with at least one of the first, second, and third single width horizontal modules.

The modular laundry system can further comprise one of a horizontal module and a second cabinet module configured to be vertically arranged with at least one of the washing machine and the dryer to form a vertically arranged unit having a height that is about the same as a height of the cabinet module.

The modular laundry system can further comprise a work surface configured to extend across at least one of the washing machine, the dryer, and the cabinet module. The work surface can be configured to be removably mounted to at least one of the washing machine, the dryer, and the cabinet module. The work surface can comprise opposing sides with each side configured for performing an associated function. The work surface can comprise a non-skid surface. The work surface can comprise an ironing surface. The work surface can comprise a hygienic material. The work surface can comprise a hanging bar.

DESCRIPTION OF EMBODIMENTS OF THE INVENTION

A modular laundry system according to the invention comprises at least one laundry appliance 10 and at least one module 20. According to one embodiment of the invention, the laundry system comprises two laundry appliances 10 and at least one module 20, which can be selected and configured to provide desired laundry care functionality within a given laundry area. The laundry area is a space of a home in which the laundry appliance 10 conventionally resides. The laundry area can be, for example, a dedicated laundry room, a shared room, such as a combined laundry and utility room or a combined laundry room and garage, a closet, or part of another room or hallway of the home.

The laundry appliance 10 is a conventional appliance for washing and drying fabric items, such as clothes and linens. Examples of the laundry appliance include, but are not limited to, a washing machine, including top-loading, front-loading, vertical axis, and horizontal axis washing machines, a dryer, such as a tumble dryer, including top-loading dryers and front-loading dryers, a combination washing machine and dryer, a tumbling refreshing machine, an extractor, and a non-aqueous washing apparatus. An exemplary non-aqueous washing apparatus is disclosed in U.S. Patent Application Publication No. 2005/0155393, which is incorporated herein by reference in its entirety. The non-aqueous washing apparatus of the incorporated application publication comprises a wash unit and a reclamation unit, and the laundry appliance 10 can be the wash unit. When the laundry system comprises two of the laundry appliances 10, a first laundry appliance and a second laundry appliance, the first and second laundry appliances 10 can be the same type of laundry appliance, such as two washing machines, or different types of laundry appliances, such as a washing machine and a dryer.

Figure 1A:
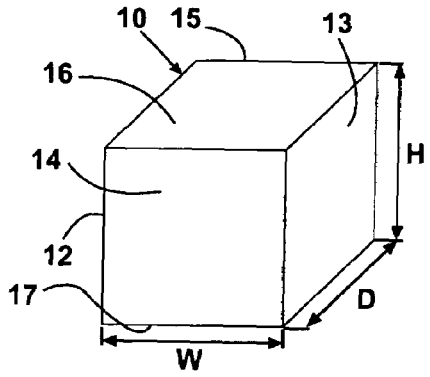
FIG. 1A is a schematic view of a laundry appliance.

Referring now to the schematic three-dimensional illustration in FIG. 1A, the laundry appliance 10 is defined by a space bounded by spaced left and right side walls 12, 13, spaced front and rear walls 14, 15, and spaced top and bottom walls 16, 17 that together define for the laundry appliance 10 a width W, a height H, and a depth D. In FIG. 1A, the laundry appliance 10 is depicted as a cube; however, the width W, the height H, and the depth D need not be equal. The width W and the depth D determine a footprint of the laundry appliance 10. The footprint corresponds to the amount of floor space required by the laundry appliance 10. The laundry appliances 10 that are presently commercially available have a range of dimensions, and it is within the scope of the invention to utilize a laundry appliance having any suitable dimensions. Exemplary dimensions for the laundry appliance 10 are 27"W×38"H×31.5"D. A survey of multiple commercially available washing machines and dryers resulted in the following exemplary dimensions, which are given in inches and rounded to the nearest whole number:

| DIMENSION | AVERAGE | MAXIMUM | MINIMUM |
|---|---|---|---|
| Washing machine W | 24 | 27 | 20 |
| Washing machine H | 35 | 39 | 26 |
| Washing machine D | 25 | 34 | 20 |
| Dryer W | 27 | 29 | 23 |
| Dryer H | 36 | 38 | 31 |
| Dryer D | 28 | 32 | 21 |

Figure 1B:
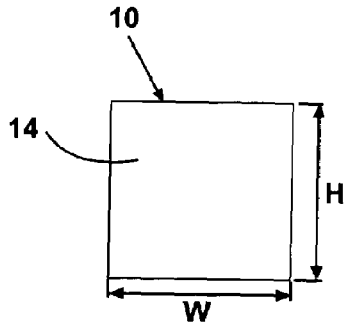
FIG. 1B is a view of a symbol representative of the laundry appliance of FIG. 1A.

FIG. 1B displays a two-dimensional symbol for the laundry appliance 10, and the symbol is used in the drawings of this application to represent the laundry appliance 10 in the modular laundry system. The symbol corresponds to the front wall 14 of the laundry appliance 10, and, therefore, the shape of the symbol is determined by the width W and the height H. As explained in further detail below, the width W, the height H, and the depth D of the laundry appliance 10 are reference dimensions, and dimensions for the modules 20 are described with respect to the reference dimensions.

The modules 20 can be stand-alone units that do not require physical connection to the laundry appliance 10 for operation, or, alternatively, they can be coupled to the laundry appliance 10, either as a requirement for operation of the module 20 or to support operation of the laundry appliance 10. The modules 20 can be characterized in terms of their geometry and function and will first be described with respect to their geometry. The geometry of the modules 20 enables the modules 20 to form an aesthetically coherent system with the laundry appliances 10 and to optimize the space available in the laundry area. The modules 20 according to one embodiment of the invention are illustrated schematically in FIGS. 2A-5F. The modules 20 are grouped into horizontal modules (FIGS. 2A-2D, 4A-4F), vertical modules (FIGS. 3A-3D), and cabinet modules (5A-5F).

Figure 2A:
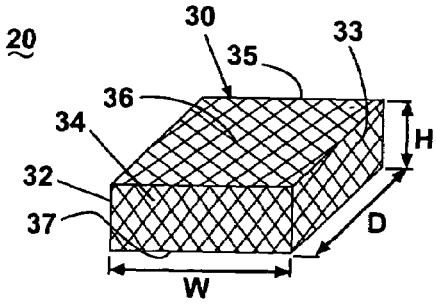
FIG. 2A is a schematic view of a single width horizontal module according to one embodiment of the invention.
Figure 2B:
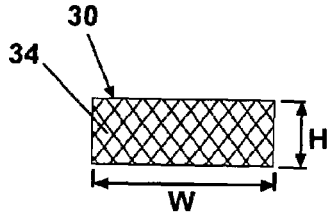
FIG. 2B is a view of a symbol representative of the single width horizontal module of FIG. 2A.

FIG. 2A shows a single width horizontal module 30 that is defined by a space bounded by spaced left and right side walls 32, 33, spaced front and rear walls 34, 35, and spaced top and bottom walls 36, 37. The single width horizontal module 30 has a width W approximately equal to the width W of the laundry appliance 10. When the single width horizontal module 30 has a depth D that is approximately equal to the depth D of the laundry appliance 10, the single width horizontal module 30 has the same footprint as the laundry appliance 10, whereby the bottom wall 37 of the single width horizontal module 30 is generally the same size as the bottom wall 17 of the laundry appliance 10. Because the single width horizontal module 30 has the same width W as the laundry appliance 10, the single width horizontal module 30 can be arranged above or below the laundry appliance 10 with the left side walls 12, 32 forming a generally continuous surface and the right side walls 13, 33 likewise forming a generally continuous surface. The single width horizontal module 30 can have any suitable height H less than the height H of the laundry appliance 10, and an exemplary height for a 27" wide single width horizontal module 30 is about 15.5". A symbol for the single width horizontal module 30 is illustrated in FIG. 2B. The symbol corresponds to the front wall 34 of the single width horizontal module 30, and, therefore, the shape of the symbol is determined by the width W and the height H.

Figure 2C:
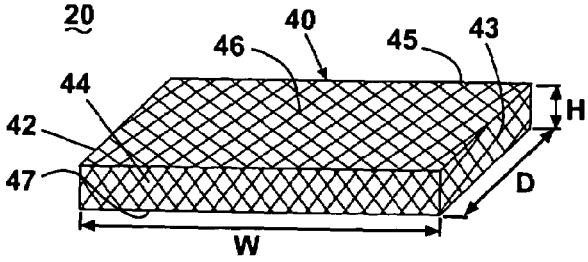
FIG. 2C is a schematic view of a double width horizontal module according to one embodiment of the invention.
Figure 2D:
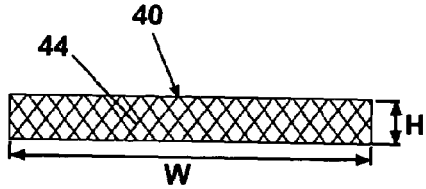
FIG. 2D is a view of a symbol representative of the double width horizontal module of FIG. 2C.

FIG. 2C illustrates a double width horizontal module 40 that is defined by a space bounded by spaced left and right side walls 42, 43, spaced front and rear walls 44, 45, and spaced top and bottom walls 46, 47. The double width horizontal module 40 has a width W approximately equal to twice the width W of the laundry appliance 10 or approximately equal to a collective width of two of the laundry appliances 10, i.e., the first and second laundry appliances, which can have differing individual widths. When the double width horizontal module 40 has a depth D approximately equal to that of the laundry appliance 10, the double width horizontal module 40 has a footprint that is twice as wide as that of the laundry appliance 10 or as wide as the collective width of two of the laundry appliances 10. The double width horizontal module 40 can be arranged above or below two laundry appliances 10 arranged side-by-side. In this configuration, because the width W of the double width horizontal module 40 is twice that of the laundry appliance 10, the left side wall 42 of the double width horizontal module 40 and the left side wall 12 of one of the laundry appliances 10 form a generally continuous surface, while the right side wall 43 of the double width horizontal module 40 and the right side wall 13 of the other of the laundry appliances 10 form a generally continuous surface. The double width horizontal module 40 can have any suitable height H less than the height H of the laundry appliance 10, and, according to the illustrated embodiment, the height H of the double width horizontal module 40 is less than that of the single width horizontal module 30; however, it is within the scope of the invention for the height H of the double width horizontal module 40 to be equal to or greater than that of the single width horizontal module 30. Exemplary heights for a 54" wide double width horizontal module 40 are about 6" and 10". A symbol for the double width horizontal module 40 is illustrated in FIG. 2D. The symbol corresponds to the front wall 44 of the double width horizontal module 40, and, therefore, the shape of the symbol is determined by the width W and the height H.

In addition to the single width horizontal module 30 and the double width horizontal module 40, the modular laundry system can include a less than single width horizontal module 1050, an intermediate width horizontal module 1060, and a greater than double width horizontal module 1070. These additional horizontal modules are described below with respect to FIGS. 4A-4F.

Figure 3A:
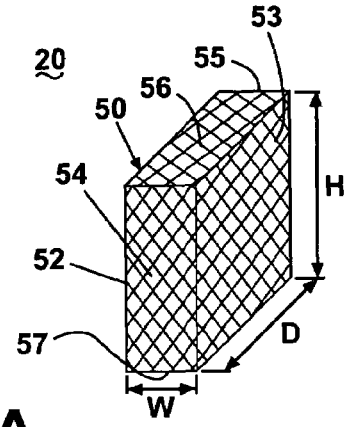
FIG. 3A is a schematic view of a single height vertical module according to one embodiment of the invention.
Figure 3B:
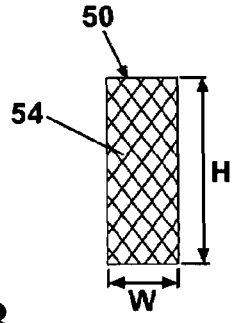
FIG. 3B is a view of a symbol representative of the single height vertical module of FIG. 3A.

FIG. 3A depicts a single height vertical module 50 that is defined by a space bounded by spaced left and right side walls 52, 53, spaced front and rear walls 54, 55, and spaced top and bottom walls 56, 57. The single height vertical module 50 has a height H approximately equal to the height H of the laundry appliance 10. Because the heights H of the single height vertical module 50 and the laundry appliance 10 are substantially equal, the single height vertical module 50 can be positioned adjacent to the laundry appliance 10 in a side-by-side relationship with the top walls 16, 56 forming a generally continuous surface. The single height vertical module 50 can have any suitable depth D, such as a depth equal to the depth D of the laundry appliance 10. Further, the single height vertical module 50 can have any suitable width W less than the width W of the laundry appliance 10. Thus, the footprint of the single height vertical module 50 is less wide than that of the laundry appliance 10. Exemplary widths W for the single height vertical module 50 are about 10.5", 13.5", and 15.5". A symbol for the single height vertical module 50 is illustrated in FIG. 3B. The symbol corresponds to the front wall 54 of the single height vertical module 50, and, therefore, the shape of the symbol is determined by the width W and the height H.

Figure 3C:
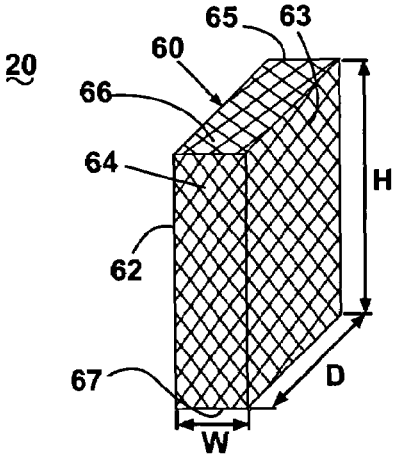
FIG. 3C is a schematic view of an intermediate height vertical module according to one embodiment of the invention.
Figure 3D:
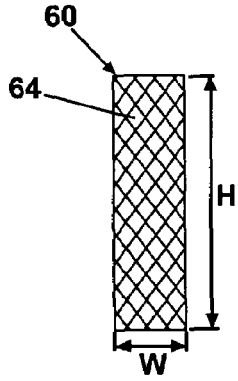
FIG. 3D is a view of a symbol representative of the intermediate height vertical module of FIG. 3C.

FIG. 3C shows an intermediate height vertical module 60 that is defined by a space bounded by spaced left and right side walls 62, 63, spaced front and rear walls 64, 65, and spaced top and bottom walls 66, 67. The intermediate height vertical module 60 has a height H approximately equal to a height of the laundry appliance 10 vertically stacked with one or more of the horizontal modules 30, 40, 1050, 1060, 1070 and less than a collective height of two of the laundry appliances vertically stacked. Because the height H of the intermediate height vertical module 60 and the height of the laundry appliance 10 vertically stacked with one or more of the horizontal modules 30, 40, 1050, 1060, 1070 are substantially equal, the intermediate height vertical module 60 can be positioned in a side-by-side relationship with the laundry appliance 10 vertically stacked with one or more of the horizontal modules 30, 40, 1050, 1060, 1070 such that the top wall 66 of the intermediate height vertical module 60 and the top wall of the laundry appliance 10 or the one or more of the horizontal modules 30, 40, 1050, 1060, 1070, depending on the relative vertical positioning, form a generally continuous surface. The intermediate height vertical module 60 can have any suitable depth D, such as a depth equal to the depth D of the laundry appliance 10. Further, as with the single height vertical module 50, the intermediate height vertical module 60 can have any suitable width W less than the width W of the laundry appliance 10. Thus, the footprint of the intermediate height vertical module 60 is less wide than that of the laundry appliance 10. Exemplary widths W for the intermediate height vertical module 60 are about 10.5", 13.5", and 15.5". A symbol for the intermediate height vertical module 60 is illustrated in FIG. 3D. The symbol corresponds to the front wall 64 of the intermediate height vertical module 60, and, therefore, the shape of the symbol is determined by the width W and the height H.

Figure 4A:
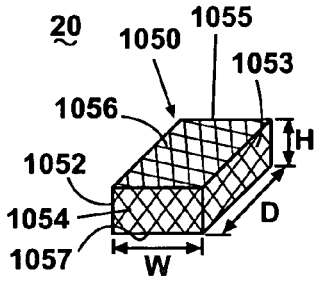
FIG. 4A is a schematic view of a less than single width horizontal module according to one embodiment of the invention.
Figure 4B:
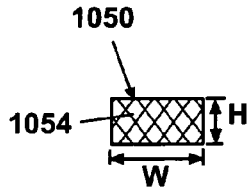
FIG. 4B is view of a symbol representative of the less than single width horizontal module of FIG. 4A.

FIG. 4A illustrates the less than single width horizontal module 1050, which is defined by a space bounded by spaced left and right side walls 1052, 1053, spaced front and rear walls 1054, 1055, and spaced top and bottom walls 1056, 1057. As with the single and double width horizontal modules 30, 40, the less than single width horizontal module 1050 can have any suitable height H less than the height H of the laundry appliance 10. The less than single width horizontal module 1050 has a width W less than the width W of the laundry appliance 10. For example, the width W of the less than single width horizontal module 1050 can be about equal to the width D of one or more the vertical modules 50, 60. When the width W of the less than single width horizontal module 1050 is about the same as that of the one or more vertical modules 50, 60, the less than single width horizontal module 1050 can be arranged above or below the one or more vertical modules 50, 60 with the left side walls 52 or 62, 1052 forming a generally continuous surface and the right side walls 53 or 63, 1053 likewise forming a generally continuous surface. Further, the less than single width horizontal module 1050 can have any suitable depth D, and an exemplary depth D for the less than single width horizontal module 1050 is about equal to the depth D of the laundry appliance 10. A symbol for the less than single width horizontal module 1050 is illustrated in FIG. 4B. The symbol corresponds to the front wall 1054 of the less than single width horizontal module 1050, and, therefore, the shape of the symbol is determined by the width W and the height H.

Figure 4C:
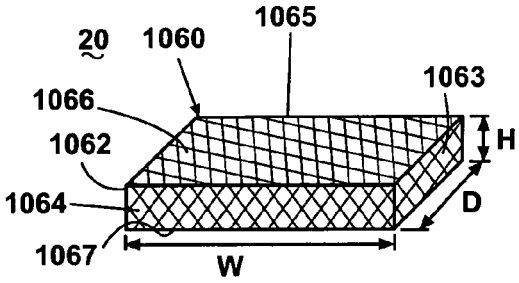
FIG. 4C is a schematic view of an intermediate width horizontal module according to one embodiment of the invention.
Figure 4D:
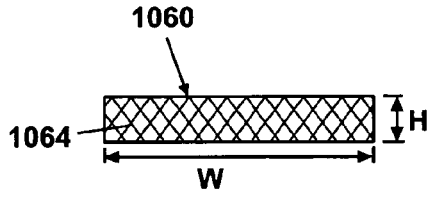
FIG. 4D is view of a symbol representative of the intermediate width horizontal module of FIG. 4C.

FIG. 4C illustrates the intermediate width horizontal module 1060, which is defined by a space bounded by spaced left and right side walls 1062, 1063, spaced front and rear walls 1064, 1065, and spaced top and bottom walls 1066, 1067. The intermediate width horizontal module 1060 can have any suitable height H less than the height H of the laundry appliance 10. The intermediate width horizontal module 1060 has a width W approximately equal to a collective width of the laundry appliance 10 arranged side-by-side with one or more of the vertical modules 50, 60 and less than a collective width of two of the laundry appliances 10 arranged side-by-side. Because the width of the intermediate width horizontal module 1060 and the collective width of the laundry appliance 10 arranged side-by-side with one or more of the vertical modules 50, 60 are substantially equal, the intermediate width horizontal module 1060 can be vertically stacked with the laundry appliance 10 arranged side-by-side with one or more of the vertical modules 50, 60 such that the left side wall 1062 of the intermediate width horizontal module 1060 forms a generally continuous surface with the leftmost side wall of the laundry appliance 10 arranged side-by-side with one or more of the vertical modules 50, 60, while the right side wall 1063 of the intermediate width horizontal module 1060 forms a generally continuous surface with the rightmost side wall of the laundry appliance 10 arranged side-by-side with one or more of the vertical modules 50, 60. Further, the intermediate width horizontal module 1060 can have any suitable depth D, and an exemplary depth D for the intermediate width horizontal module 1060 is about equal to the depth D of the laundry appliance 10. A symbol for the intermediate width horizontal module 1060 is illustrated in FIG. 4D. The symbol corresponds to the front wall 1064 of the intermediate width horizontal module 1060, and, therefore, the shape of the symbol is determined by the width W and the height H.

Figure 4E:
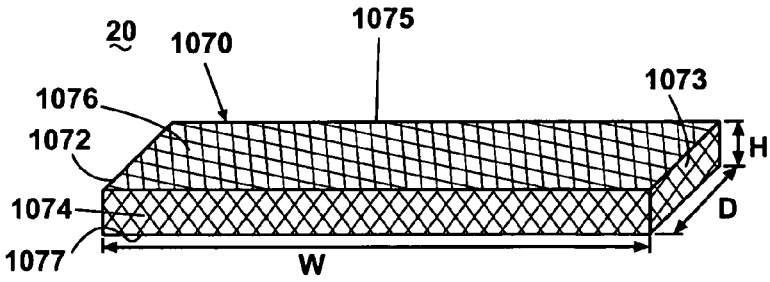
FIG. 4E is a schematic view of a greater than double width horizontal module according to one embodiment of the invention.
Figure 4F:
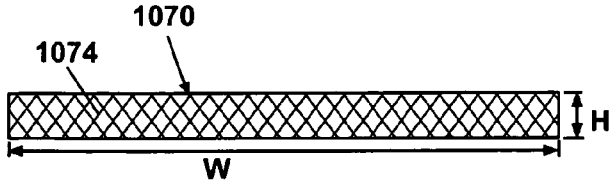
FIG. 4F is view of a symbol representative of the greater than double width horizontal module of FIG. 4E.

FIG. 4E illustrates the greater than double width horizontal module 1070, which is defined by a space bounded by spaced left and right side walls 1072, 1073, spaced front and rear walls 1074, 1075, and spaced top and bottom walls 1076, 1077. The greater than double width horizontal module 1070 can have any suitable height H less than the height H of the laundry appliance 10. The greater than double width horizontal module 1070 has a width W greater than a collective width of two of the laundry appliances 10 arranged side-by-side. For example, the width W of the greater than double width horizontal module 1070 can be about equal to a collective width of two of the laundry appliances 10 and one of the vertical modules 50, 60 arranged side-by-side or about equal to a collective width of three of the laundry appliances 10 arranged side-by-side. In the latter example, the greater than double width horizontal module 1070 can be vertically stacked with the three laundry appliances 10 arranged side-by-side such that the left side wall 1072 of the greater than double width horizontal module 1070 forms a generally continuous surface with the leftmost side wall of the three side-by-side laundry appliances 10, while the right side wall 1073 of the greater than double width horizontal module 1070 forms a generally continuous surface with the rightmost side wall of the three side-by-side laundry appliances 10. Further, the greater than double width horizontal module 1070 can have any suitable depth D, and an exemplary depth D for the greater than double width horizontal module 1070 is about equal to the depth D of the laundry appliance 10. A symbol for the greater than double width horizontal module 1070 is illustrated in FIG. 4F. The symbol corresponds to the front wall 1074 of the greater than double width horizontal module 1070, and, therefore, the shape of the symbol is determined by the width W and the height H.

Figure 5A:
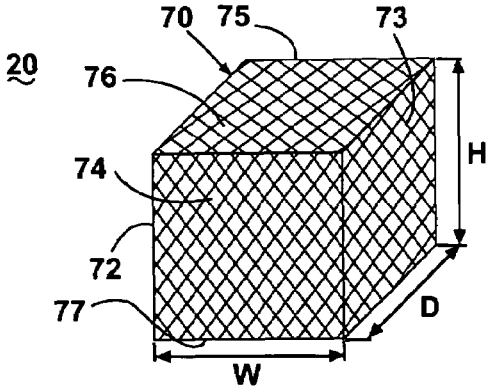
FIG. 5A is a schematic view of a single height cabinet module according to one embodiment of the invention.
Figure 5B:
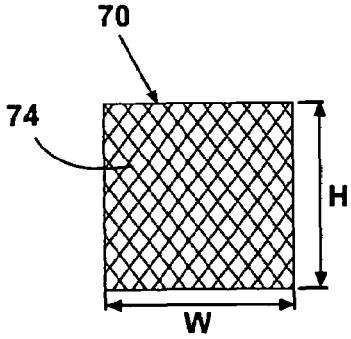
FIG. 5B is a view of a symbol representative of the single height cabinet module of FIG. 5A.

FIG. 5A illustrates a single height cabinet module 70 that is defined by a space bounded by spaced left and right side walls 72, 73, spaced front and rear walls 74, 75, and spaced top and bottom walls 76, 77. The single height cabinet module 70 has a width W and a height H approximately equal to the width W and the height H, respectively, of the laundry appliance 10. Thus, the single height cabinet module 70 can be positioned adjacent to the laundry appliance 10 with the top walls 16, 76 forming a generally continuous surface or can be vertically stacked with the laundry appliance 10, whereby the left side walls 12, 72 and the right side walls 13, 73 each form a generally continuous surface. The single height cabinet module 70 can have any suitable depth D, such as a depth equal to the depth D of the laundry appliance 10. When the depth D is equal to that of the laundry appliance 10, a footprint of the single height cabinet module 70 is the same as that of the laundry appliance 10. A symbol of the single height cabinet module 70, which corresponds to the front wall 74 of the single height cabinet module 70 and is shown in FIG. 5B, is the same as that of the laundry appliance 10, except for cross-hatching, which indicates that the symbol represents one of the modules 20.

Figure 5C:
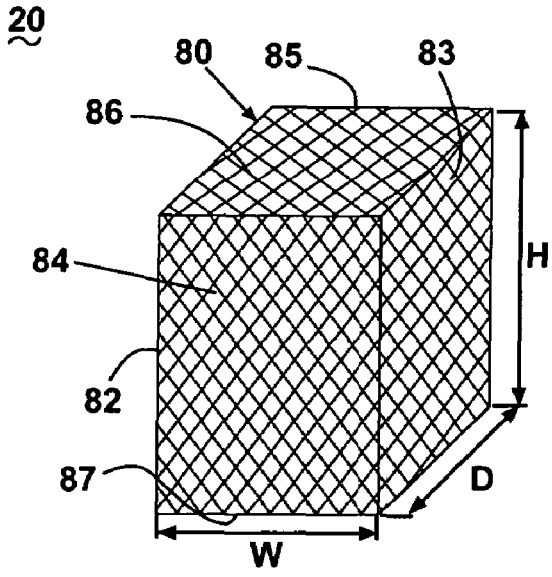
FIG. 5C is a schematic view of an intermediate height cabinet module according to one embodiment of the invention.
Figure 5D:
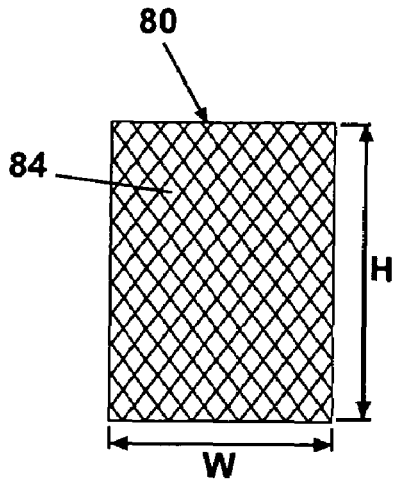
FIG. 5D is a view of a symbol representative of the intermediate height cabinet module of FIG. 5C.

FIG. 5C depicts an intermediate height cabinet module 80 that is defined by a space bounded by spaced left and right side walls 82, 83, spaced front and rear walls 84, 85, and spaced top and bottom walls 86, 87. The intermediate height cabinet module 80 has a width W approximately equal to the width W of the laundry appliance 10. Further, the intermediate height cabinet module 80 has a height H approximately equal to the height of the laundry appliance 10 vertically stacked with one or more of the horizontal modules 30, 40, 1050, 1060, 1070 and less than a collective height of two of the laundry appliances 10 vertically stacked. Because the height H of the intermediate height cabinet module 80 and the height of the laundry appliance 10 vertically stacked with one or more of the horizontal modules 30, 40, 1050, 1060, 1070 are substantially equal, the intermediate height cabinet module 80 can be positioned in a side-by-side relationship with the laundry appliance 10 vertically stacked with one or more of the horizontal modules 30, 40, 1050, 1060, 1070 such that the top wall 86 of the intermediate height cabinet module 80 and the top wall of the laundry appliance 10 or the one or more of the horizontal modules 30, 40, 1050, 1060, 1070, depending on the relative vertical positioning, form a generally continuous surface. The intermediate height cabinet module 80 can have any suitable depth D, such as a depth equal to the depth D of the laundry appliance 10. When the depth D is equal to that of the laundry appliance 10, intermediate height cabinet module 80 has a footprint that is the same as that of the laundry appliance 10. A symbol for the intermediate height cabinet module 80 is illustrated in FIG. 5D. The symbol corresponds to the front wall 84 of the intermediate height cabinet module 80, and, therefore, the shape of the symbol is determined by the width W and the height H.

Figure 5E:
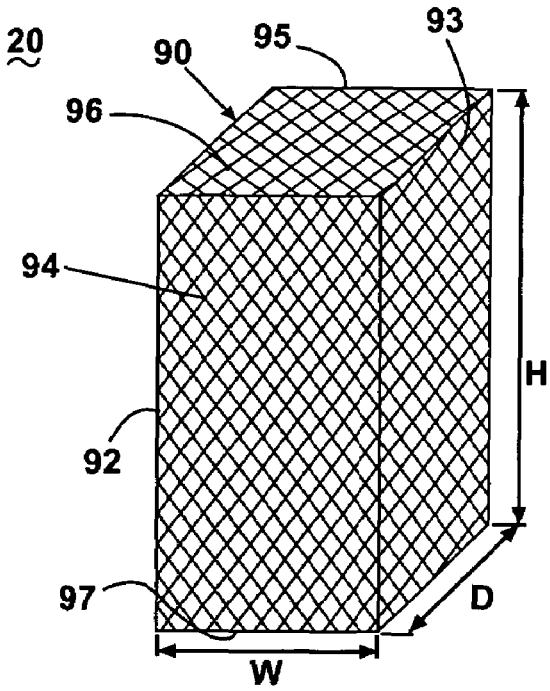
FIG. 5E is a schematic view of a double height cabinet module according to one embodiment of the invention.
Figure 5F:
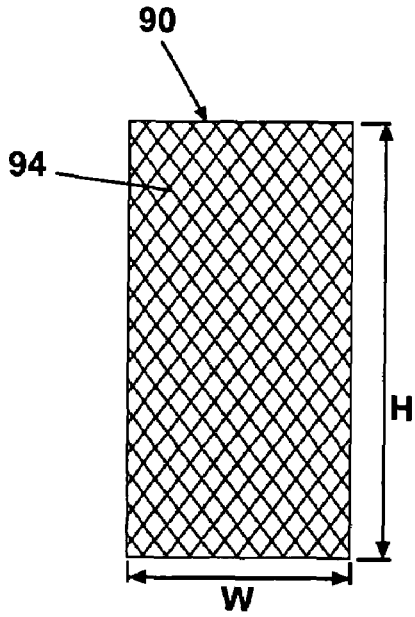
FIG. 5F is a view of a symbol representative of the double height cabinet module of FIG. 5E.

FIG. 5E shows a double height cabinet module 90 that is defined by a space bounded by spaced left and right side walls 92, 93, spaced front and rear walls 94, 95, and spaced top and bottom walls 96, 97. The double height cabinet module 90 has a width W approximately equal to the width W of the laundry appliance 10. Further, the double height cabinet module 90 has a height H approximately equal to a height of two vertically stacked laundry appliances 10 or approximately equal to a collective height of two of the laundry appliances 10, i.e., the first and second laundry appliances, which can have differing individual heights. Because the height H of the double height cabinet module 90 and the height of the two vertically stacked laundry appliances 10 are substantially equal, the double height cabinet module 90 can be positioned in a side-by-side relationship with the two vertically stacked laundry appliances 10 such that the top wall 96 of the double height cabinet module 90 and the top wall 16 of the upper laundry appliance 10 form a generally continuous surface. The double height cabinet module 90 can have any suitable depth D, such as a depth equal to the depth D of the laundry appliance 10. When the depth D is equal to that of the laundry appliance 10, the double height cabinet module 90 has a footprint that is the same as that of the laundry appliance 10. A symbol for the double height cabinet module 90 is illustrated in FIG. 5F. The symbol corresponds to the front wall 94 of the double height cabinet module 90, and, therefore, the shape of the symbol is determined by the width W and the height H.

The single and intermediate height vertical modules 50, 60 and the single and intermediate height cabinet modules 70, 80 are geometrically similar in that their heights H can be about equal to the height of the laundry appliance 10 alone for the single height vertical and cabinet modules 50, 70 or vertically stacked with one or more of the horizontal modules 30, 40, 1050, 1060, 1070 for the intermediate height vertical and cabinet modules 60, 80. Furthermore, although not disclosed above, it is within the scope of the invention for one of the modules 20 to be a double height vertical module, which would be a counterpart to the double height cabinet module 90 with respect to height. The heights H of both of the double height vertical module and the double height cabinet module 90 are about equal to that of two of the laundry appliances 10 vertically stacked. The primary differentiating geometrical feature between the vertical modules 50, 60 and the cabinet modules 70, 80, 90 is width. While the width of the vertical modules 50, 60 is less than a standard width, i.e., the width W of the laundry appliance 10, the width W of the cabinet modules 70, 80, 90 is about equal to the standard width. A possible guideline for the standard width is the table given above for the dimensions of the multiple commercially available washing machines and dryers.

In the above descriptions of the laundry appliances 10 and of each type of the modules 20, the laundry appliance 10 and the modules 20 are described as being is defined by a space bounded by walls, and in the corresponding schematic figures, the laundry appliances 10 and the modules 20 are represented schematically by boxes defined by the walls of the space. When the laundry appliances 10 and the modules 20 are box-like with six generally planar walls joined at their edges, then the walls of the space and the walls of the laundry appliance 10 or module 20 are effectively the same, and the walls in the schematic figures effectively correspond to the walls of the box-like laundry appliance 10 or module 20. However, when the laundry appliances 10 and the modules 20 are not box-like, the walls of the space do not necessarily conform to the walls of the laundry appliance 10 or the module 20. Some of the walls of the space might correspond to the walls of the laundry appliance 10 or the module 20, but the portion of the laundry appliance 10 or module 20 that causes the laundry appliance 10 or the module 20 to deviate from the box-like shape do not correspond to the walls of the space. Thus, the walls in the schematic figures do not necessarily correspond to the walls of the non-box-like laundry appliance 10 or module 20; rather, the totality of the walls used in the schematic representations of each of the non-box-like laundry appliances 10 and modules 20 only represents the space in which the laundry appliance 10 or module 20 fits.

The dimensions of the modules 20 are described above with respect to the dimensions of the laundry appliance(s) 10 alone or in combination with the module(s) 20. The terminology used to describe each of the modules 20, i.e., less than single, single, intermediate, double, and greater than double width and single, intermediate, and double height, is meant to distinguish the modules 20 from one another and to describe the general dimensions of the modules 20 relative to the dimensions of the laundry appliance 10. The descriptors are not intended to require the modules 20 to have exactly the same width or height as the laundry appliance(s) 10 alone or in combination with the module(s) 20. Thus, it is within the scope of the invention for the modules 20 to have about the same width or height as the laundry appliance(s) 10 alone or in combination with the module(s) 20. In other words, minor deviations in width or height can be tolerated. A specific threshold for acceptance does not exist; rather, the acceptability of dimensional deviations depends on whether the deviations are sufficiently small such that they do not interfere with forming an assembly of the laundry appliances 10 and the modules 20 of the modular laundry system or with expanding an existing assembly of the modular laundry system by adding another one of the laundry appliances 10 and/or modules 20. For example, a deviation on the order of multiple inches is likely to be considered not acceptable, while deviations of fractions of an inch are more likely to be deemed acceptable. Additionally, it is within the scope of the invention to add height to the modules 20 with a base or pedestal positioned below or above the modules 20 so that the modules 20 conform to the respective height requirements.

Figure 6:
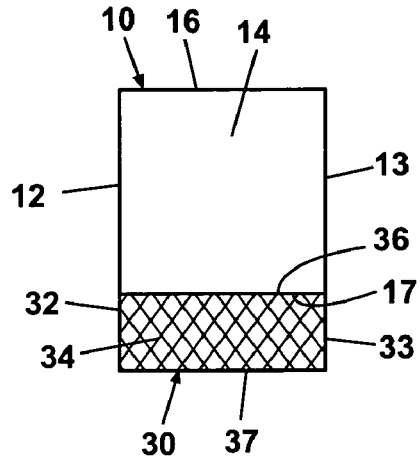
FIG. 6 is a schematic view of an arrangement of the laundry appliance of FIG. 1A and the single width horizontal module of FIG. 2A, wherein the arrangement forms generally continuous left and right side walls.

Additionally, the above description identifies arranging the modules 20 with the laundry appliance(s) 10 alone or in combination with the module(s) 20 based on the relative dimensions of the laundry appliances 10 and the modules 20. The arrangements are formed by vertically stacking the modules 20 with the laundry appliances 10 or positioning the modules 20 in side-by-side relationship with the laundry appliances 10. Each of the arrangements calls for formation of a generally continuous surface by the side walls or the top walls, and the laundry appliances 10 and the modules 20 can also be arranged so that the front wall 14 of the laundry appliance 10 and the front walls 34, 44, 54, 64, 74, 84, 94, 1054, 1064, 1074 of the modules 20 are flush and form a generally continuous surface, regardless of whether the laundry appliances 10 and the modules 20 have the same or differing depths D. An example of an arrangement of the laundry appliances 10 and the modules 20 with generally continuous surfaces is illustrated schematically in FIG. 6. In this example, the laundry appliance 10 is stacked with the single width horizontal module 30 with the left side walls 12, 32 forming a generally continuous surface and the right side walls 13, 33 forming a generally continuous surface. The generally continuous surface does not require the individual walls that form the generally continuous surface to lie in the same plane; rather, it is within the scope of the invention for the walls to be slightly offset from one another.

Figure 7A:
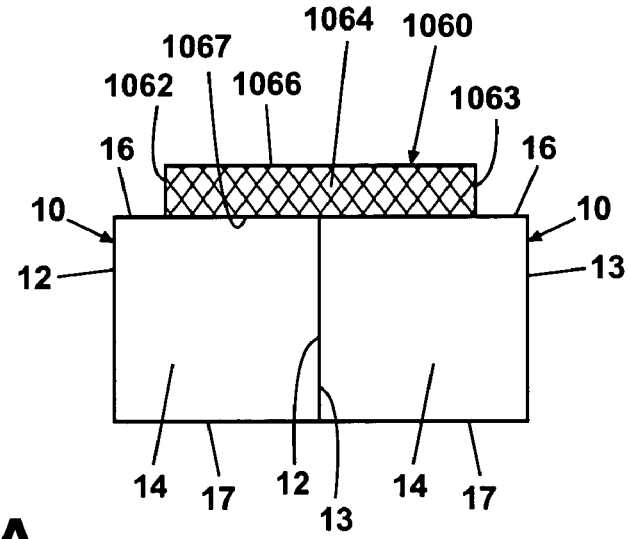
FIG. 7A is a schematic view of an arrangement of two of the laundry appliances of FIG. 1A and the intermediate width horizontal module of FIG. 4C, wherein the intermediate width horizontal module spans an interface between the laundry appliances.
Figure 7B:
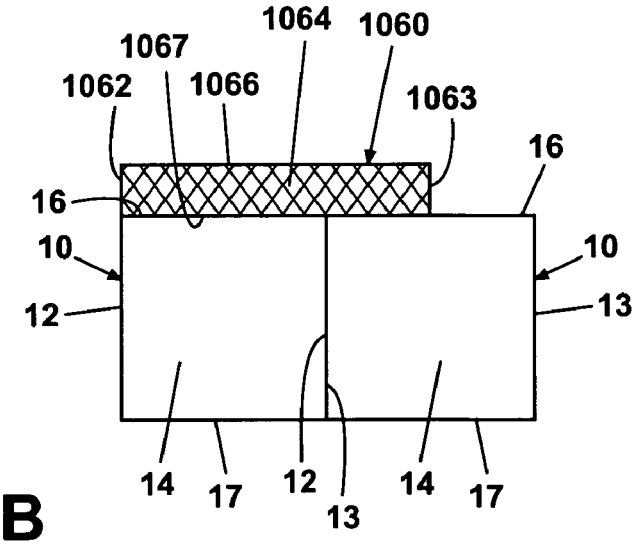
FIG. 7B is a schematic view of an arrangement of two of the laundry appliances of FIG. 1A and the intermediate width horizontal module of FIG. 4C, wherein the intermediate width horizontal module spans the interface between the laundry appliances, and the arrangement forms a generally continuous left side wall.

Other arrangements of the laundry appliances 10 and the modules 20 can be made without formation of the continuous surface. An example of an arrangement of the laundry appliances 10 and the modules 20 without formation of the generally continuous surfaces is illustrated schematically in FIG. 7A. In this example, two of the laundry appliances 10 are arranged side-by-side with the left side wall 13 of one of the laundry appliances 10 adjacent to the right side wall 12 of the other of the laundry appliances 10 to form an interface between the laundry appliances 10. The interface can be formed by the left and right side walls 12, 13 contacting one another or by a space formed between the adjacent left and right side walls 12, 13. The intermediate width horizontal module 1060 is stacked with the laundry appliances 10 such that the intermediate width horizontal module 1060 spans the interface between the laundry appliances 10. Hybrid arrangements are also contemplated, as shown schematically in FIG. 7B. In this example, two of the laundry appliances 10 are arranged side-by-side with the left side wall 13 of one of the laundry appliances 10 adjacent to the right side wall 12 of the other of the laundry appliances 10 to form the interface between the laundry appliances 10. The intermediate width horizontal module 1060 is stacked with the laundry appliances 10 such that the intermediate width horizontal module 1060 spans the interface as well as forms a generally continuous surface at the left side wall 12 of one of the laundry appliances 10 and the left side wall 1062 of the intermediate width horizontal module 1060. In addition to the arrangements described above, the modules 20 can be combined with the laundry appliances 10 and other modules 20 to form other arrangements that include and do not include formation of a generally continuous surface.

According to the invention, the laundry appliances 10 and the modules 20 can be arranged into core configurations, wherein each core configuration comprises a pair of the laundry appliances 10 and one or two of the modules 20. The core configuration can be viewed as a foundation to which other modules 20 can be added to form more complex configurations. Examples of the core configurations are illustrated in FIGS. 8A-15B. In the following descriptions, the laundry appliances 10 and the modules 20 are described as being horizontally arranged, vertically arranged, or stacked. The horizontal and vertical arrangements refer to the laundry appliances 10 and/or the modules 20 as positioned horizontally and vertically, respectively, relative to one another in space and does not require, although it is possible, for the laundry appliances 10 and/or the modules 20 to be directly horizontally or vertically adjacent to one another (i.e., without an intervening laundry appliance 10 or module 20). The stacked descriptor is intended to be equivalent to vertically arranged and does not require the laundry appliances 10 and/or the modules 20 to be directly vertically adjacent to one another.

Figure 8A:
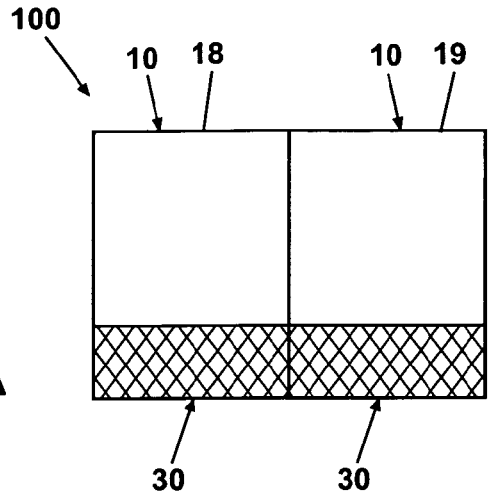
FIG. 8A is a schematic view of a core configuration A formed by two of the laundry appliances of FIG. 1A in a horizontal arrangement and two of the single width horizontal modules of FIG. 2A vertically stacked with the laundry appliances.
Figure 8B:
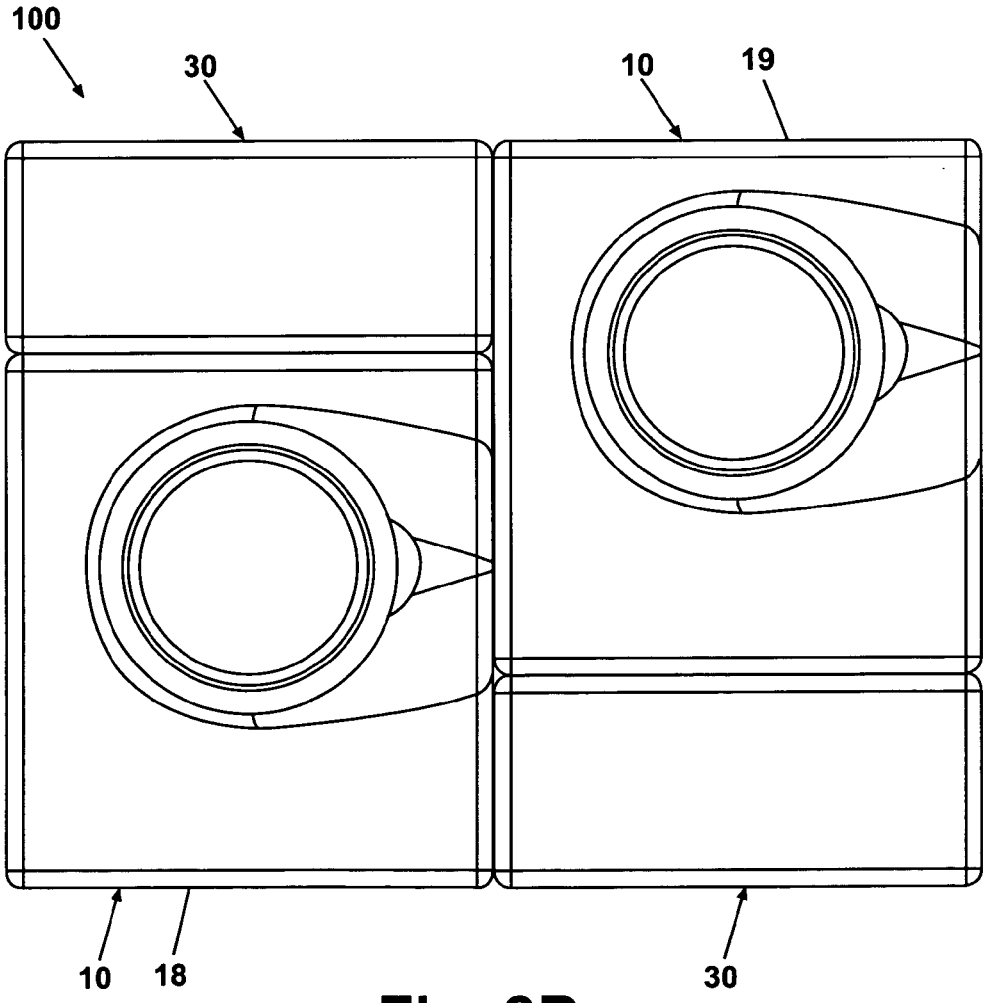
FIG. 8B is a schematic view of the core configuration A of FIG. 8A with the one of the single width horizontal modules stacked above one of the laundry appliances and the other of the single width horizontal modules stacked below the other of the laundry appliances.

FIG. 8A illustrates a core configuration A 100 comprising two of the laundry appliances 10, a first laundry appliance 18 and a second laundry appliance 19, arranged in a horizontal relationship and two of the single width horizontal modules 30. According to the illustrated embodiment, the single width horizontal modules 30 are each vertically stacked beneath one of the laundry appliances 10. The single width horizontal modules 30 can also be both vertically stacked above the respective laundry appliances 10, or one of the single width horizontal modules 30 can be vertically stacked above its respective laundry appliance 10 while the other of the single width horizontal modules 30 can be vertically stacked below its respective laundry appliance 10, as shown in FIG. 8B.

Figure 9:
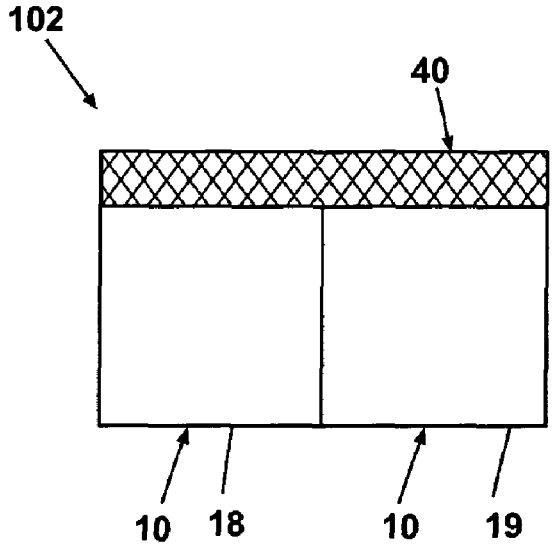
FIG. 9 is a schematic view of a core configuration B formed by two of the laundry appliances of FIG. 1A in a horizontal arrangement and the double width horizontal module of FIG. 2C vertically stacked with the laundry appliances.

FIG. 9 illustrates a core configuration B 102 comprising two of the laundry appliances 10, the first laundry appliance 18 and the second laundry appliance 19, arranged in a horizontal relationship and one of the double width horizontal modules 40. According to the illustrated embodiment, the double width horizontal module 40 is vertically stacked above and extends across both of the laundry appliances 10. The double width horizontal module 40 can also be described as completely spanning both of the laundry appliances 10, as compared to the intermediate width horizontal module 1060 in the arrangement of FIG. 7A, wherein the intermediate width horizontal module 1060 partially spans both the laundry appliances 10. The double width horizontal module 40 can also be vertically stacked below both of the laundry appliances 10.

Figure 10:
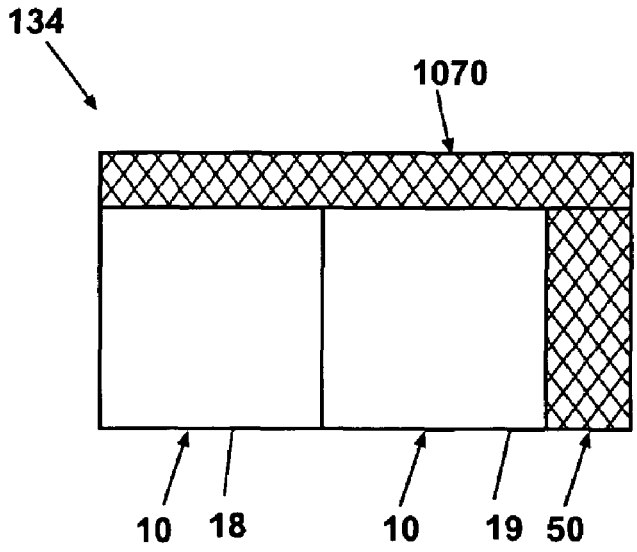
FIG. 10 is a schematic view of a core configuration R formed by two of the laundry appliances of FIG. 1A and one of the single height vertical modules of FIG. 3A in a horizontal arrangement and the greater than double width horizontal module of FIG. 4E vertically stacked with the laundry appliances and the single height vertical module.

FIG. 10 illustrates a core configuration R 134 comprising two of the laundry appliances 10, the first laundry appliance 18 and the second laundry appliance 19, arranged in a horizontal relationship and one of the single height vertical modules 50 horizontally arranged relative to the first and second laundry appliances 18, 19. The core configuration R 134 further comprises the greater than double width horizontal module 1070 stacked with the first and second laundry appliances 18, 19 and the single height vertical module 50.

Figure 11A:
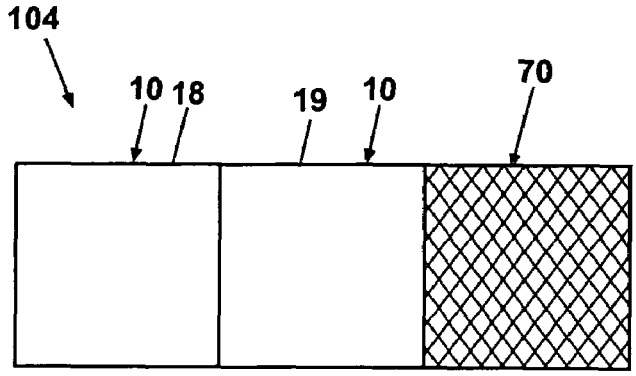
FIG. 11A is a schematic view of a core configuration C formed by two of the laundry appliances of FIG. 1A in a horizontal arrangement and the single height cabinet module of FIG. 5A positioned adjacent to the laundry appliances.
Figure 11B:
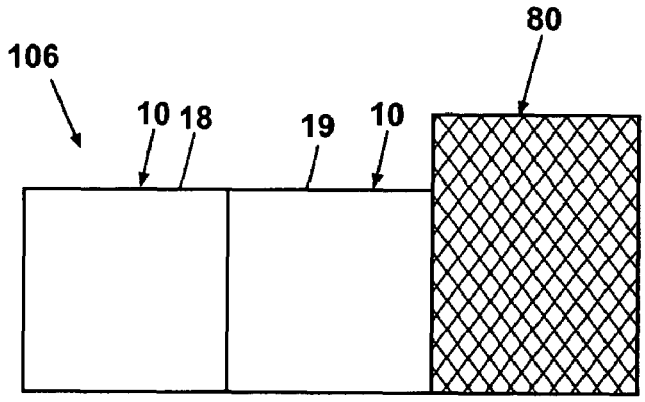
FIG. 11B is a schematic view of a core configuration D formed by two of the laundry appliances of FIG. 1A in a horizontal arrangement and the intermediate height cabinet module of FIG. 5C positioned adjacent to the laundry appliances.
Figure 11C:
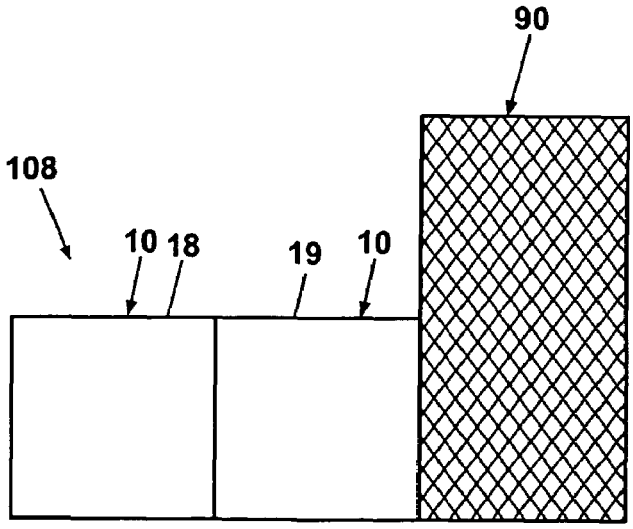
FIG. 11C is a schematic view of a core configuration E formed by two of the laundry appliances of FIG. 1A in a horizontal arrangement and the double height cabinet module of FIG. 5E positioned adjacent to the laundry appliances.

FIGS. 11A-11C illustrate core configurations comprising two of the laundry appliances 10, the first laundry appliance 18 and the second laundry appliance 19, in a horizontal arrangement and one of the cabinet modules 70, 80, 90 horizontally arranged relative to the first and second laundry appliances 18, 19. Thus, the core configurations of FIGS. 11A-11C each have a configuration footprint having a width about equal to that of three horizontally aligned laundry appliances 10. In a core configuration C 104, shown in FIG. 11A, the cabinet module is the single height cabinet module 70. According to the illustrated embodiment, the first and second laundry appliances 18, 19 are side-by-side, and the single height cabinet module 70 is positioned directly adjacent to only the second laundry appliance 19. Alternatively, the single height cabinet module 70 can be positioned directly adjacent to only the first laundry appliance 18 or between the first and the second laundry appliances 18, 19. In a core configuration D 106, shown in FIG. 11B, the cabinet module is the intermediate height cabinet module 80. According to the illustrated embodiment, the first and second laundry appliances 18, 19 are side-by-side, and the intermediate height cabinet module 80 is positioned directly adjacent to only the second laundry appliance 19. Alternatively, the intermediate height cabinet module 80 can be positioned directly adjacent to only the first laundry appliance 18 or between the first and the second laundry appliances 18, 19. In a core configuration E 108, shown in FIG. 11C, the cabinet module is the double height cabinet module 90. According to the illustrated embodiment, the first and second laundry appliances 18, 19 are side-by-side, and the double height cabinet module 90 is positioned directly adjacent to only the second laundry appliance 19. Alternatively, the double height cabinet module 90 can be positioned directly adjacent to only the first laundry appliance 18 or between the first and the second laundry appliances 18, 19.

Figure 12A:
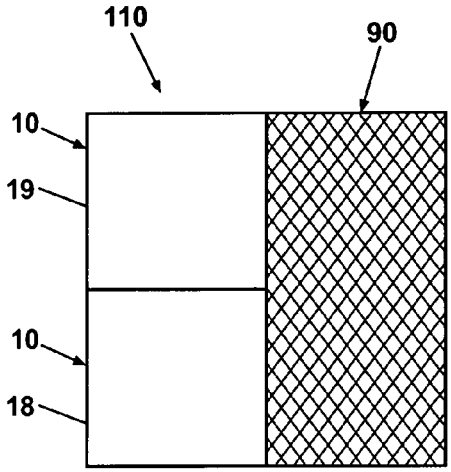
FIG. 12A is a schematic view of a core configuration F formed by two of the laundry appliances of FIG. 1A in a vertical arrangement and the double height cabinet module of FIG. 5E positioned adjacent to the laundry appliances.
Figure 12B:
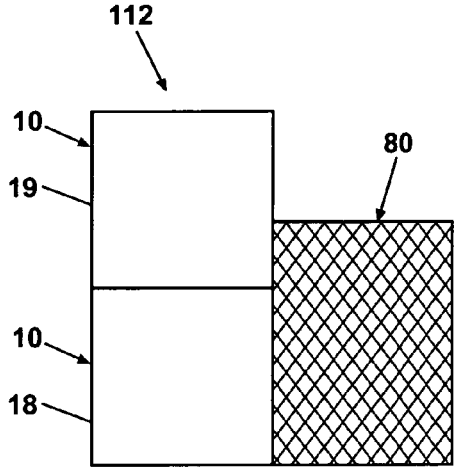
FIG. 12B is a schematic view of a core configuration G formed by two of the laundry appliances of FIG. 1A in a vertical arrangement and the intermediate height cabinet module of FIG. 5C positioned adjacent to the laundry appliances.
Figure 12C:
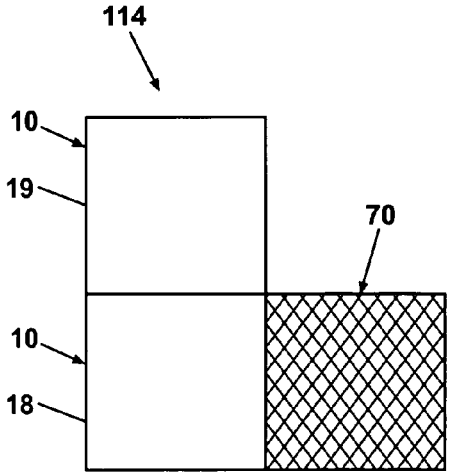
FIG. 12C is a schematic view of a core configuration H formed by two of the laundry appliances of FIG. 1A in a vertical arrangement and the single height cabinet module of FIG. 5A positioned adjacent to the laundry appliances.
Figure 12D:
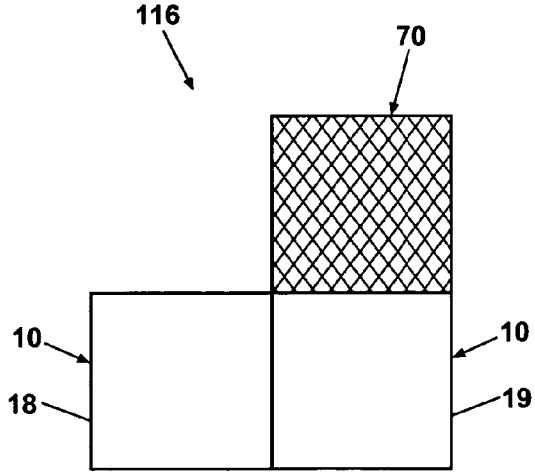
FIG. 12D is a schematic view of a core configuration I formed by two of the laundry appliances of FIG. 1A in a horizontal arrangement and the single height cabinet module of FIG. 5A vertically stacked with one of the laundry appliances.

FIGS. 12A-12D illustrate core configurations comprising two of the laundry appliances 10, the first laundry appliance 18 and the second laundry appliance 19, in either a horizontal or vertical arrangement and one of the cabinet modules 70, 80, 90 arranged relative to the first and second laundry appliances 18, 19 to form a configuration footprint having width about equal to that of two horizontally arranged laundry appliances 10 or that of one of the laundry appliances 10 horizontally arranged with one of the cabinet modules 70, 80, 90. In a core configuration F 110, shown in FIG. 12A, the cabinet module is the double height cabinet module 90, and the first and second laundry appliances 18, 19 are vertically stacked adjacent to the cabinet module 90. In the illustrated embodiment, the double height cabinet module 90 is on the right side of the first and second laundry appliances 18, 19, but the double height cabinet module 90 can be located on the left side of the first and second laundry appliances 18, 19. A core configuration G 112, shown in FIG. 12B, and a core configuration H 114, illustrated in FIG. 12C, are similar to the core configuration F 110, except that the cabinet module is the intermediate height cabinet module 80 and the single height cabinet module 70, respectively. In a core configuration I 116, depicted in FIG. 12D, the first and second laundry appliances 18, 19 are horizontally arranged, and the cabinet module, which is the single height cabinet module 70, is vertically stacked on top of the second laundry appliance 19. Alternatively, the single height cabinet module 70 can be stacked on top of the first laundry appliance 18 or below either of the first and second laundry appliances 18, 19.

Figure 13A:
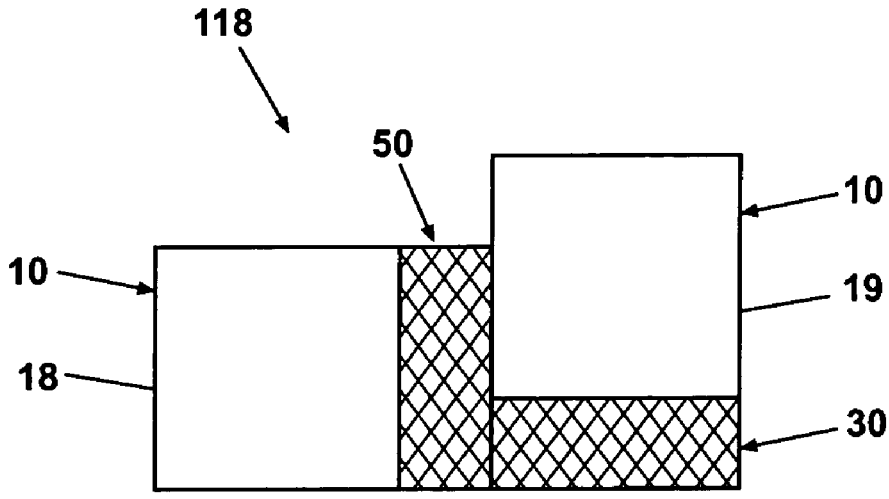
FIG. 13A is a schematic view of a core configuration J formed by two of the laundry appliances of FIG. 1A in a horizontal arrangement, the single height vertical module of FIG. 3A positioned adjacent to the laundry appliances, and the single width horizontal module of FIG. 2A vertically stacked with one of the laundry appliances.
Figure 13B:
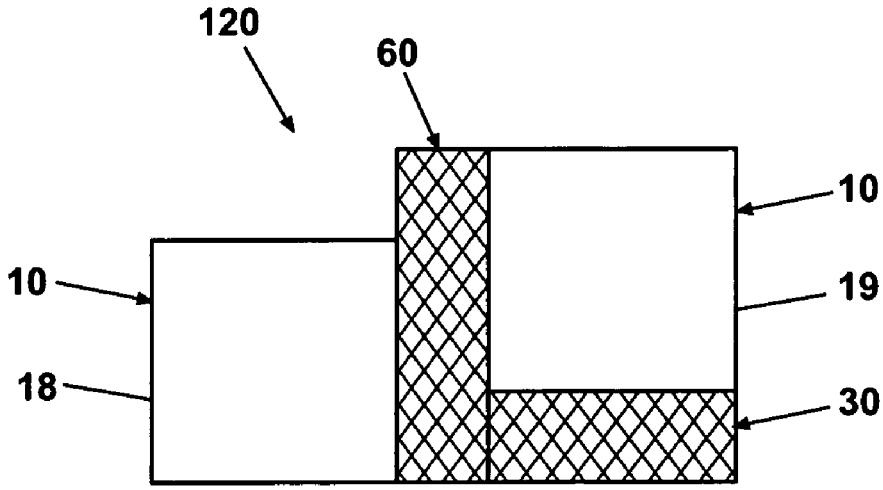
FIG. 13B is a schematic view of a core configuration K formed by two of the laundry appliances of FIG. 1A in a horizontal arrangement, the double height vertical module of FIG. 3C positioned adjacent to the laundry appliances, and the single width horizontal module of FIG. 2A vertically stacked with one of the laundry appliances.

FIGS. 13A and 13B illustrate core configurations comprising two of the laundry appliances 10, the first laundry appliance 18 and the second laundry appliance 19, one of the single width horizontal modules 30, and one of the vertical modules 50, 60. In both of the figures, the first and second laundry appliances 18, 19 are horizontally arranged with the single width horizontal module 30 located below the second laundry appliance 19. Alternatively, the single width horizontal module 30 can be positioned above the second laundry appliance 19 or above or below the first laundry appliance 18. In a core configuration J 118, shown in FIG. 13A, the vertical module is the single height vertical module 50. In the illustrated embodiment, the single height vertical module 50 is located between the first and second laundry appliances 18, 19. Alternatively, the single height vertical module 50 can be positioned to the left of the first laundry appliance 18 or to the right of the second laundry appliance 19. In a core configuration K 120, depicted in FIG. 13B, the vertical module is the intermediate height vertical module 60. In the illustrated embodiment, the intermediate height vertical module 60 is located between the first and second laundry appliances 18, 19. Alternatively, the intermediate height vertical module 60 can be positioned to the left of the first laundry appliance 18 or to the right of the second laundry appliance 19. Regardless of the relative positioning of the modules 50, 60 in the core configuration J 118 and the core configuration K 120, each of the core configurations J and K 118, 120 have a configuration footprint having a width about equal to the width of two side-by-side laundry appliances 10 plus the width of the single or intermediate height vertical module 50, 60. Because the vertical modules 50, 60 each have a width less than that of the laundry appliance 10, the configuration footprint is wider than that of two side-by-side laundry appliances 10 but less wide than that of three side-by-side laundry appliances 10.

Figure 14A:
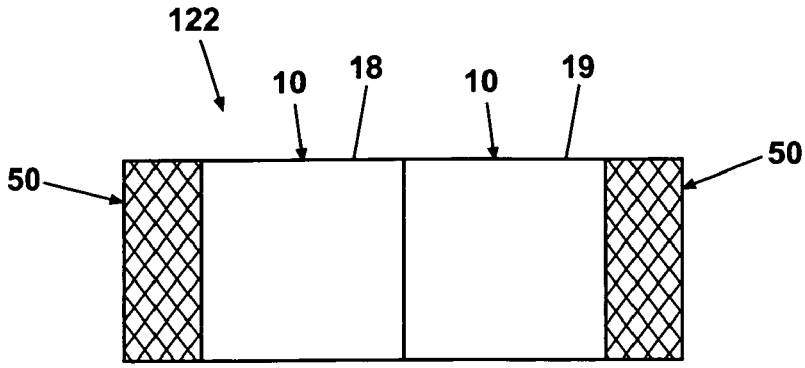
FIG. 14A is a schematic view of a core configuration L formed by two of the laundry appliances of FIG. 1A in a horizontal arrangement and two of the single height vertical modules of FIG. 3A positioned adjacent to the laundry appliances.
Figure 14B:
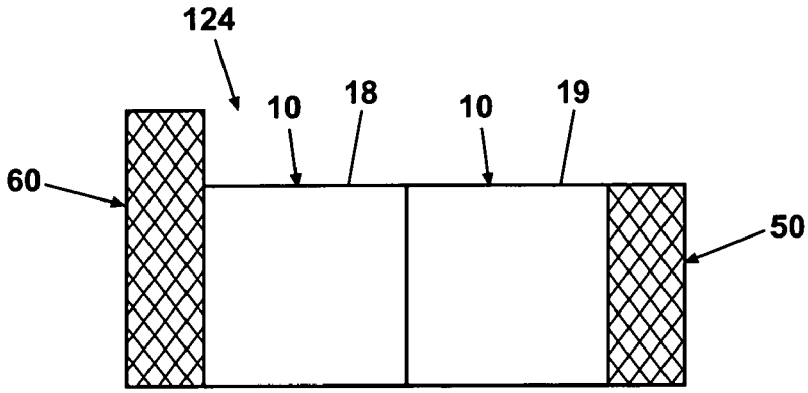
FIG. 14B is a schematic view of a core configuration M formed by two of the laundry appliances of FIG. 1A in a horizontal arrangement and one each of the single height vertical module of FIG. 3A and the intermediate height vertical module of FIG. 3C positioned adjacent to the laundry appliances.
Figure 14C:
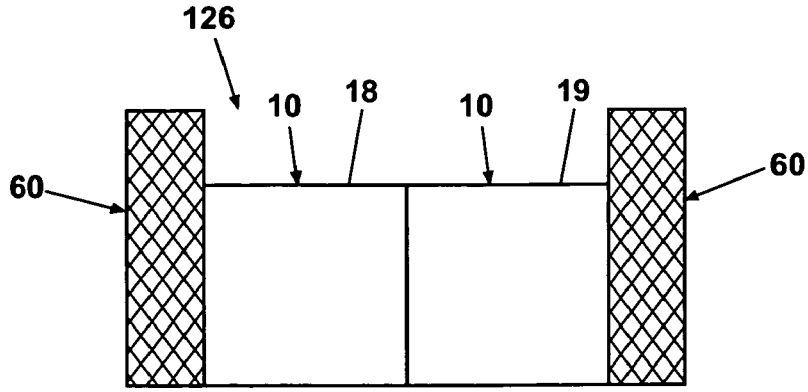
FIG. 14C is a schematic view of a core configuration N formed by two of the laundry appliances of FIG. 1A in a horizontal arrangement and two of the intermediate height vertical modules of FIG. 3C positioned adjacent to the laundry appliances.

FIGS. 14A-14C illustrate core configurations comprising two of the laundry appliances 10, the first laundry appliance 18 and the second laundry appliance 19, in a horizontal arrangement and two of the vertical modules 50, 60. In a core configuration L 122, shown in FIG. 14A, both of the vertical modules are the single height vertical modules 50. In the illustrated embodiment, the single height vertical modules 50 are arranged with one on the left side of the first laundry appliance 18 and the other on the right side of the second laundry appliance 19; thus, the single height vertical modules 50 are located on the ends of the core configuration L 122. Alternatively, the single height vertical modules 50 can be positioned with both between the first and second laundry appliances 18, 19, both to the left side of the first laundry appliance 18, both to the right side of the second laundry appliance 19, or one between the laundry appliances 18, 19 and the other either on the left side of the first laundry appliance 18 or on the right side of the second laundry appliance 19. A core configuration M 124, shown in FIG. 14B, and a core configuration N 126, illustrated in FIG. 14C, are similar to the core configuration L 122, except that the two vertical modules are, for the former, the single height vertical module 50 and the intermediate height vertical module 60, or, for the latter, two of the intermediate height vertical modules 60. Regardless of the relative positioning of the modules 50, 60 and the laundry appliances 18, 19 in the core configurations L, M, N 122, 124, 126, the configuration footprint has a width about equal to the width of two side-by-side laundry appliances 10 plus the width of the two vertical modules 50, 60.

Figure 15A:
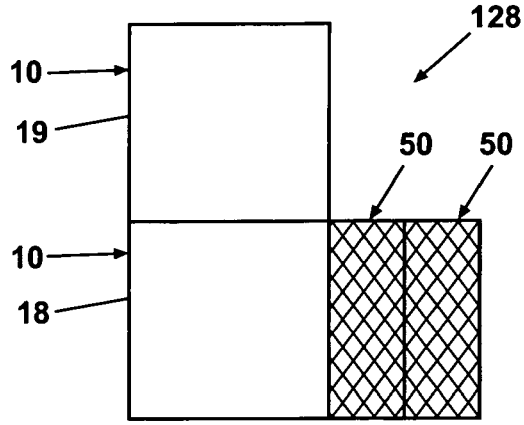
FIG. 15A is a schematic view of a core configuration O formed by two of the laundry appliances of FIG. 1A in a vertical arrangement and two of the single height vertical modules of FIG. 3A positioned adjacent to the laundry appliances.
Figure 15B:
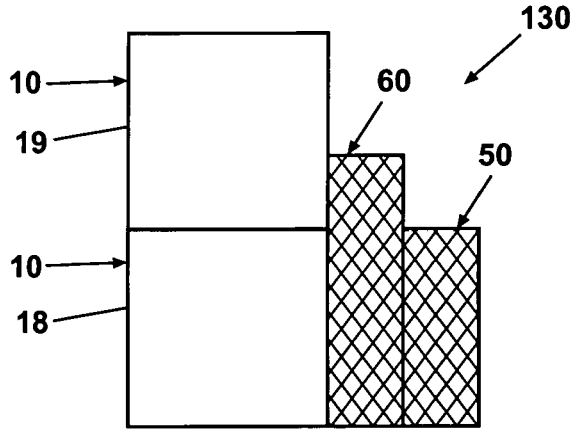
FIG. 15B is a schematic view of a core configuration P formed by two of the laundry appliances of FIG. 1A in a vertical arrangement and one each of the single height vertical module of FIG. 3A and the intermediate height vertical module of FIG. 3C positioned adjacent to the laundry appliances.
Figure 15C:
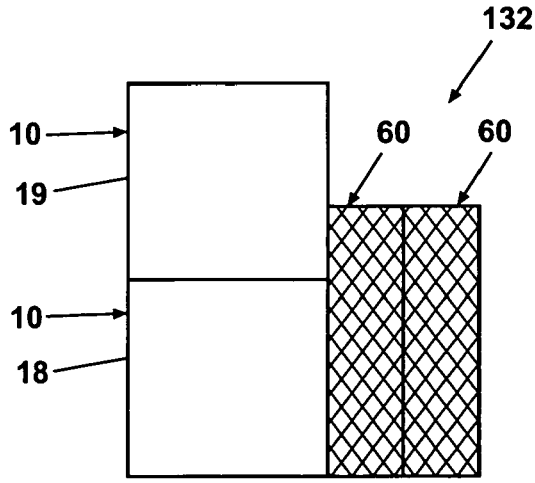
FIG. 15C is a schematic view of a core configuration Q formed by two of the laundry appliances of FIG. 1A in a vertical arrangement and two of the intermediate height vertical modules of FIG. 3C positioned adjacent to the laundry appliances.

FIGS. 15A-15C illustrate core configurations comprising two of the laundry appliances 10, the first laundry appliance 18 and the second laundry appliance 19, in a vertical arrangement and two of the vertical modules 50, 60. In a core configuration O 128, shown in FIG. 15A, both of the vertical modules are the single height vertical modules 50. In the illustrated embodiment, the single height vertical modules 50 are arranged with both on the right side of the stacked laundry appliances 10. Alternatively, the single height vertical modules 50 can be positioned with both on the left side of the stacked laundry appliances 10, or one on each side of the stacked laundry appliances 10. A core configuration P 130, shown in FIG. 15B, and a core configuration Q 132, illustrated in FIG. 15C, are similar to the core configuration O 128, except that the two vertical modules are, for the former, the single height vertical module 50 and the intermediate height vertical module 60, or, for the latter, two of the intermediate height vertical modules 60. Regardless of the relative positioning of the modules 50, 60 and the laundry appliances 18, 19 in the core configurations O, P, Q 128, 130, 132, the configuration footprint has a width about equal to the width of a single laundry appliance 10 plus the width of the two vertical modules 50, 60.

When adding the modules 20 to the laundry appliances 10 to form the core configurations, the horizontal modules 30, 40, 1050, 1060, 1070 add height to the laundry appliance 10, the vertical modules 50, 60 add width to the laundry appliance 10, and the cabinet modules 70, 80, 90 add width to the laundry appliance 10 when horizontally arranged with the laundry appliance 10 (e.g. the core configurations C-H 104-114) and add height to the laundry appliance 10 when vertically arranged with the laundry appliance 10 (e.g., the core configuration I 116). Thus, the core configuration can be selected according to the spatial limitations of the particular laundry area in which the modular laundry system is used. For example, if the laundry area has only extra width next to the laundry appliances 10, then the core configurations having only the vertical modules 50, 60 or the cabinet modules 70, 80, 90 (except the core configuration I 114) can be employed. The core configurations that fall into this group are the core configurations C-H 104-114 and the core configurations L-Q 122-132. Alternatively, if the laundry area has only extra height above the laundry appliances 10, then the core configurations having only the horizontal modules 30, 40, 1050, 1060, 1070 which are the core configurations A, B 100, 102, or the core configuration I 114, where the single height cabinet module 70 is vertically stacked with one of the laundry appliances 10, can be utilized. In another scenario, if the laundry area has extra width next to and extra height above the laundry appliances 10, then any of the core configurations A-R 100-134 can be employed as long as the core configuration fits within the spatial limitations of the laundry area. Further, any of the core configurations A-R 100-134 can be used if the laundry area does not have substantial spatial limitations.

As stated above, the modules 20 can be added to the core configurations A-R 100-134 to form more complex configurations that are customized according to the preferences of a user and to optimize the space of the laundry area. By using the core configurations A-R 100-134 and the other modules 20 as building blocks, numerous customized configurations can be constructed. The modules 20 that are added to the core configurations A-R 100-134 to form the customized configurations can depend on whether height or width or both is available in the laundry area. When adding the modules 20 to the core configurations to create the customized configurations, the horizontal modules 30, 40, 1050, 1060, 1070 add height to the laundry appliances 10 and/or the modules 20 (i.e., the horizontal modules 30, 40, 1050, 1060, 1070 can be stacked with other modules 20 in addition to being stacked with the laundry appliances 10), the vertical modules 50, 60 add width to the laundry appliances 10 and/or the modules 20, and the cabinet modules 70, 80, 90 add width to the laundry appliances 10 and/or the modules 20 when horizontally arranged with the laundry appliances 10 and/or the modules 20 and add height to the laundry appliance 10 when vertically arranged with the laundry appliances 10 and/or the modules 20. If the space of the laundry area is not limited, then any of the modules 20 can be added to the core configurations A-R 100-134. Examples of customized configurations are illustrated in FIGS. 16A-22C.

Figure 16A:
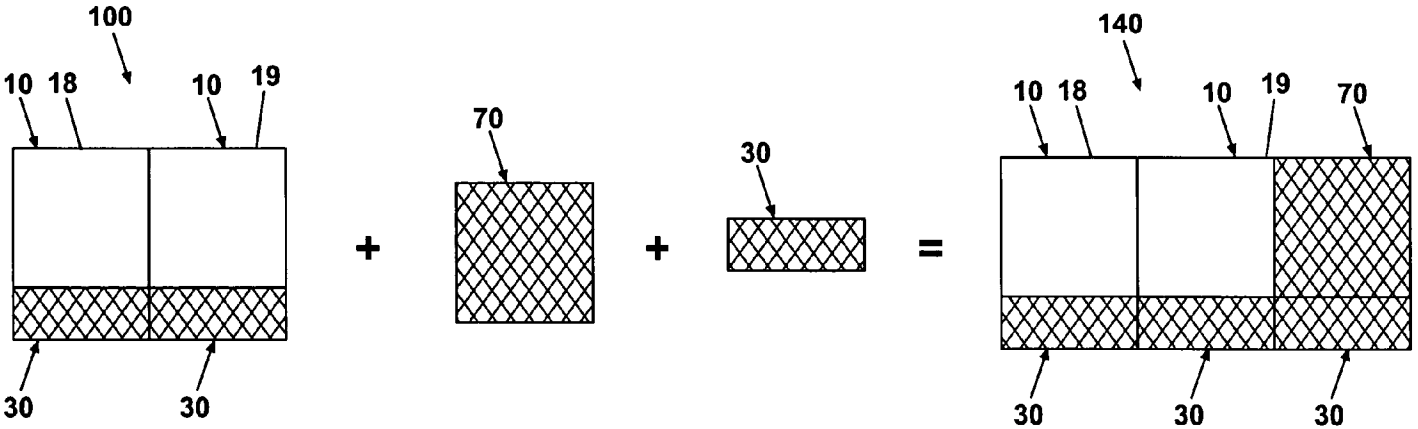
FIG. 16A is a schematic view illustrating construction of a customized configuration A formed from the core configuration A of FIG. 8A.
Figure 16B:
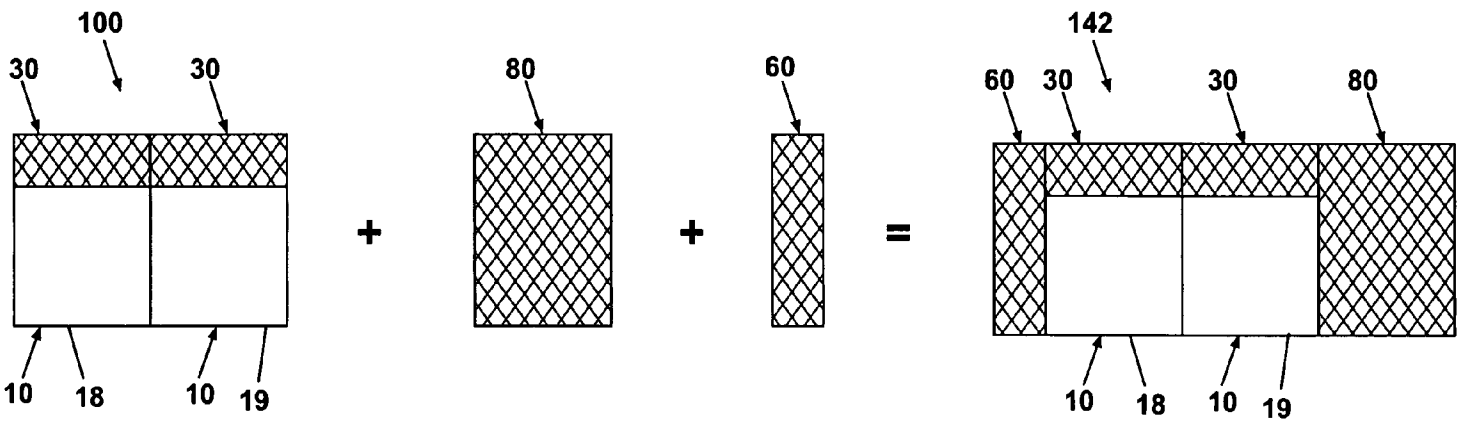
FIG. 16B is a schematic view illustrating construction of a customized configuration B formed from the core configuration A of FIG. 8A.

FIG. 16A schematically represents the construction of a customized configuration A 140 having the core configuration A 100 as the foundation. The customized configuration A 140 is formed by adding the single height cabinet module 70 and the single width horizontal module 30 to the core configuration A 100. A customized configuration B 142, shown in FIG. 16B, is also created with the core configuration A 100. The customized configuration B 142 is formed by adding the intermediate height cabinet module 80 and the intermediate height vertical module 60 to the core configuration A 100.

Inspection of the customized configurations A, B 140, 142 reveals that a particular customized configuration can be formed from more than one of the core configurations. For example, the customized configuration A 140 can be created from the core configuration A 100, as described above, or the core configuration C 104. Adding three of the single width modules 30 to the core configuration C 104 achieves the customized configuration A 140. Similarly, the customized configuration B 142 can be formed from the core configuration D 106 rather than the core configuration A 100. This is the case for many of the customized configurations shown in FIGS. 16A-22C, but each one will only be described with respect to one of the core configurations A-R 100-134.

Figure 17A:
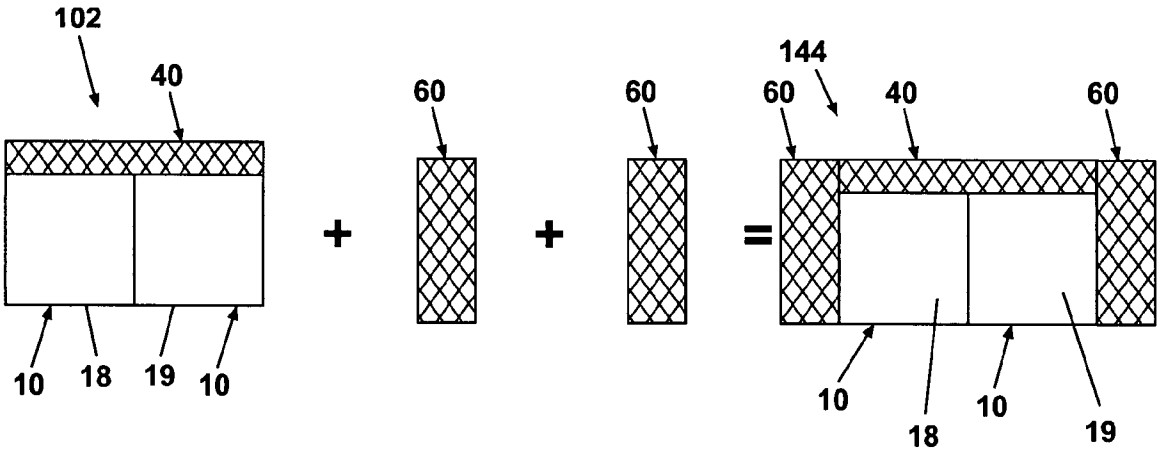
FIG. 17A is a schematic view illustrating construction of a customized configuration C formed from the core configuration B of FIG. 9.
Figure 17B:
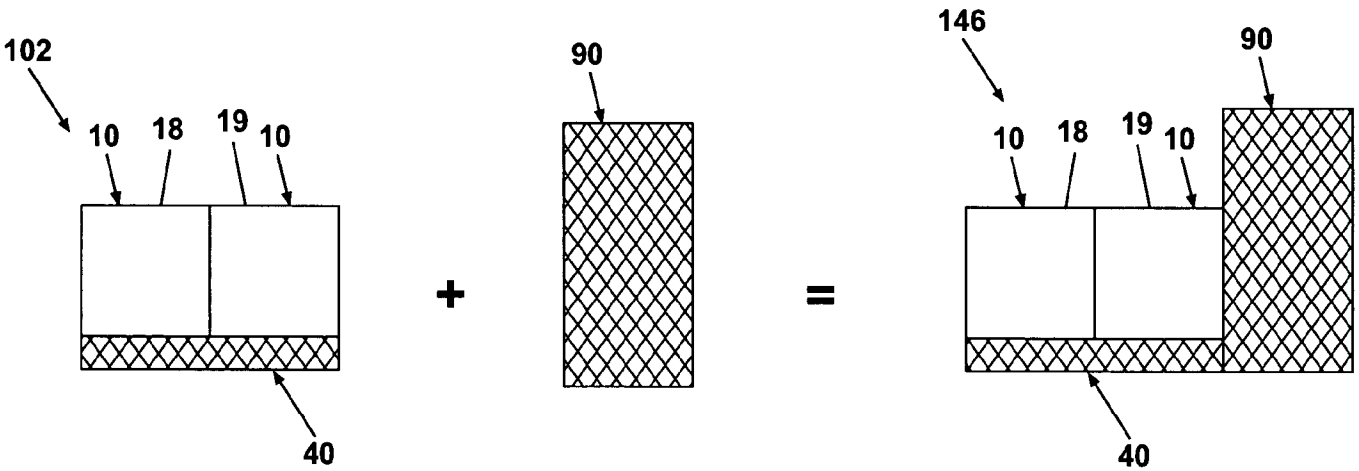
FIG. 17B is a schematic view illustrating construction of a customized configuration D formed from the core configuration B of FIG. 9.

FIGS. 17A and 17B represent construction of a customized configuration C 144 and a customized configuration D 146, respectively, from the core configuration B 102. The customized configuration C 144 is formed by adding two of the intermediate height vertical modules 60 to the core configuration B 102, while the double height cabinet module 90 is added to the core configuration B 102 to create the customized configuration D 146.

Figures 18A, 18B, 18C:
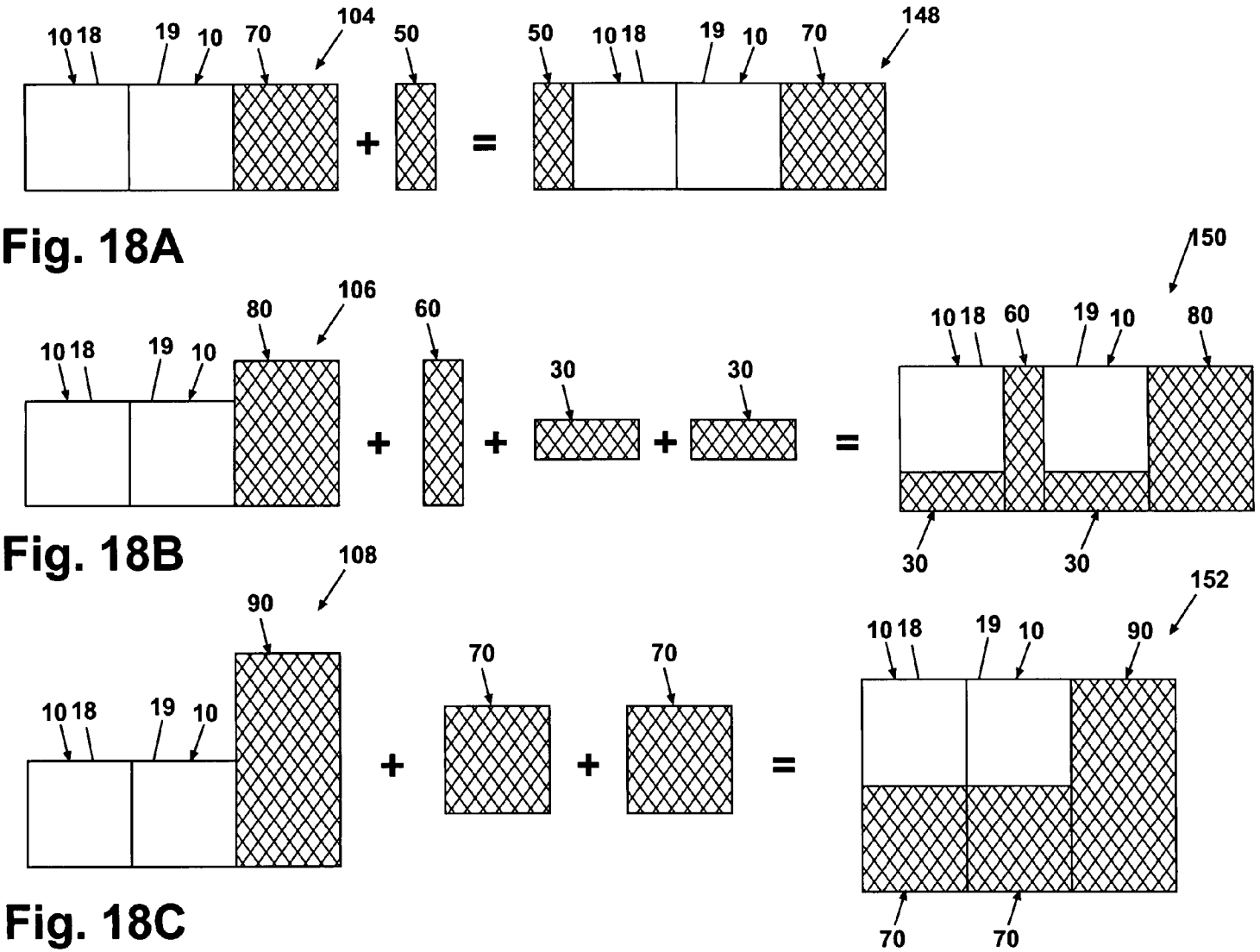
FIG. 18A is a schematic view illustrating construction of a customized configuration E formed from the core configuration C of FIG. 11 A.
FIG. 18B is a schematic view illustrating construction of a customized configuration F formed from the core configuration D of FIG. 11B.
FIG. 18C is a schematic view illustrating construction of a customized configuration G formed from the core configuration E of FIG. 11C.

FIGS. 18A-18C schematically illustrate construction of customized configurations E, F, G 148, 150, 152, respectively, from the core configurations C, D, E 104, 106, 108, which comprise two of the laundry appliances 10 in a vertically stacked arrangement and horizontally arranged with one of the cabinet modules 70, 80, 90. As shown in FIG. 18A, the single height vertical module 50 combined with the core configuration C 104 forms the customized configuration E 148. Referring now to FIG. 18B, the core configuration D 106 plus the intermediate height vertical module 60 and two of the single width horizontal modules 30 results in the customized configuration F 150. The customized configuration G 152 can be formed by adding two of the single height cabinet modules 70 to the core configuration E 108, as illustrated in FIG. 18C.

Figure 19A:
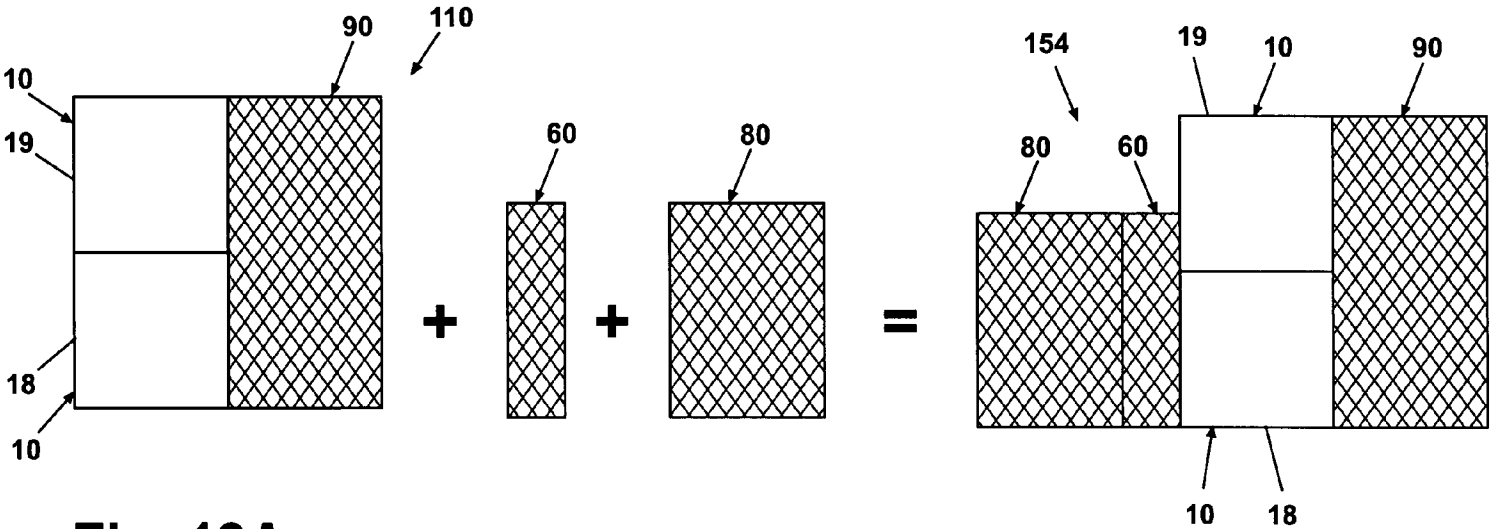
FIG. 19A is a schematic view illustrating construction of a customized configuration H formed from the core configuration F of FIG. 12A.
Figure 19B:
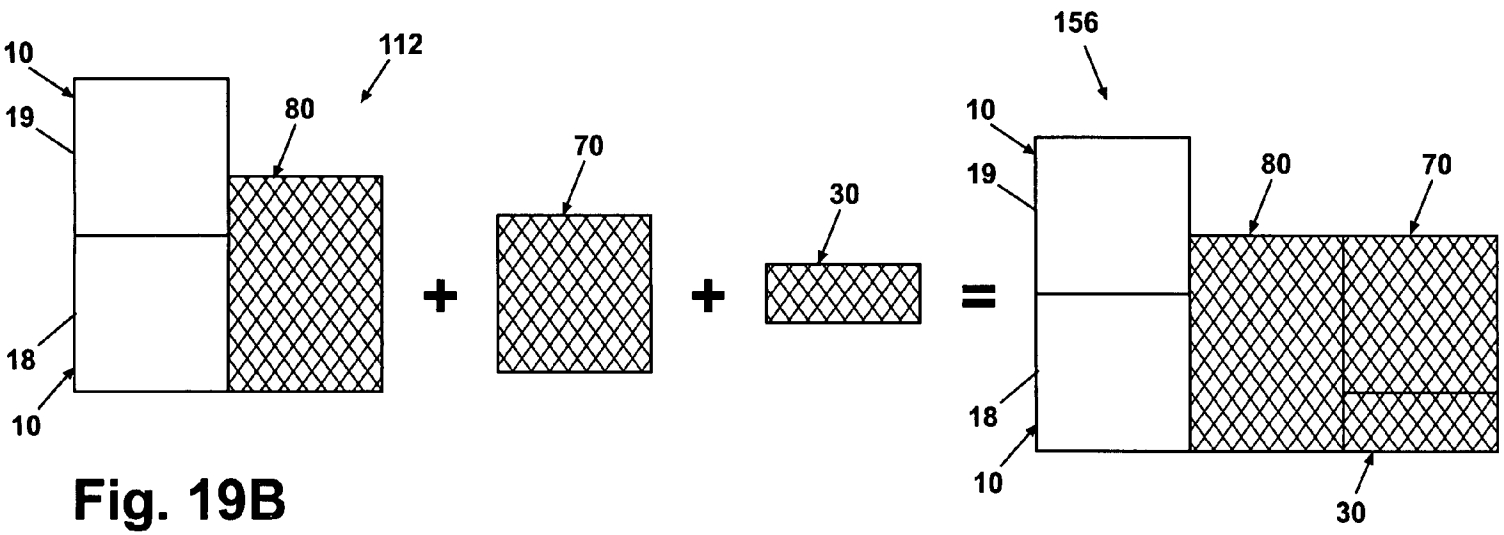
FIG. 19B is a schematic view illustrating construction of a customized configuration I formed from the core configuration G of FIG. 12B.
Figure 19C:
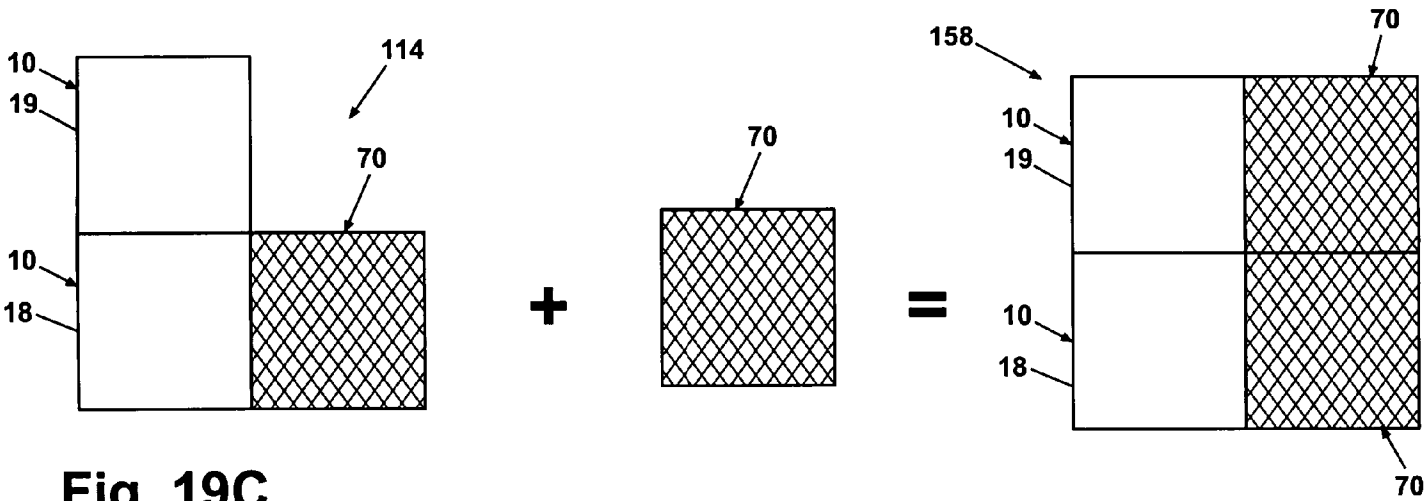
FIG. 19C is a schematic view illustrating construction of a customized configuration J formed from the core configuration H of FIG. 12C.
Figure 19D:
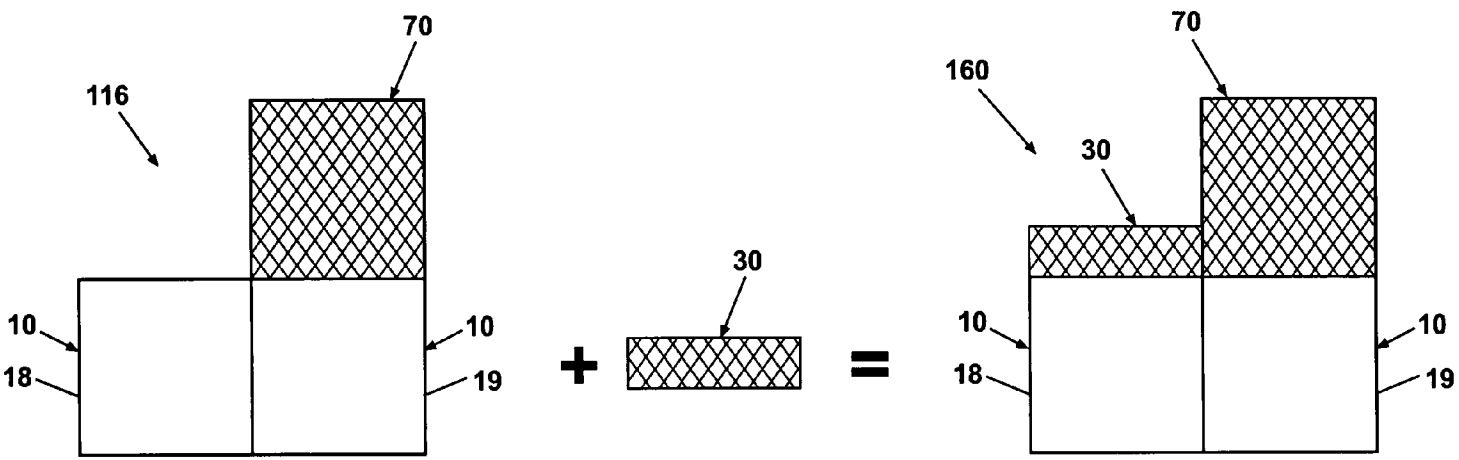
FIG. 19D is a schematic view illustrating construction of a customized configuration K formed from the core configuration I of FIG. 12D.

FIGS. 19A-19D represent construction of customized configurations with the core configurations F, G, H, I 110, 112, 114, 116, which each comprise two of the laundry appliances 10 and one of the cabinet modules 70, 80, 90 and have the configuration footprint of two of the laundry appliances 10 in a side-by-side arrangement. FIG. 19A shows a customized configuration H 154 formed by the core configuration F 110, the intermediate height vertical module 60, and the intermediate height cabinet module 80. The core configuration G 112 can be combined with the single height cabinet module 70 and the single width horizontal module 30 to form a customized configuration I 156, as illustrated in FIG. 19B. Referring now to FIG. 19C, adding the single height cabinet module 70 to the core configuration H 114 results in the customized configuration J 158. Finally, as shown in FIG. 19D, a customized configuration K 160 is created by combining the core configuration I 116 with the single width horizontal module 30.

Figure 20A:
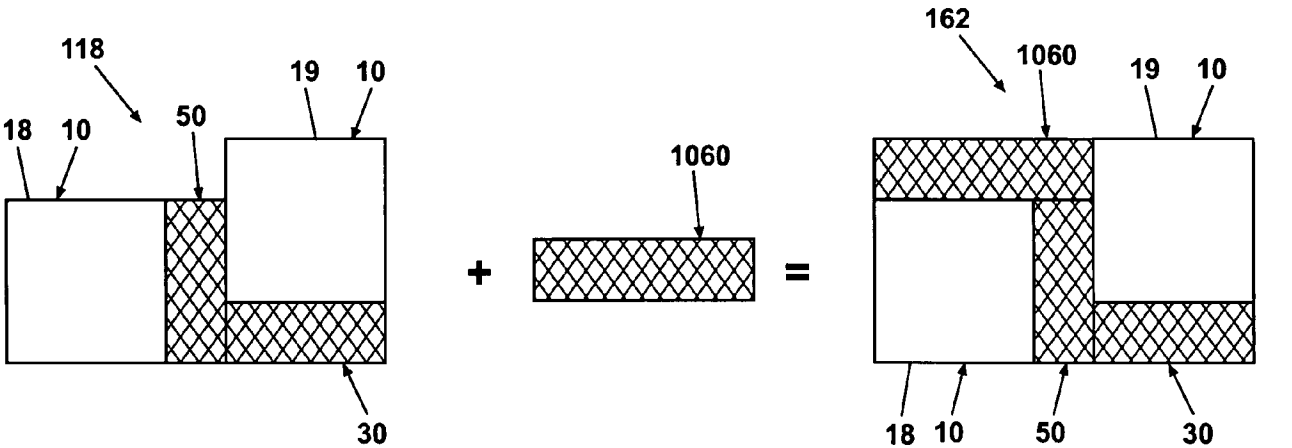
FIG. 20A is a schematic view illustrating construction of a customized configuration L formed from the core configuration J of FIG. 13A.
Figure 20B:
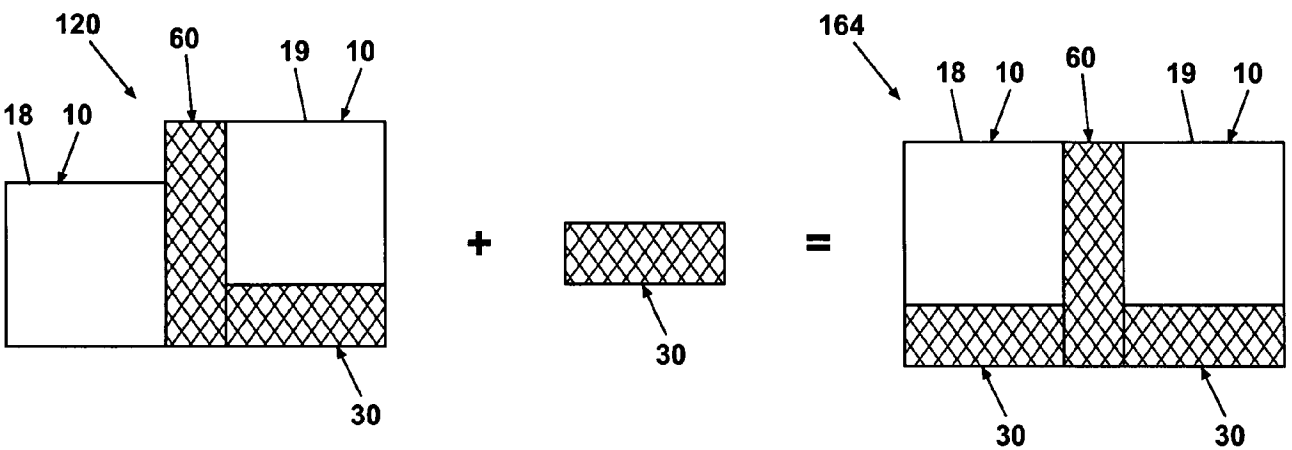
FIG. 20B is a schematic view illustrating construction of a customized configuration M formed from the core configuration K of FIG. 13B.

FIGS. 20A and 20B schematically illustrate construction of a customized configuration L 162 and a customized configuration M 164, respectively, from the core configuration J 118 and the core configuration K 120, respectively. The customized configuration L 162 can be formed by adding the intermediate width horizontal module 1060 to the core configuration J 118, while adding the single width horizontal module 30 to the core configuration K 120 results in the customized configuration M 164.

Figures 21A, 21B, 21C:
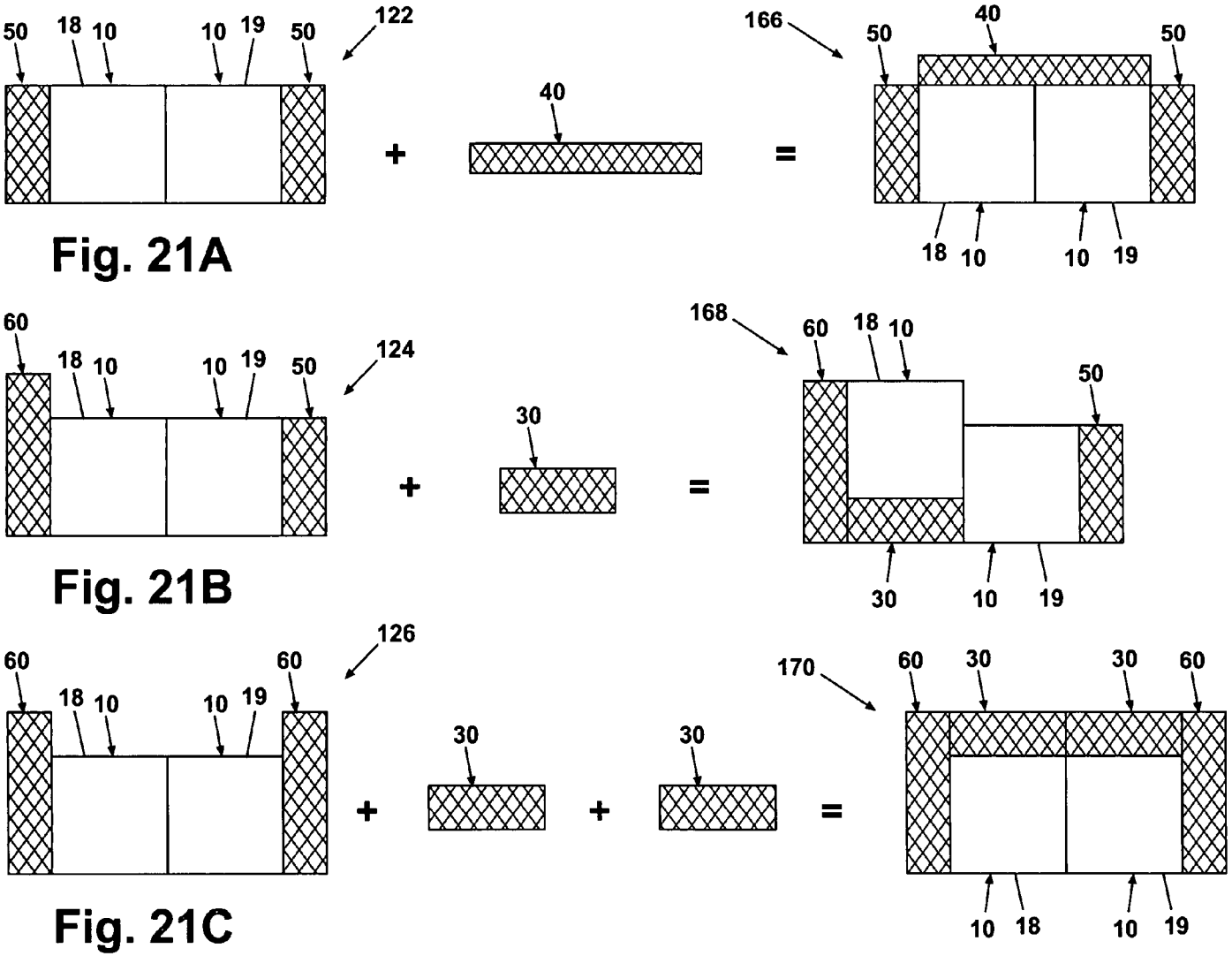
FIG. 21A is a schematic view illustrating construction of a customized configuration N formed from the core configuration L of FIG. 14A.
FIG. 21B is a schematic view illustrating construction of a customized configuration O formed from the core configuration M of FIG. 14B.
FIG. 21C is a schematic view illustrating construction of a customized configuration P formed from the core configuration N of FIG. 14C.

FIGS. 21A-21C show construction of customized configurations based on the core configurations L, M, N 122, 124, 126, which all comprise two of the laundry appliances 10 in a horizontal arrangement and two of the vertical modules 50, 60. A customized configuration N 166, illustrated in FIG. 21A, can be formed by adding the double width horizontal module 40 to the core configuration L 122. Alternatively, the double with horizontal module 40 can be replaced with, for example, the greater than double width horizontal module 1070, which can span the laundry appliances 10 and the single height vertical modules 50. Referring now to FIG. 21B, the single width horizontal module 30 can be combined with the core configuration M 124 to create a customized configuration O 168, while two of the single width horizontal modules 30 can be added to the core configuration N 126 to construct a customized configuration P 170, as shown in FIG. 21C. In the customized configuration P 170, the two single width horizontal modules 30 can easily be replaced with, for example, the double width horizontal module 40.

Figure 22A:
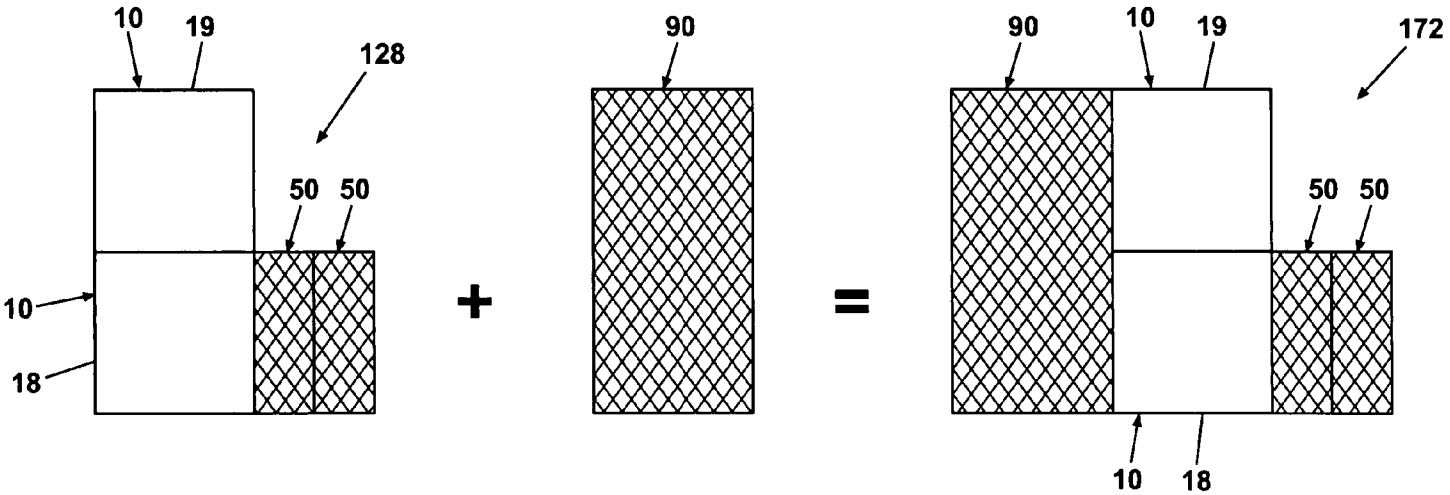
FIG. 22A is a schematic view illustrating construction of a customized configuration Q formed from the core configuration O of FIG. 15A.
Figure 22B:
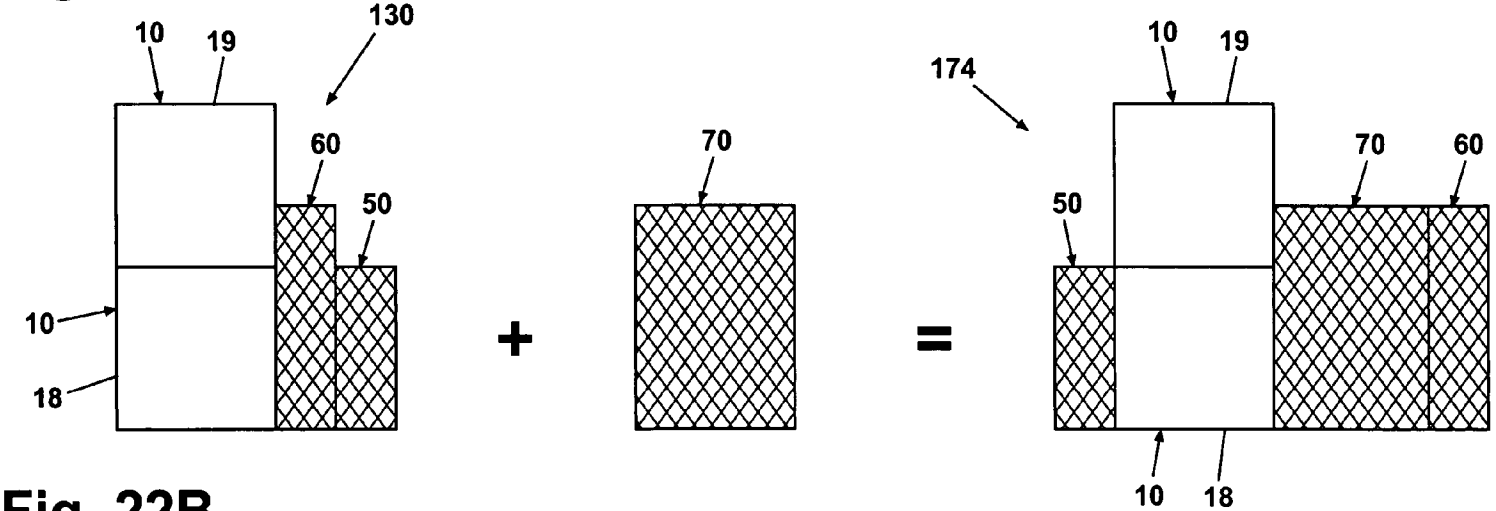
FIG. 22B is a schematic view illustrating construction of a customized configuration R formed from the core configuration P of FIG. 15B.
Figure 22C:
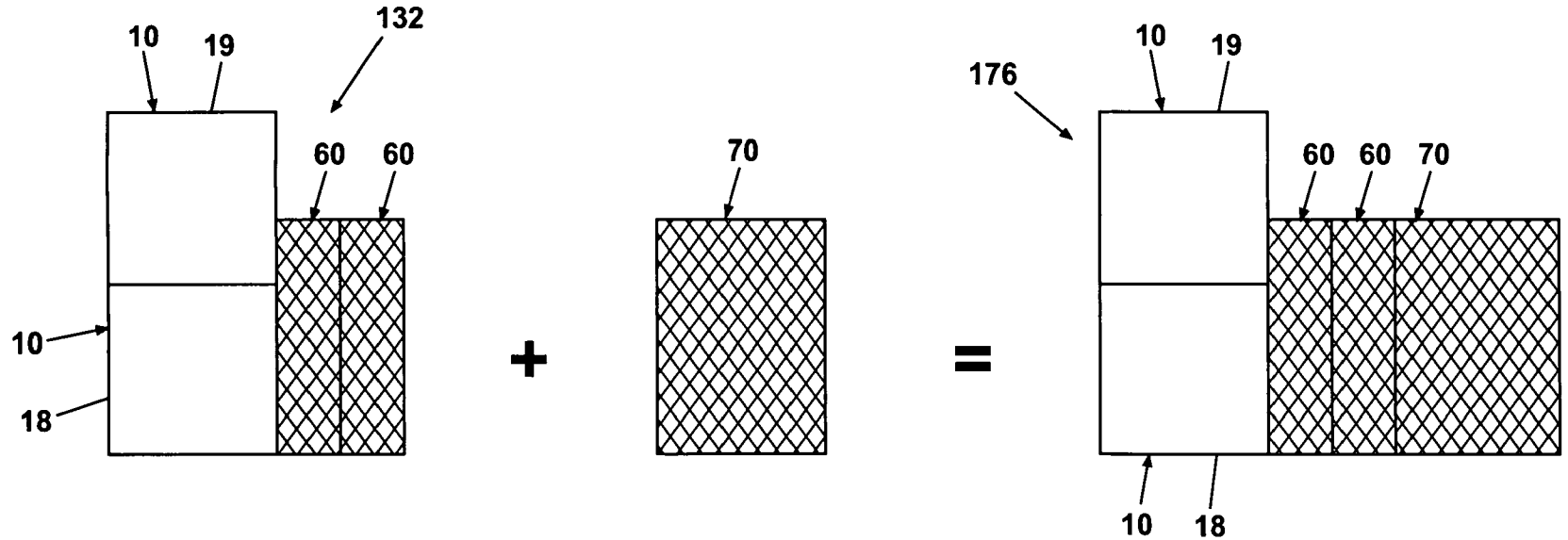
FIG. 22C is a schematic view illustrating construction of a customized configuration S formed from the core configuration Q of FIG. 15C.

FIGS. 22A-22C schematically illustrate construction of customized configurations based on the core configurations O, P, Q 128, 130, 132, which all comprise two of the laundry appliances 10 in a vertical arrangement and two of the vertical modules 50, 60. Adding the double height cabinet module 90 to the core configuration O 128 results in a customized configuration Q 172, as shown in FIG. 22A. A customized configuration R 174, as illustrated in FIG. 22B, can be formed by combining the core configuration P 130 with the intermediate height cabinet module 70. Further, the intermediate height cabinet module 70 can be added to the core configuration Q 132 to obtain a customized configuration S 176, which is shown in FIG. 22C.

The modules 20 and the core and customized configurations created from the modules 20 and the laundry appliances 10 have thus far been described with respect to their geometry. As stated above, the modules 20 can also be characterized according to their function. The modules 20 can comprise one or more functional elements or functional structures that perform or carry out the function. In general, the functions for the modules 20 can be grouped according to laundry care functions and non-laundry care functions.

The laundry care functions are functions that are associated with an aspect of treating the laundry. Exemplary laundry care functions include, but are not limited to, washing, drying, refreshing, sanitizing, stain removal, ironing, hand steaming, and sink. The washing function corresponds to subjecting a fabric item to a wash process wherein wash liquid is used to clean the fabric item, such as in a washing machine specifically suited for delicate items, including lingerie and sweaters. The drying function relates to evaporation of liquid from a fabric item by subjecting the fabric item to forced air, which can optionally be heated. The fabric item can be laid flat for non-tumble drying.

The refreshing function involves exposing the fabric item to a refreshing medium for wrinkle removal and/or odor removal of the fabric item without fully washing the fabric item. The refreshing function thereby improves the appearance and smell of the fabric item. The sanitizing function is similar to the refreshing function, except that the fabric item is exposed to a sanitizing medium that disinfects the fabric item by removal of germs, microbes, and the like. The refreshing and sanitizing functions can be performed independently of one another or simultaneously. For example, the fabric item can be exposed to steam, which can reduce wrinkles and odors from clothing (the refreshing function) while removing germs (the sanitizing function), or the fabric item can be exposed to air containing a material that imparts a pleasant scent, such as in the form of a cool mist, to the fabric item (the refreshing function). The refreshing and/or sanitizing functions can utilize misting technologies, which can use nebulizers that incorporate chemicals that remove wrinkles, odors, germs, microbes, and combinations thereof.

Figure 23:
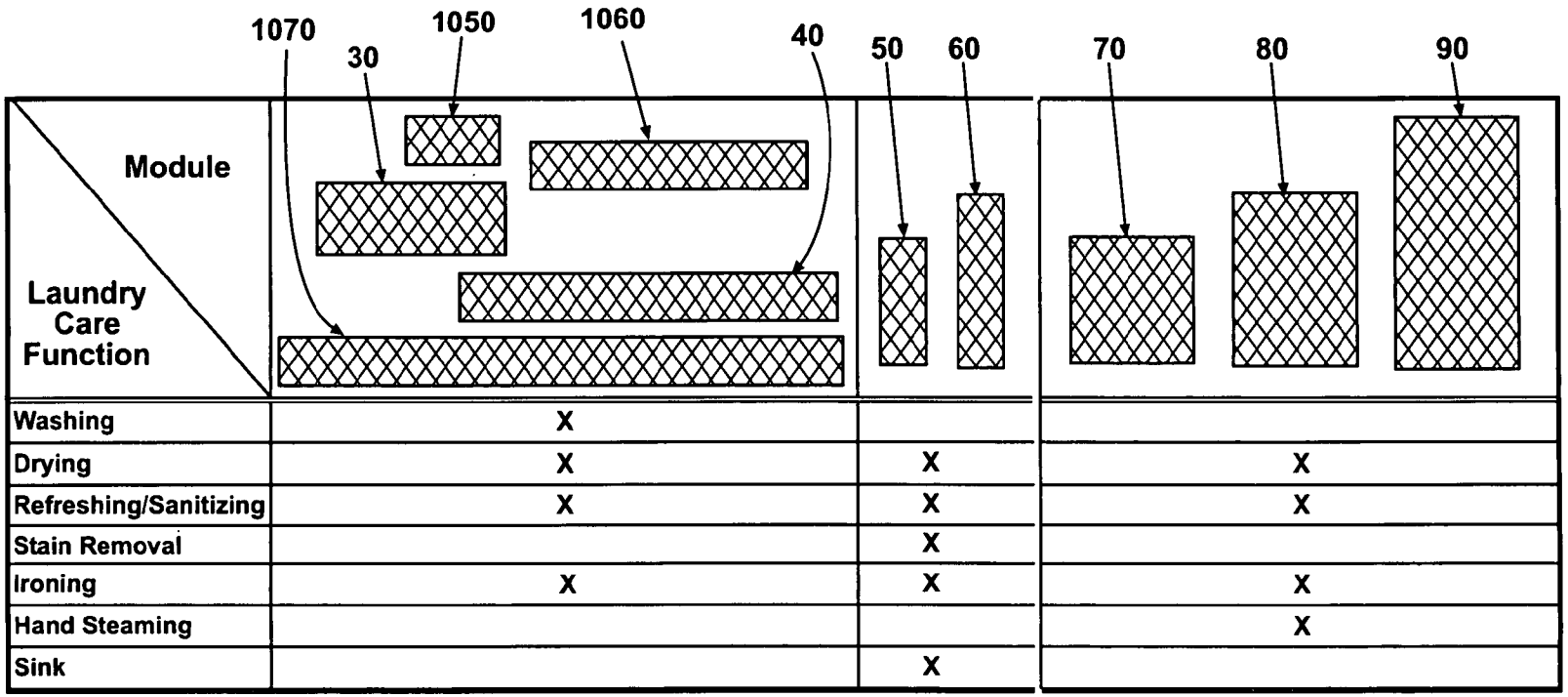
FIG. 23 is a table of exemplary laundry care functions for the modules shown in FIGS. 2A-5F.

The stain removal function corresponds to treating a stained area of the fabric item to remove the stain without washing the fabric item or to reduce the severity of the stain prior to washing the fabric item. The ironing and hand steaming functions relate to removing wrinkles from the fabric item with an iron and a hand steamer, respectively. The sink function can involve several processes, such as soaking the fabric item to wash the fabric item or to treat a stain prior to washing or simply wetting the fabric item. While any of the modules 20 can be associated with any of the laundry care functions, a table in FIG. 23 indicates the laundry care functions that are especially suited for particular modules 20.

The non-laundry care functions are functions that are not associated with an actual treatment of the laundry. Examples of non-laundry care functions are storage, garbage and recycling collection, shelving, laundry sorting, hanging, bulk dispensing, resource management, resource supply and/or recovery/reclamation, resource treatment, lighting, refrigeration, entertainment, pet care, data collection and communication, home automation, home security, home safety, power outlet and supply, and module controller.

The storage function relates to storing anything, whether related to laundry care or to something else. Some items that are commonly stored in the laundry area are detergents, bleach, fabric softeners, irons, stain pre-treatment products, and household cleaning products. The items can be stored in an enclosed space so that the items are not visible unless accessed by the user, such as by opening a drawer or a door, or the items can be staged in a location that is exposed and readily available to the user without having to perform an action to make the items visible. Garbage and recycling collection are similar to storage, but the storage is specifically designated for the collection of garbage and recyclable materials. The shelving function corresponds to providing a generally horizontal surface that can optionally be retracted when not in use and extended when used for numerous purposes, including, but not limited to, sorting laundry, folding fabric items, and supporting a laundry basket. The hanging function relates to providing a location to hang a fabric item, either directly on the location or through a hanger supported at the location. Any of the modules 20 can be associated with any of the non-laundry care functions. The laundry sorting function can relate to the shelving function, as described above, or to a plurality of bins designated for particular types of laundry. The bins can be differentiated based on type of fabric, such as delicates or regular, or color of the fabric items, such as lights or darks.

The bulk dispensing function is used in conjunction with the laundry appliance 10 and relates to storing a bulk supply of detergent or other chemicals and dispensing a charge of the detergent or other chemicals to the laundry appliance 10 upon request from the laundry appliance 10. In this case, the bulk supply is considered to be an amount greater than the charge. The resource management function deals with managing electrical and/or water supply to the laundry appliances 10 and/or to the other modules 20 and/or to other areas of the home. The available electrical and water resources can be managed to ensure that the laundry appliances 10 and the modules 20 properly function without detrimentally affecting the performance of the other laundry appliances 10 and the other modules 20. The resource supply and/or recovery/reclamation function relates to providing resources to the laundry appliance 10 and/or the modules 20 and/or reclaiming the resources from the laundry appliance 10 and/or the modules 20. For example, the reclamation unit of the aforementioned non-aqueous washing apparatus performs the resource supply and/or recovery/reclamation function. Other examples of this function include, but are not limited to, water supply and recovery and suds and additive recovery. The resource treatment function relates to treating a resource that is supplied to the laundry appliance 10 and/or the modules 20. Examples of the treatment include, but are not limited to, water heating, water filtering, and water softening.

The lighting function corresponds to providing illumination either as general lighting to the laundry area or as task lighting to a specific area of the laundry appliance 10 and/or the module 20 for performing a particular task. For example, the task lighting can include a black light to facilitate identification of spots and stains on fabric items. The refrigeration function relates to cooling a chamber in the module 20 so that items, such as food items, can be stored in the cooled chamber and kept at a desired temperature. The entertainment function relates to providing audio and/or visual media that entertains a user. Examples of components that can be integrated into or mounted to the module 20 for providing the entertainment function include, but are not limited to, a television, a video player, such as a VCR, DVD player, and DVR, or an audio player, such as a radio, a cassette player, a record player, a CD player, and a digital music player, such as an MP3 player. The pet care function corresponds to providing food or water to a household pet or a location where the household pet can urinate or defecate, such as a kitty litter.

The data collection and communication function corresponds to receiving data from the laundry appliance 10 and/or the module 20 related to the operation of the laundry appliance 10 and/or the module 20 and communicating the data, such as through a network, to a computer or other device. The home automation function relates to participating in a system for controlling operation of various devices in the home. For example, several devices, including the laundry appliance 10 and the module 20, can be included in the system and controlled remotely or automatically. The home security function relates to providing a home security system to detect intruders in the home, and the home safety function relates to detecting harmful substances, such as fire and smoke detection and carbon monoxide detection. The power outlet function corresponds to providing an electrical plug receptacle into which various electronic devices can be plugged for receiving power. The power can be provided by an external power supply, such as the main power supply for the home, or a compact power supply, such as a battery stored in the module 20. The module controller function relates to providing a user-interactive control panel for controlling operation of the module 20. The control panel can receive input from the user, such as input regarding desired operational modes for the module 20, and can communicate output to the user, such as output related to the operational status of the module 20 and/or the laundry appliance 10.

Each of the modules 20 can have one or more of the laundry care functions, one or more of the non-laundry care functions, or a combination of the laundry care and the non-laundry care functions. Some of the laundry care functions are more suited for being combined together than others. For example, the refreshing and sanitizing functions are strong candidates for being integrated together into one of the modules 20, and these two functions can also be combined either separately or together with the drying function. Another exemplary combination of the laundry care functions is the drying function and the hand steaming or ironing function. In this case, the module 20 can be designed for the drying function and include a built-in ironing or hand-steaming station. Furthermore, any of the laundry care functions can easily be integrated with the non-laundry care functions of storage and hanging.

Examples of the modules 20 having the laundry care functions, the non-laundry care functions, or combinations thereof are shown in FIGS. 24A-36B. In the following descriptions of the modules 20 in FIGS. 24A-36B, the functional elements/structures that provide the corresponding laundry care and/or laundry care functions are at least partially described. The modules 20 in these figures are provided for illustrative purposes and are not intended to limit the invention in any manner. It is within the scope of the invention for the modules 20 to differ in structure from the particular embodiments of FIGS. 24A-36B while remaining within the general limitations described above for the modules 20 and to have functions other than those of FIGS. 24A-36B. Furthermore, the modules 20 of FIGS. 24A-36B are named below according to the function or one of the functions associated with the module 20 to differentiate the modules 20 from one another. The naming of the modules 20 according to the function is not intended to limit the invention in any manner.

Figure 24A:
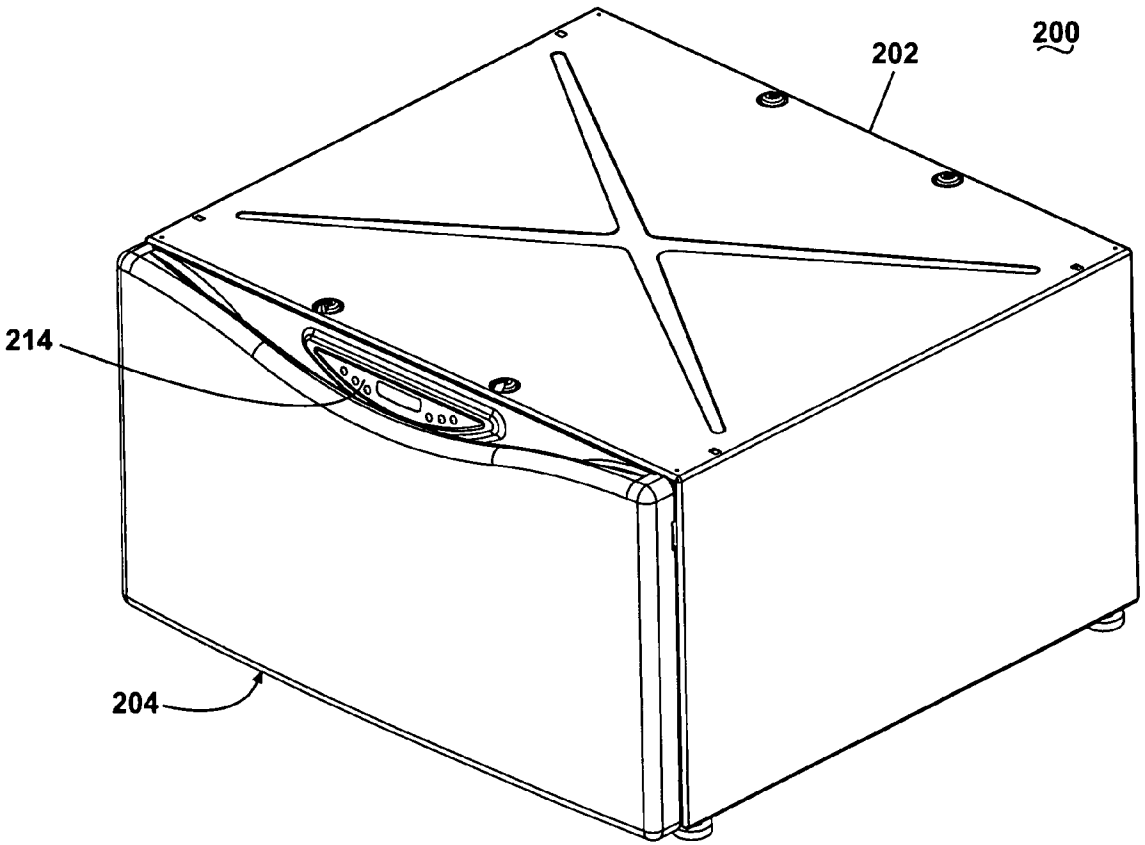
FIG. 24A is a perspective view of the single width horizontal module of FIG. 2A having a washing function and shown with a wash drawer in a closed position.
Figure 24B:
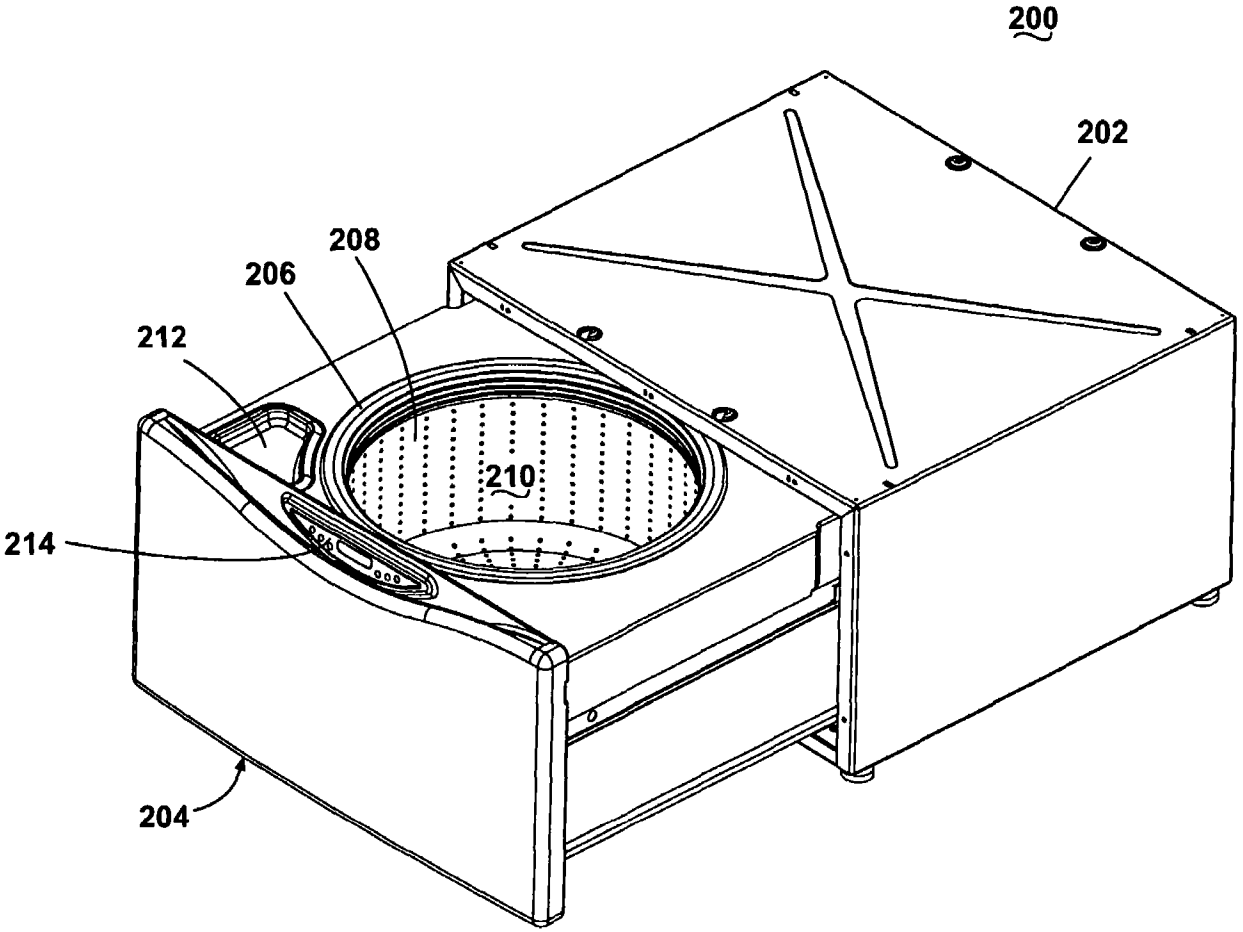
FIG. 24B is a perspective view of the washing function single width horizontal module of FIG. 24A with the wash drawer in an opened position.

FIGS. 24A and 24B show an embodiment of a washing function single width horizontal module 200. The particular embodiment of the washing function single width horizontal module 200 shown in FIGS. 24A and 24B is adapted for gentle washing delicate fabric items. The washing function single width horizontal module 200 comprises an open-face cabinet 202 and an open-top drawer 204 slidably mounted to the cabinet 202. The drawer 204 supports an imperforate tub 206, a perforated open-top wash basket 208 rotatably mounted within the tub 206 and defining a wash chamber 210, and a detergent dispenser 212 located adjacent to the tub 206. The drawer 204 is movable relative to the open face of the cabinet 202 between a closed position, as shown in FIG. 24A, where the drawer 204 closes the open face of the cabinet 202 and the wash chamber 210 is inaccessible, and an opened position, as illustrated in FIG. 24B, where the drawer 204 extends forwardly from the cabinet 202 and the user can access the wash chamber 210. The user can select a desired wash cycle through a control panel 214 mounted on the drawer 204.

According to one embodiment, the washing function single width horizontal module 200 has a low capacity relative to a capacity of the laundry appliance 10. Although the washing function single width horizontal module 200 can be used for any small volume loads of fabric items, the washing function single width horizontal module 200 can be designed for gentle washing fabric items that require special care, such as fabric items that are intended to be hand washed or washed in a delicate wash cycle.

Figure 25A:
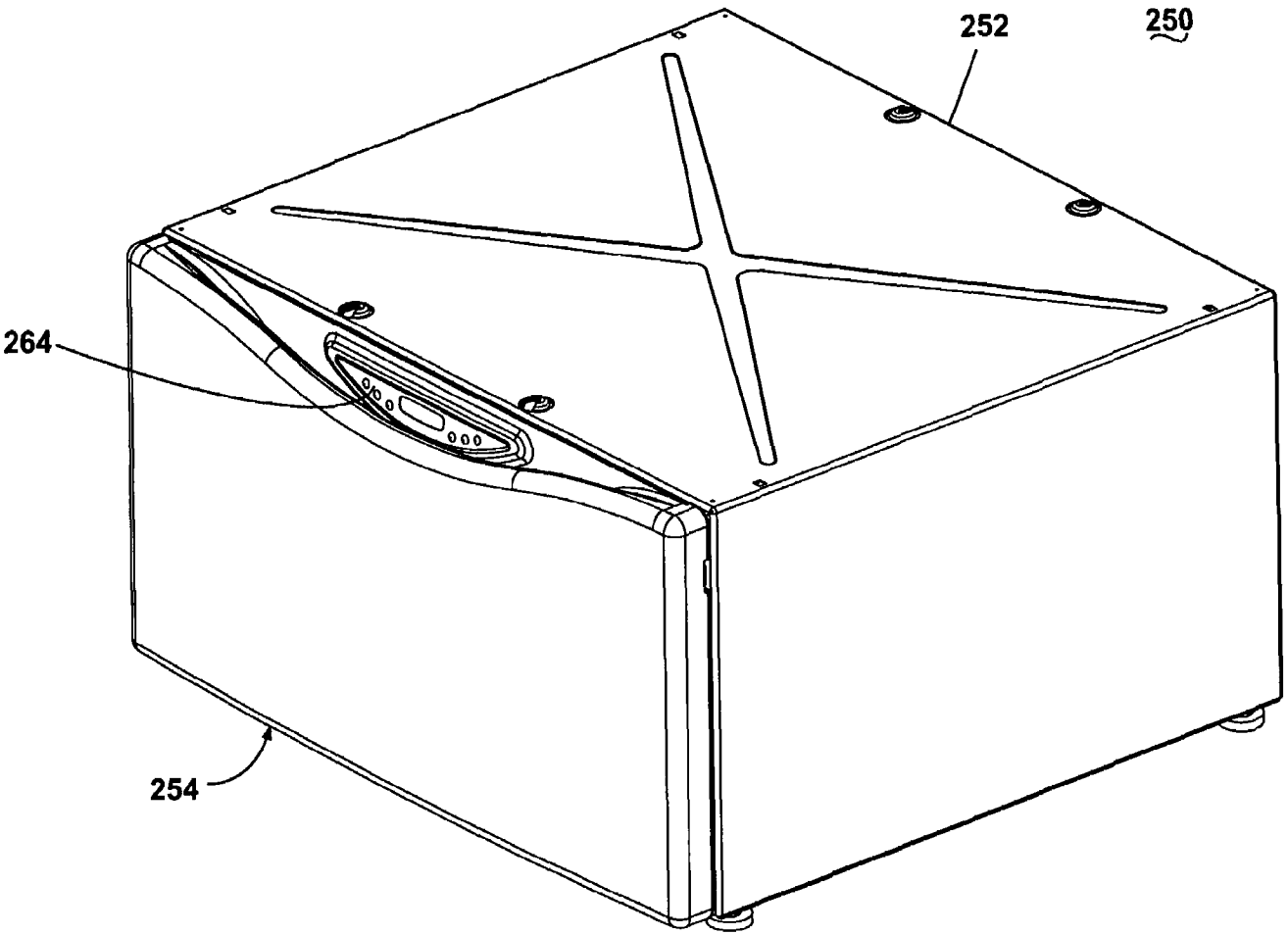
FIG. 25A is a perspective view of the single width horizontal module of FIG. 2A having a drying function and shown with a dryer drawer in a closed position.
Figure 25B:
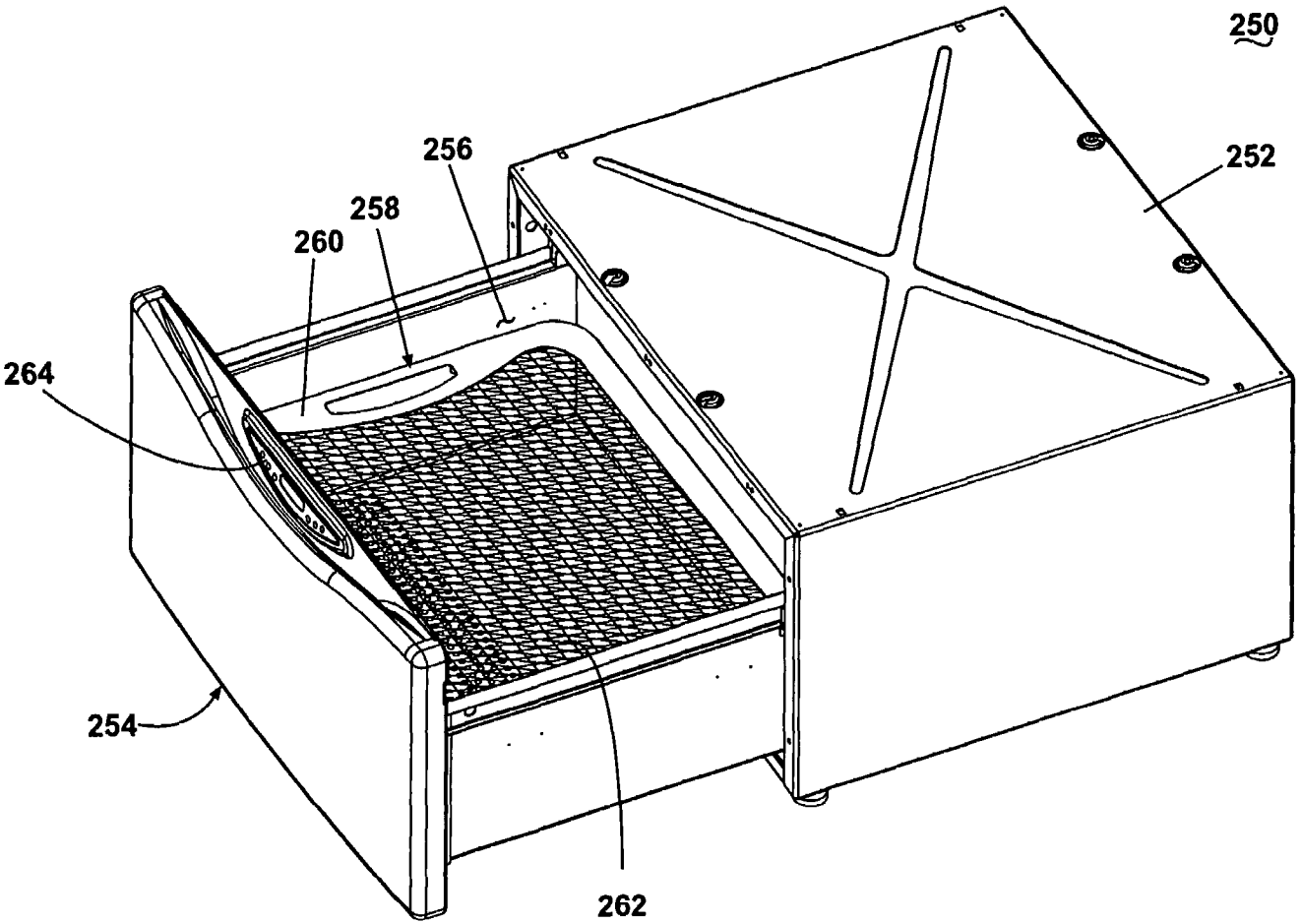
FIG. 25B is a perspective view of the drying function single width horizontal module of FIG. 25A with the drying drawer in an opened position.

FIGS. 25A and 25B illustrate an embodiment of a drying function single width horizontal module 250, which comprises an open-face cabinet 252 and an open-top drawer 254 slidably mounted to the cabinet 252. The drawer 254 defines an open-top drying chamber 256 through which forced air can flow to dry fabric items. The fabric items can be positioned on a drying rack 258 removably mounted in the drying chamber 256. The drying rack 258 comprises a rack frame 260 that supports a mesh panel 262 through which the forced air can flow. The drawer 254 is movable relative to the open face of the cabinet 252 between a closed position, as shown in FIG. 25A, where the drawer 254 closes the open face of the cabinet 252 and the drying chamber 256 is inaccessible, and an opened position, as illustrated in FIG. 25B, where the drawer 254 extends forwardly from the cabinet 252 and the user can access the drying chamber 256. The user can select a desired drying cycle through a control panel 264 mounted on the drawer 254. The refreshing and/or sanitizing functions can be incorporated into the drying function single width horizontal module 250 or can replace the drying function, if desired.

Figure 26A:
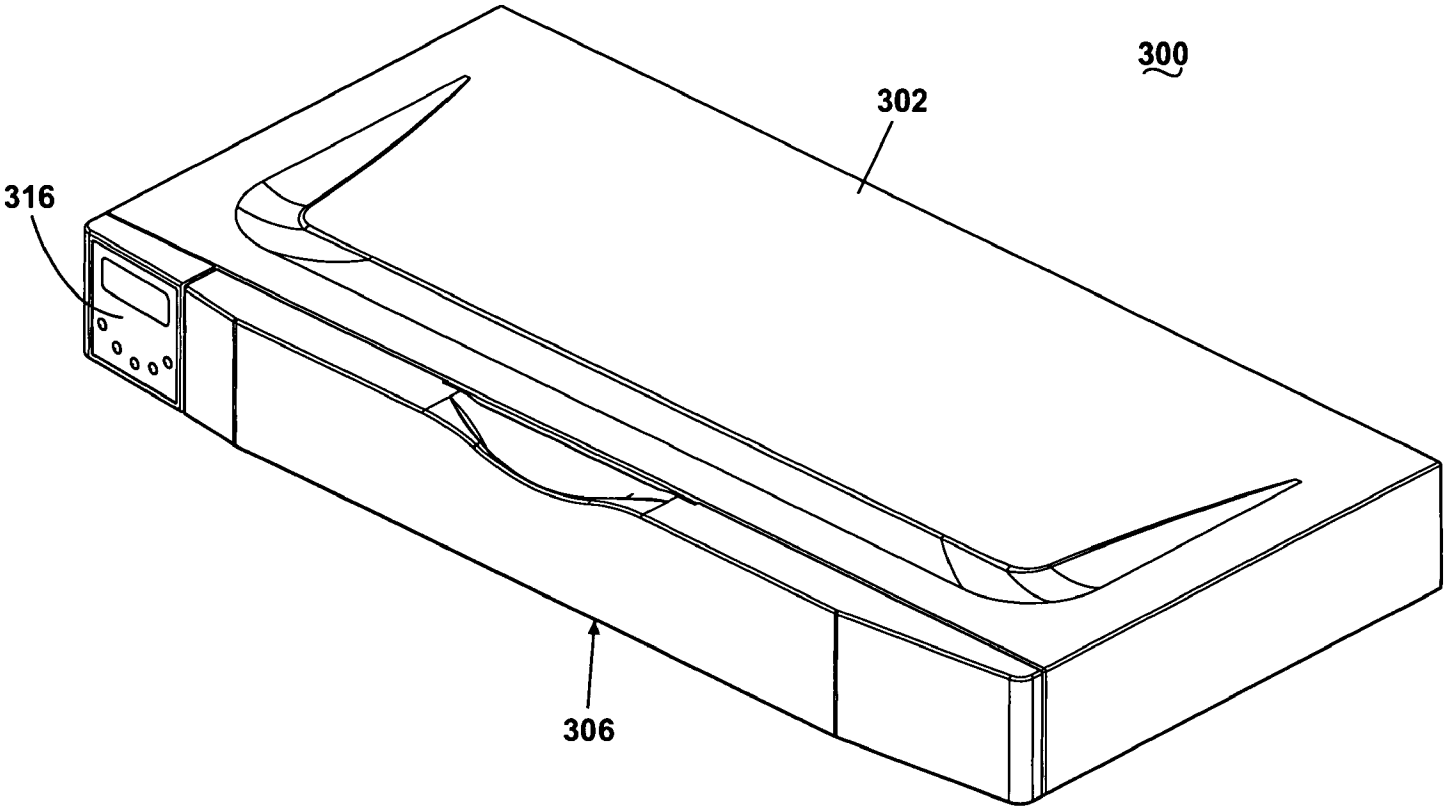
FIG. 26A is a perspective view of the double width horizontal module of FIG. 2C having a drying function and shown with a dryer drawer in a closed position.
Figure 26B:
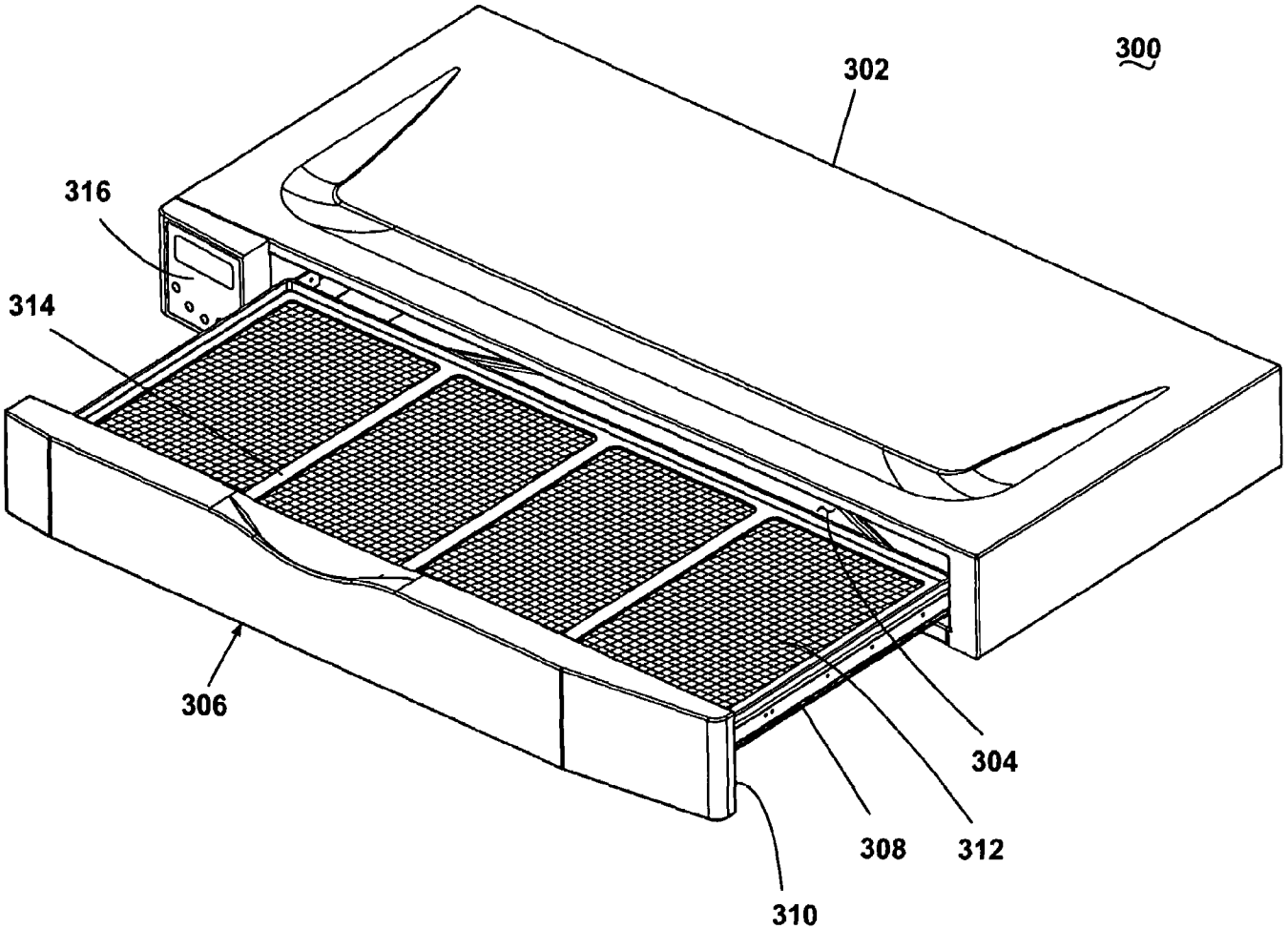
FIG. 26B is a perspective view of the drying function double width horizontal module of FIG. 26A with the drying drawer in an opened position.

FIGS. 26A and 26B illustrate an embodiment of a drying function double width horizontal module 300 comprising an open-face cabinet 302 defining a drying chamber 304 through which forced air can flow to dry fabric items and a drawer 306 slidably mounted to the cabinet 302. The drawer 306 is formed by a drawer frame 308 connected to a drawer front 310. The drawer frame 308 supports a drying rack in the form of a mesh panel 312 that extends across the width and the depth of the drawer frame 308 and is held in place, at least partially, by a grid 314 positioned on top of the mesh panel 312. The drawer 306 is movable relative to the open face of the cabinet 302 between a closed position, as shown in FIG. 26A, where the drawer 306 closes the open face of the cabinet 302 and is received within the drying chamber 304, and an opened position, as illustrated in FIG. 26B, where the drawer 306 extends forwardly from the cabinet 302 so that the user can place fabric items to be dried on the mesh panel 312. Thus, the fabric items arranged on the drawer 306 are received within the drying chamber 304 when the drawer 306 is in the closed position. The user can select a desired drying cycle through a control panel 316 mounted on the cabinet 302 adjacent to the drawer 306. The refreshing and/or sanitizing functions can be incorporated into the drying function double with horizontal module 300 or can replace the drying function, if desired. The drying function single width horizontal module 250 and the drying function double width horizontal module 300 are described in more detail in application Ser. No. 11/322,502, filed concurrently herewith, and titled "Non-Tumble Clothes Dryer," which is incorporated herein by reference in its entirety.

The washing function single width horizontal module 200, the drying function single width horizontal module 250, and the drying function double width horizontal module 300 comprise some common elements. For example, each of these horizontal modules 200, 250, 300 has a cabinet or housing that defines an interior space and a drawer slidable relative to the interior space. The function of the horizontal modules 200, 250, 300 is at least partially formed by or carried out by the drawer. These common elements can also be found in at least some of the exemplary vertical modules described below.

Figure 27A:
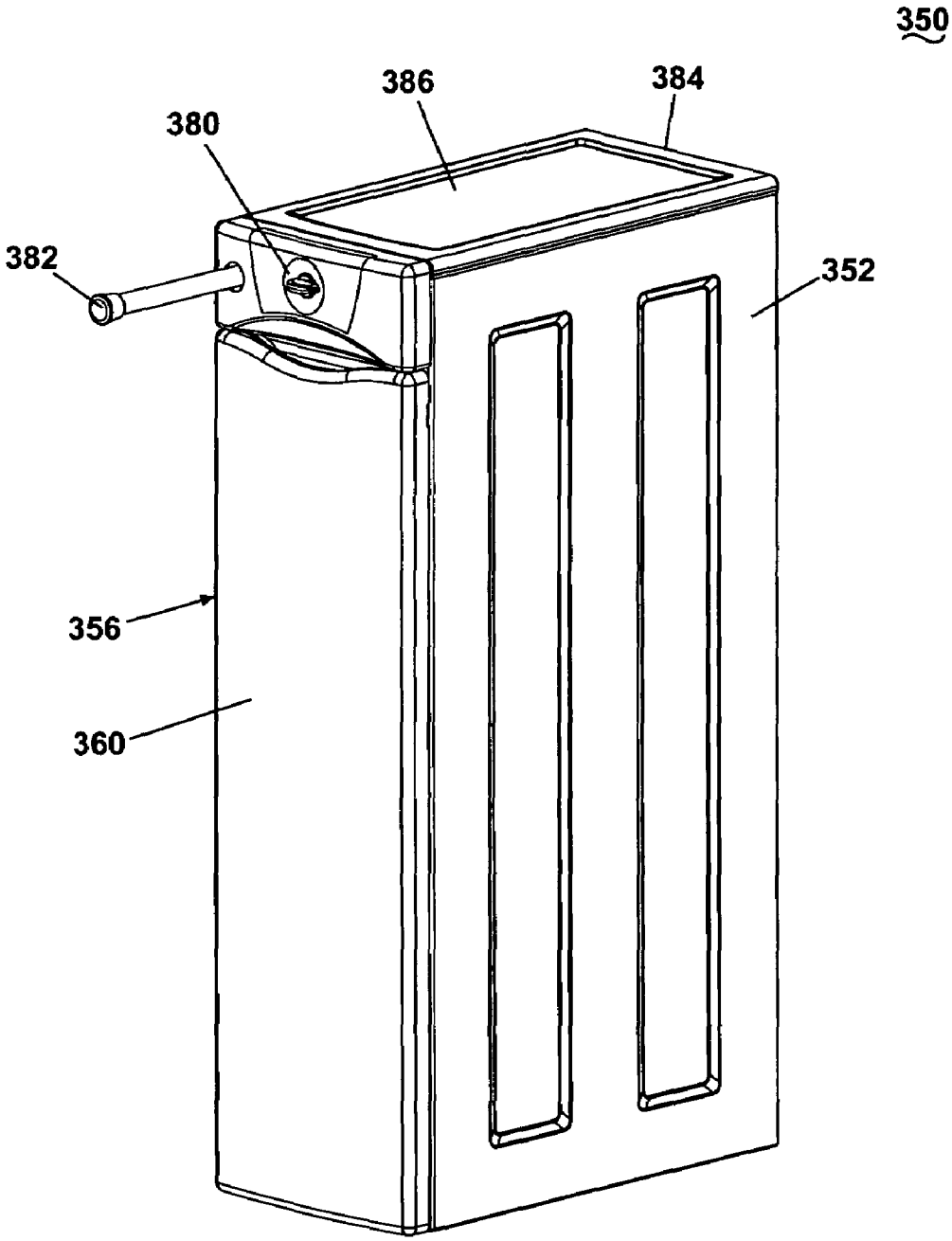
FIG. 27A is a perspective view of the intermediate height vertical module of FIG. 3C having a drying function and shown with a dryer drawer in a closed position and a hanging rod in an extended position.
Figure 27B:
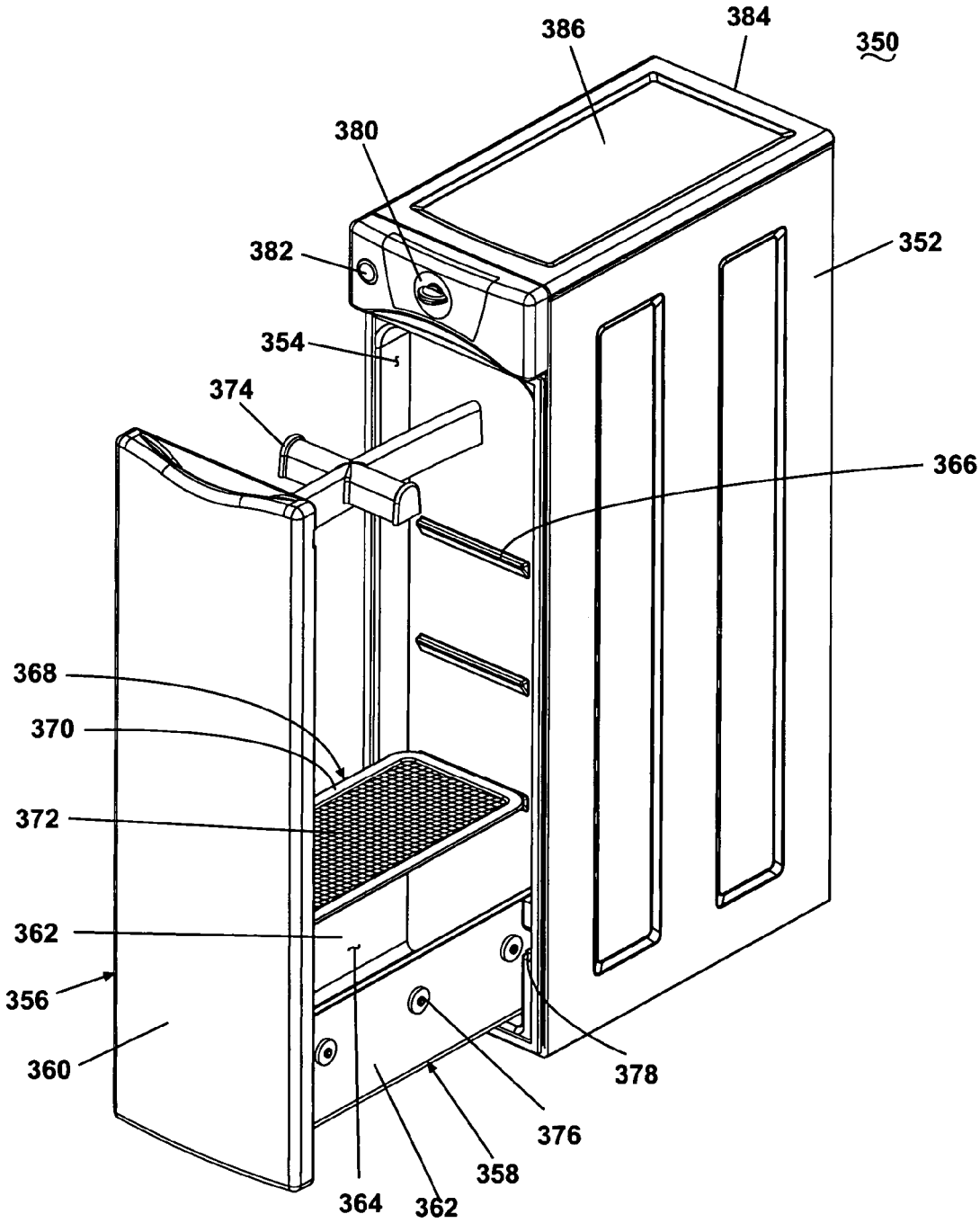
FIG. 27B is a perspective view of the drying function intermediate height vertical module of FIG. 27A with the drying drawer in an opened position and the hanging rod in a retracted position.

FIGS. 27A and 27B illustrate an embodiment of a drying function intermediate height vertical module 350 comprising an open-face cabinet 352 defining a drying chamber 354 through which forced air can flow to dry fabric items and a drawer 356 slidably mounted to the cabinet 352. The drawer 356 is formed by a generally U-shaped drawer frame 358 connected to a drawer front 360. The drawer frame 358 includes at a lower end a pair of side panels 362 that form an open-top cavity 364 sized to receive various items to be dried, such as shoes. The drawer frame 358 further comprises a plurality of paired spaced ledges 366 dimensioned to support one or more drying shelves 368, and the drying shelf 368 of the illustrated embodiment is formed by a frame 370 and a mesh panel 372 through which forced air can flow. In addition to the cavity 364 and the drying shelf 368, items to be dried can be hung on a hanging bar 374, such as on a hanger supported by the hanging bar 374, mounted at an upper end of the drawer frame 358. The drawer 356 further comprises guide rollers 376 positioned on the side panels 362 and sized for receipt within a track 378 formed on the cabinet 352 to facilitate sliding movement of the drawer 356 relative to the cabinet 352. The drawer 356 is movable relative to the open face of the cabinet 352 between a closed position, as shown in FIG. 27A, where the drawer 356 closes the open face of the cabinet 352 and is received within the drying chamber 354, and an opened position, as illustrated in FIG. 27B, where the drawer 356 extends forwardly from the cabinet 352 so that the user can place fabric items to be dried in the drawer 356, such as in the cavity 364, on the drying shelf 368, and on the hanging bar 374. Thus, the items arranged on the drawer 356 are received within the drying chamber 354 when the drawer 356 is in the closed position. The user can select a desired drying cycle through a control panel 380 mounted on the cabinet 352 above the drawer 356. The refreshing and/or sanitizing functions can be incorporated into the drying function intermediate height vertical module 350 or can replace the drying function, if desired.

Adjacent to the control panel 380, the cabinet 352 supports a hanging rod 382 movable between an extended position, as shown in FIG. 27A, where fabric items can be hung from the hanging rod 382, such as on a hanger, and a retracted position, as illustrated in FIG. 27B, where the hanging rod 382 is stored within the cabinet 352. Any type of actuator, such as a push-push type actuator, can be utilized to move the hanging rod 382 between the extended and retracted positions. More details of an example of the hanging rod 382 are provided in application Ser. No. 11/322,503, filed concurrently herewith, and titled "Retractable Hanging Element," which is incorporated herein by reference in its entirety. Additionally, the cabinet 352 further comprises a top 384 having a depression 386 that can be used to stage a variety of items.

Figure 28A:
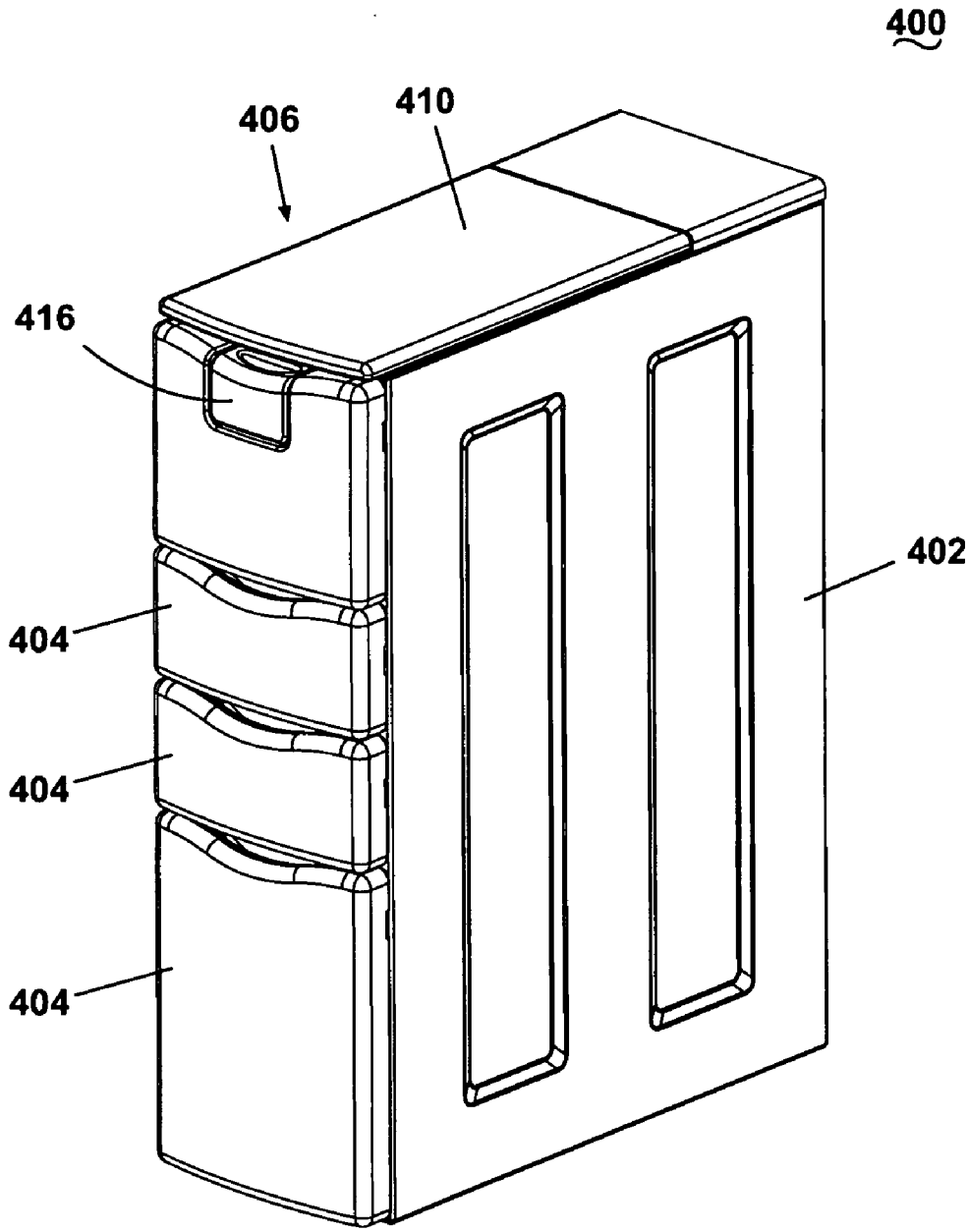
FIG. 28A is a perspective view of the single height vertical module of FIG. 3A having a stain removal function and shown with a stain removal assembly in a storage position.
Figure 28B:
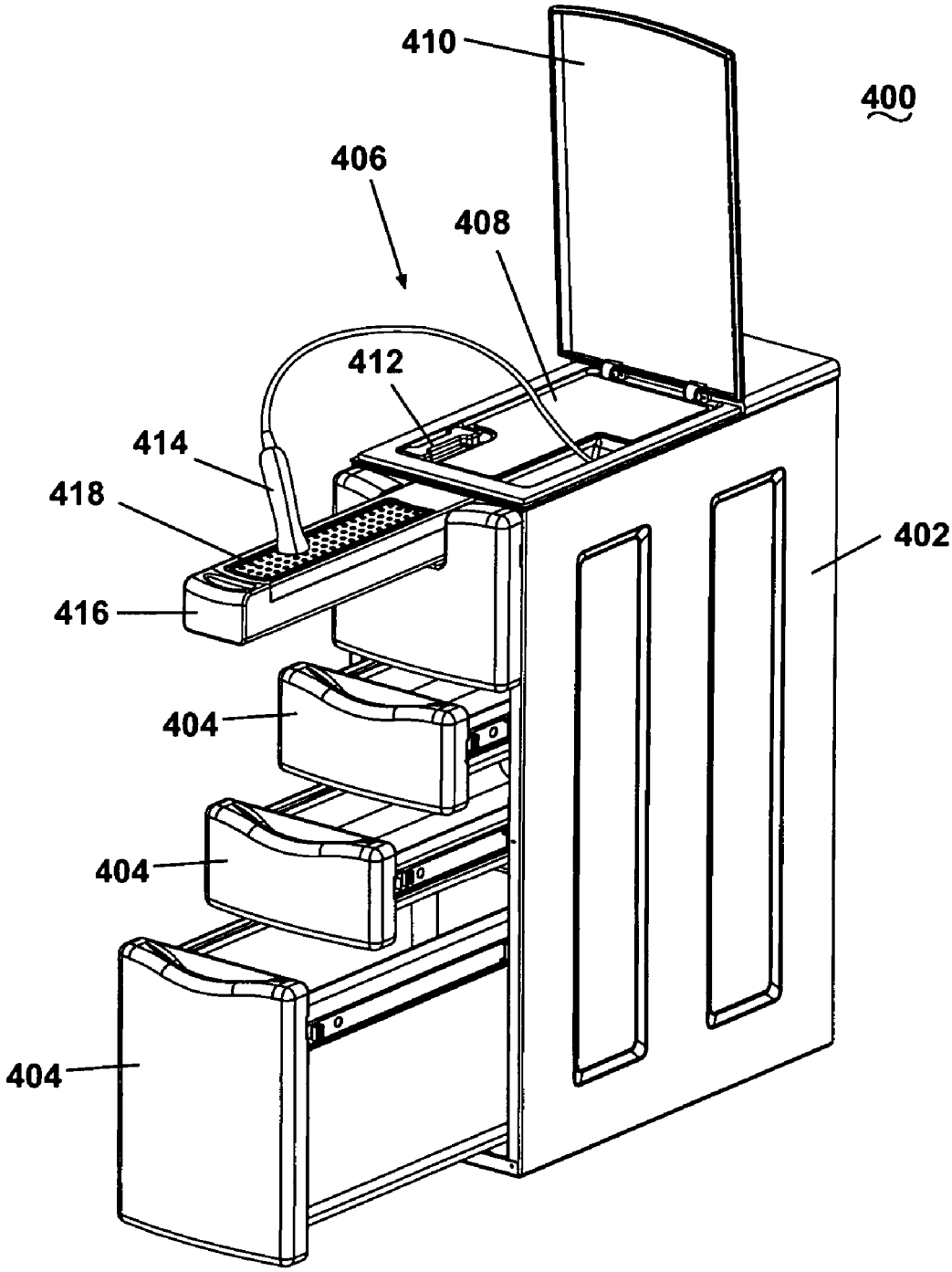
FIG. 28B is a perspective view of the stain removal function single height vertical module of FIG. 28A with the stain removal assembly in a use position.

FIGS. 28A and 28B illustrate an embodiment of a stain removal function single height vertical module 400 comprising an open-face cabinet 402, a plurality of vertically juxtaposed drawers 404 slidably mounted to the cabinet 402, and a stain removal assembly 406 mounted at an upper portion of the cabinet 402. According to the illustrated embodiment, the drawers 404 are storage drawers, and each of the drawers 404 is movable between a closed position, as shown in FIG. 28A, where the drawer 404 closes the open face of the cabinet 402, and an opened position, as illustrated in FIG. 28B, where the drawer 404 extends forwardly from the cabinet 402.

The stain removal assembly 406 comprises a basin 408 that forms part of the cabinet 402 and a lid 410 hingedly mounted to the cabinet 402 for selectively covering the basin 408. The basin 408 is adapted to store a container 412 that receives a stain removal agent, such as a detergent or bleach, and a stain removal wand 414 fluidly coupled to the container 412 for dispensing the stain removal agent either alone or in combination with a fluid, such as water or steam. The stain removal assembly 406 further comprises a board drawer 416 slidably mounted to the cabinet 402 above the drawers 404. The board drawer 416 forms a vacuum cavity located beneath a perforated stain removal board 418 and fluidly coupled to a source of vacuum. The stain removal assembly 406 is operable between a storage position, as illustrated in FIG. 28A, where the lid 410 covers the basin 408 and the board drawer 416 is received within the cabinet 402, and a use position, as shown in FIG. 28B, where the lid 410 is opened and the board drawer 416 is slid forwardly from the cabinet 402 such that the stain removal wand 414 can be removed from the basin 408 and utilized on the stain removal board 418. During use, the stained fabric item is placed on the board 418, and the stain removal agent is dispensed onto the fabric item through the stain removal wand 414 and suctioned through the fabric item and the stain removal board 418.

Figure 29A:
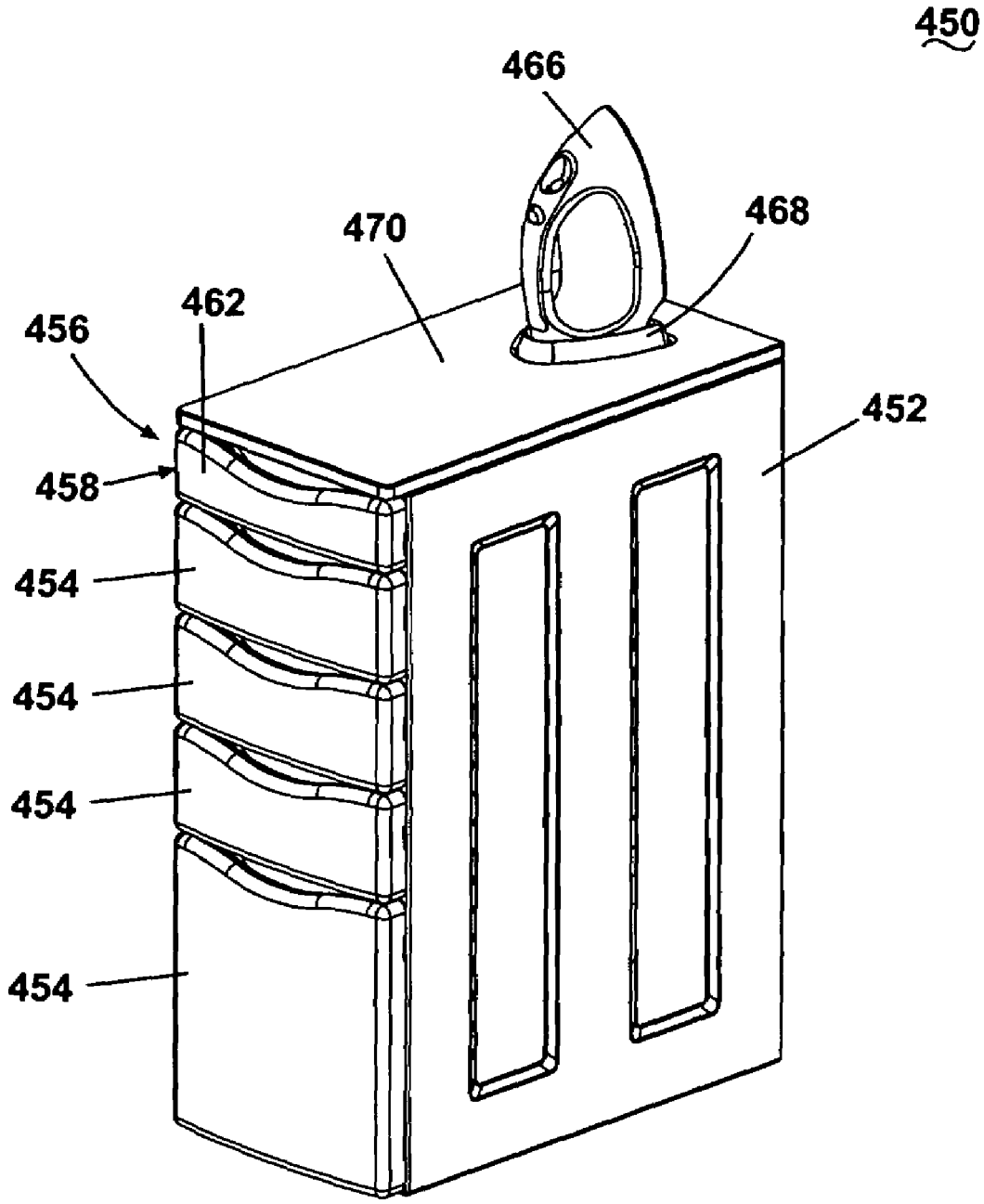
FIG. 29A is a perspective view of the single height vertical module of FIG. 3A having an ironing function and shown with an ironing board support in a closed position.
Figure 29B:
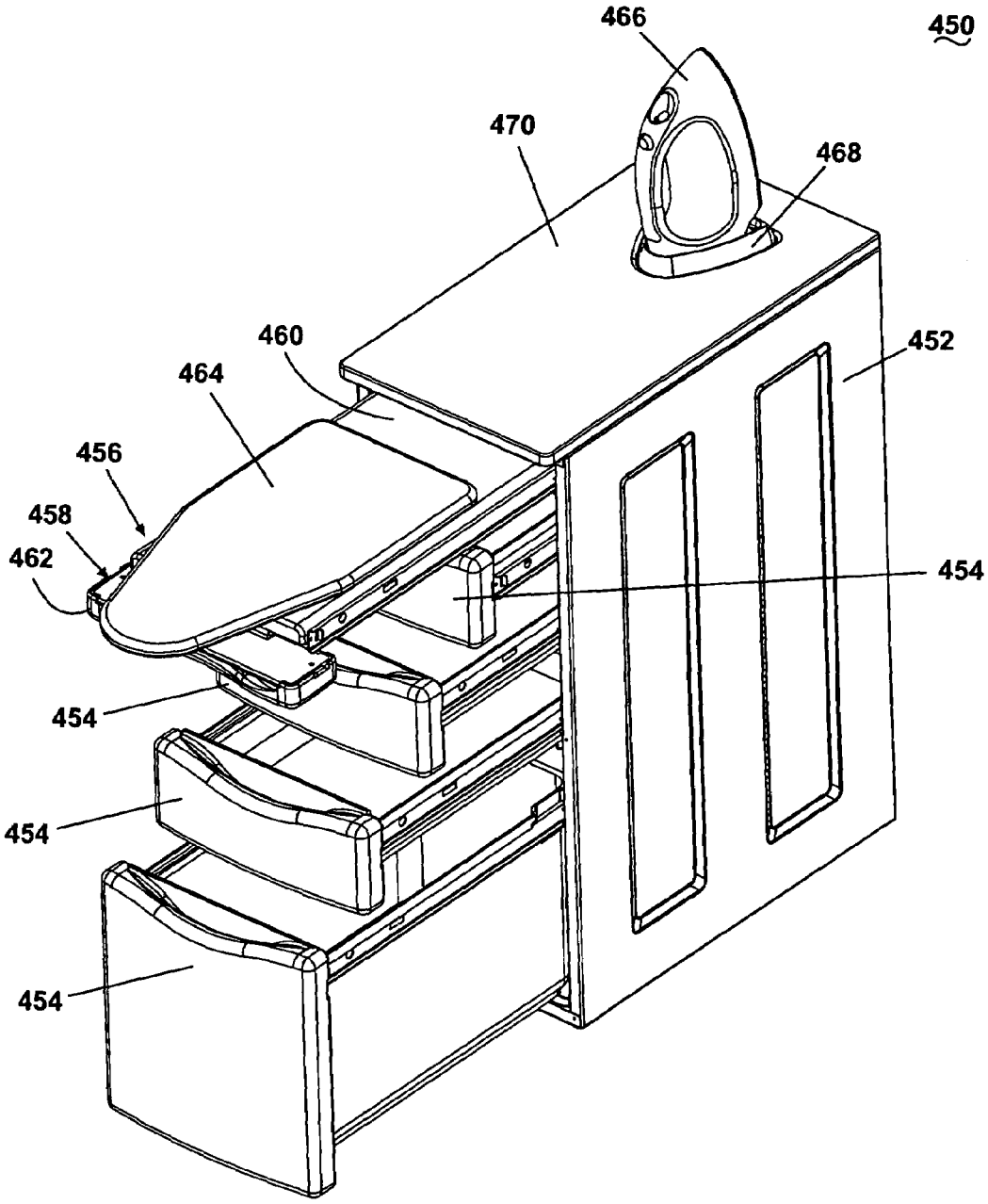
FIG. 29B is a perspective view of the ironing function single height vertical module of FIG. 29A with the ironing board support in an opened position.

FIGS. 29A and 29B illustrate an embodiment of an ironing function single height vertical module 450 comprising an open-face cabinet 452, a plurality of vertically juxtaposed drawers 454 slidably mounted to the cabinet 452, and an ironing board assembly 456 mounted at an upper portion of the cabinet 452. According to the illustrated embodiment, the drawers 454 are storage drawers, and each of the drawers 454 is movable between a closed position, as shown in FIG. 29A, where the drawer 454 closes the open face of the cabinet 452, and an opened position, as illustrated in FIG. 29B, where the drawer 454 extends forwardly from the cabinet 452.

The ironing board assembly 456 comprises a slidable ironing board support 458 having a platform 460, a front panel 462 hingedly mounted to the platform 460, and an ironing board 464 slidably and rotatably mounted to the platform 460. The ironing board support 458 is movable between a closed position, as shown in FIG. 29A, where the platform 460 and the ironing board 464 are received within the cabinet 452, and an opened position, as illustrated in FIG. 29B, where the platform 460 and the ironing board 464 extend forwardly from the cabinet 452. When the ironing board support 458 is in the opened position, the front panel 462 can be pivoted from a generally vertical position to a generally horizontal orientation, which allows the ironing board 464 to be slid forwardly toward the front panel 462 and rotated one hundred eighty degrees about a generally vertical axis to the position shown in FIG. 29B. In this position, the user can place fabric items to be ironed on the ironing board 464 and utilize an iron, such as a cordless iron 466 mounted in a docking station 468 formed in a top 470 of the cabinet 452, to remove wrinkles. The ironing function single height vertical module 450 is described in more detail in application Ser. No. 11/323,270, filed concurrently herewith, and titled "Ironing Station," which is incorporated herein by reference in its entirety.

Figure 30A:
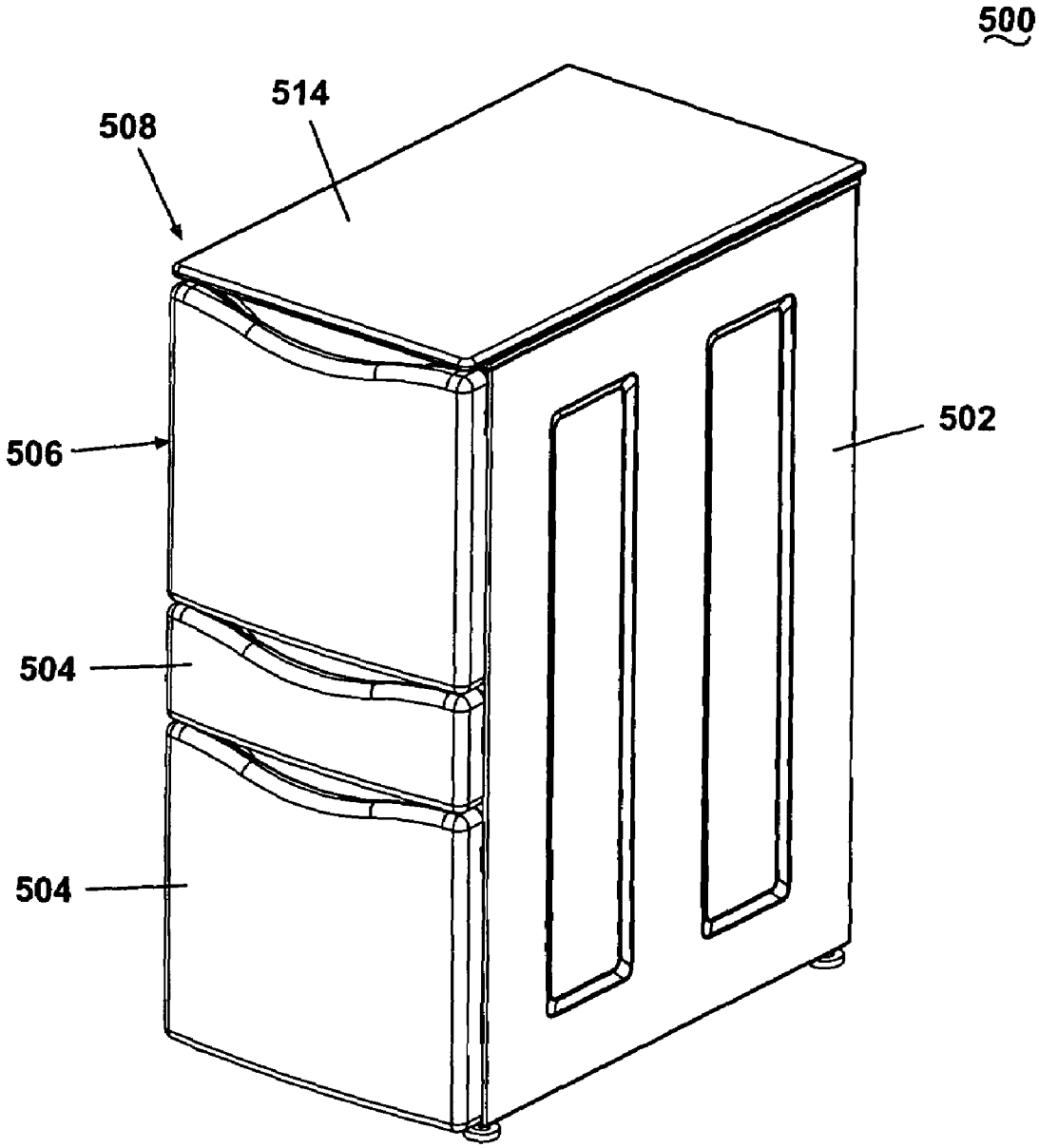
FIG. 30A is a perspective view of the single height vertical module of FIG. 3A having a sink function and shown with a sink assembly in a storage position.
Figure 30B:
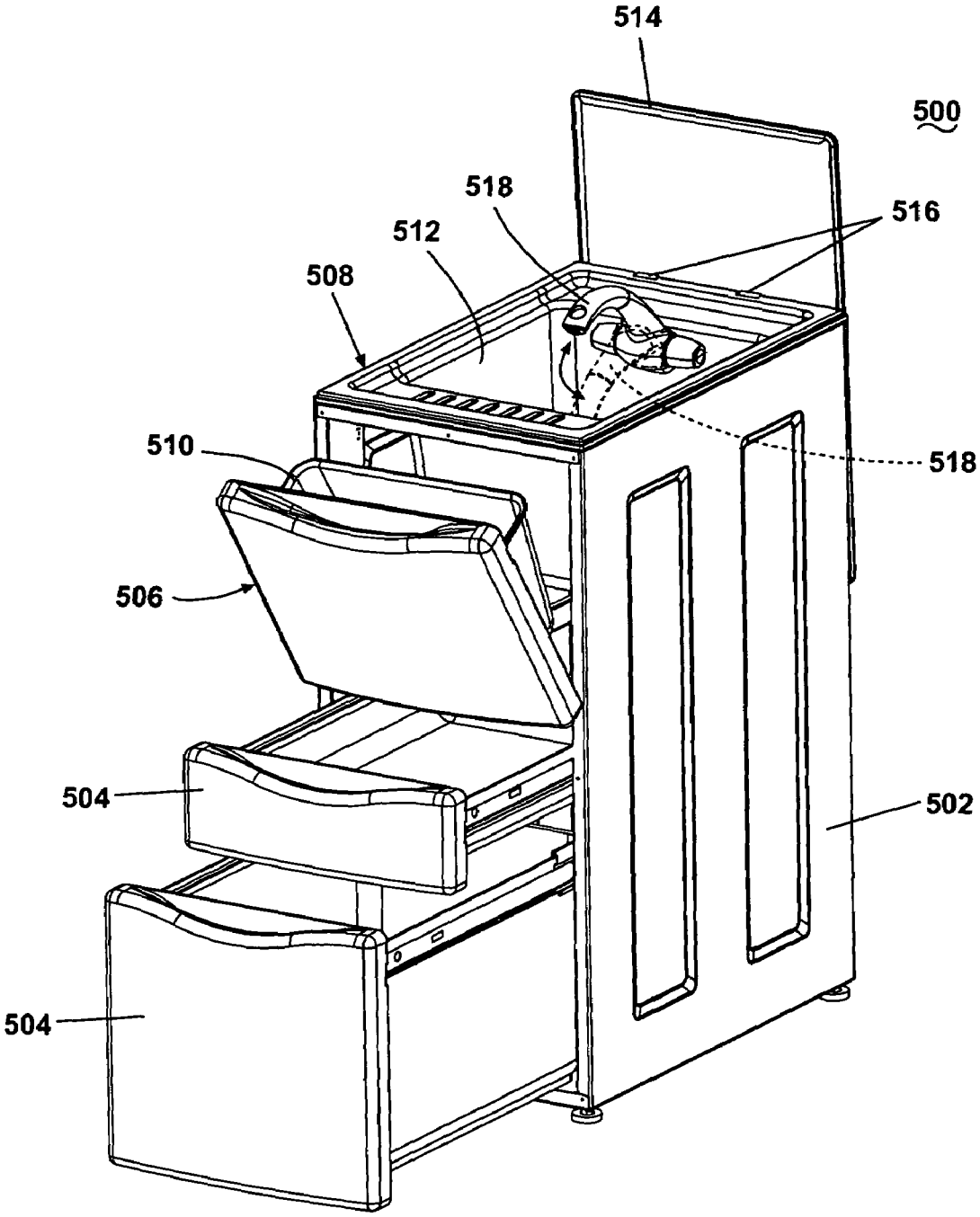
FIG. 30B is a perspective view of the sink function single height vertical module of FIG. 30A with the sink assembly in a use position.

FIGS. 30A and 30B illustrate an embodiment of a sink function single height vertical module 500 comprising an open-face cabinet 502, a pair of vertically juxtaposed drawers 504 slidably mounted to the cabinet 502, a pivoting compartment 506 pivotally mounted to the cabinet 502 above the vertically juxtaposed drawers 504, and a sink assembly 508 mounted at an upper portion of the cabinet 502. According to the illustrated embodiment, the drawers 504 are storage drawers, and each of the drawers 504 is movable between a closed position, as shown in FIG. 30A, where the drawer 504 closes the open face of the cabinet 502, and an opened position, as illustrated in FIG. 30B, where the drawer 504 extends forwardly from the cabinet 502. The pivoting compartment 506 comprises an open-top storage bin 510 mounted to an inside surface thereof. Like the drawers 504, the pivoting compartment 506 is movable between closed and opened positions shown in FIGS. 30A and 30B, respectively, and the bin 510 is accessible when the pivoting compartment 506 is in the opened position.

The sink assembly 508 comprises an open-top basin 512 and a cover or lid 514 movable relative to the cabinet 502 for selectively closing the basin 512. The lid 514 can be operably coupled to the cabinet 502 through a coupling assembly 516 that allows the lid 514 to be lifted up to a generally vertical orientation and slid behind cabinet 502. Alternatively, the lid 514 can be coupled to the cabinet 502 through another type of coupling assembly or can be separate from the cabinet 502 such that the lid 514 can be removed completely from the cabinet 502 when not used to cover the basin 512. The sink assembly 508 further comprises a spout or spigot 518 mounted in the basin 512. The spout 518 is pivotable between a folded position, as shown in phantom in FIG. 30B, where the spout 518 is completely received within the basin 502 so that the lid 514 can close the basin 502, and an unfolded position, as shown in solid lines in FIG. 30B, where the spout 518 projects upwardly from the basin 502 for use. Thus, the sink assembly 508 has a storage position, as depicted in FIG. 30A, where the lid 514 closes the basin 512 and the spout 518 (not visible in FIG. 30A) is folded, and a use position, as illustrated in FIG. 30B, where the lid 514 is removed from the basin 512 and the spout 518 is unfolded. The lid 514 and the spout 518 can be coupled so that when the lid 514 is moved to provide access to the basin 512, the spout 518 automatically pivots out of the basin 512 to the unfolded position, and when the lid 514 is moved to close the basin 512, the spout 518 automatically pivots into the basin 512 to the folded position. The sink assembly 508 can be plumbed into the laundry appliance 10 in the form of the washing machine or can have independent plumbing. The sink assembly 508 can be used to treat stains on fabric items or to hand-wash or soak delicate fabric items. The sink function single height vertical module 500 is described in more detail in application Ser. No. 11/322,944, filed concurrently herewith, and titled "Sink Station with Cover," which is incorporated herein by reference in its entirety.

Figure 31A:
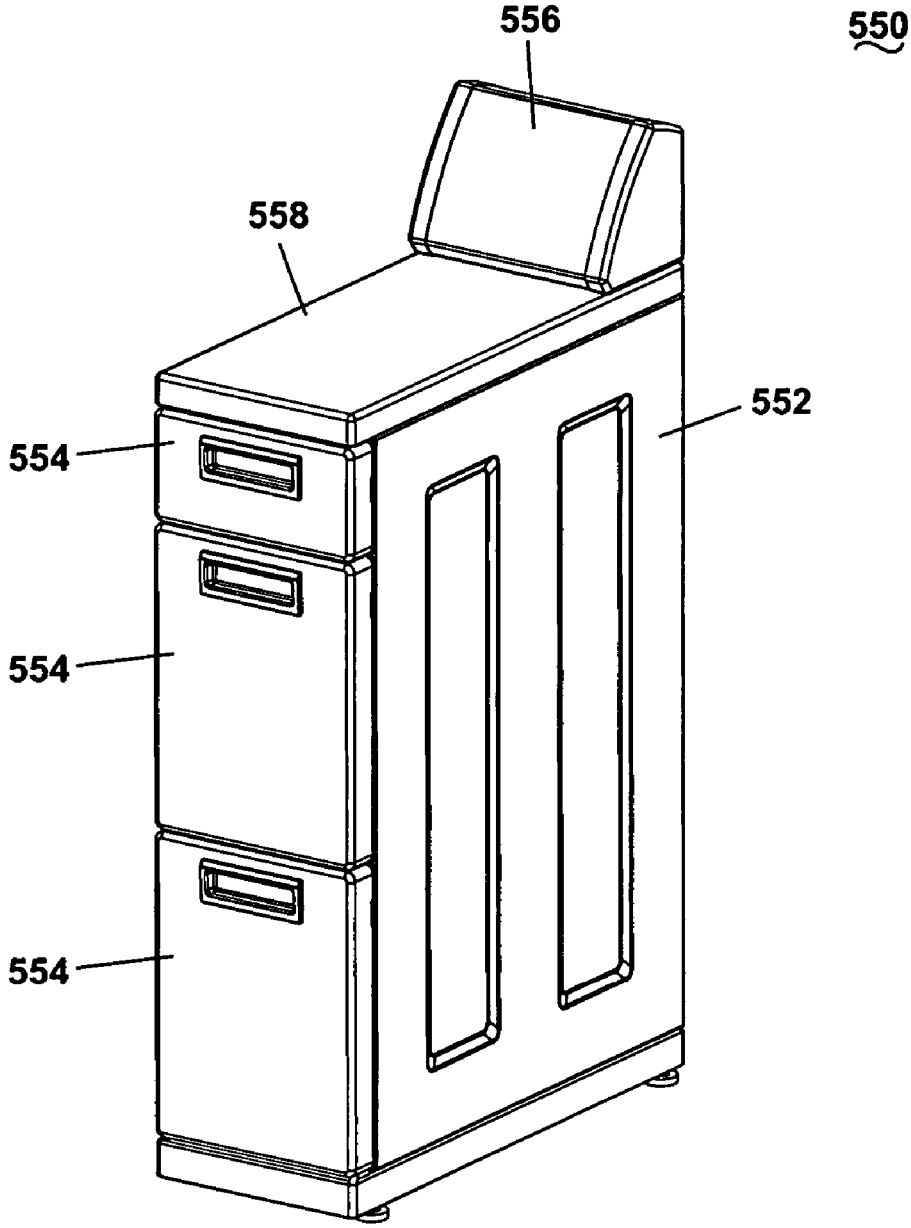
FIG. 31A is a perspective view of the single height vertical module of FIG. 3A having a storage function and shown with a plurality of storage drawers in a closed position.
Figure 31B:
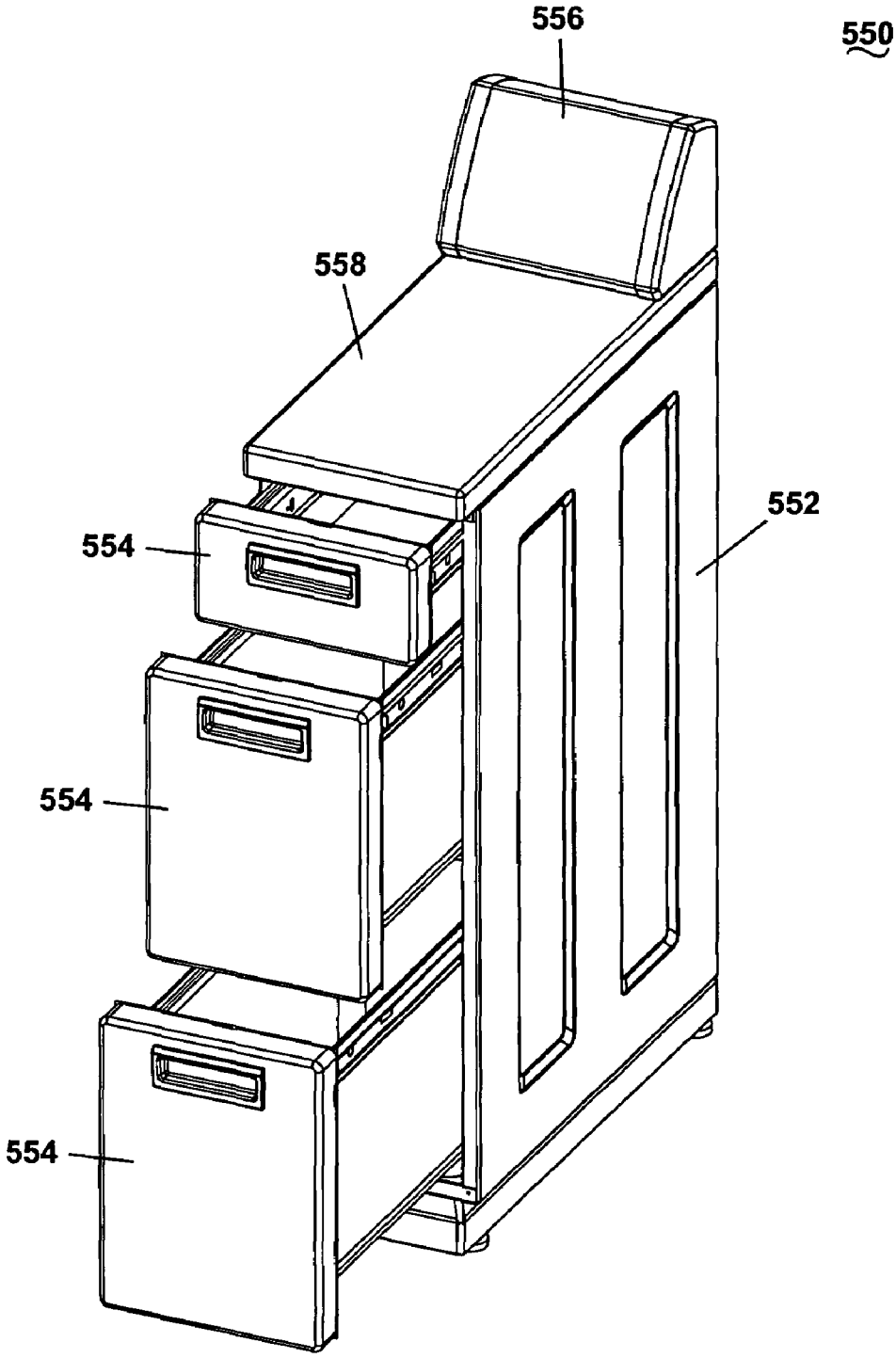
FIG. 31B is a perspective view of the storage function single height vertical module of FIG. 31A with the storage drawers in an opened position.

FIGS. 31A and 31B illustrate an embodiment of a storage function single height vertical module 550 comprising an open-face cabinet 552 and a plurality of vertically juxtaposed drawers 554 slidably mounted to the cabinet 552. According to the illustrated embodiment, the drawers 554 are storage drawers, and each of the drawers 554 is movable between a closed position, as shown in FIG. 31A, where the drawer 554 closes the open face of the cabinet 552, and an opened position, as illustrated in FIG. 31B, where the drawer 554 extends forwardly from the cabinet 552. The storage function single height vertical module 550 further comprises a backsplash 556 mounted to a top 558 of the cabinet 552. The backsplash 556 prevents items from falling behind the storage function single height vertical module 550 and, according to one embodiment, has an appearance similar to a backsplash on the laundry appliance 10 to provide an aesthetically pleasing appearance and to form a generally continuous backsplash when the storage function single height vertical module 550 is positioned adjacent to the laundry appliance 10.

Figure 32A:
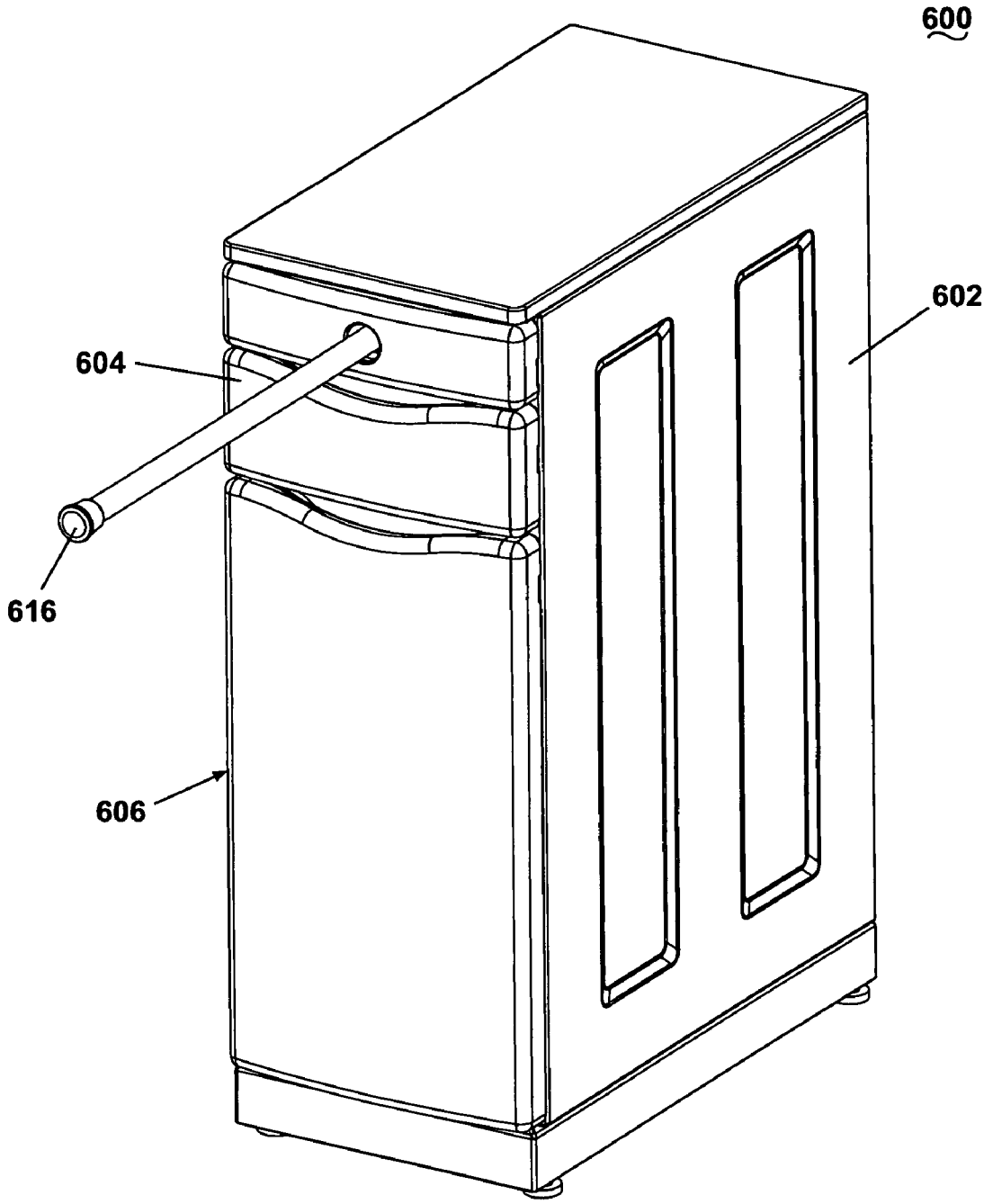
FIG. 32A is a perspective view of the single height vertical module of FIG. 3A having a storage function and shown with a plurality of storage drawers in a closed position and a hanging rod in an extended position.
Figure 32B:
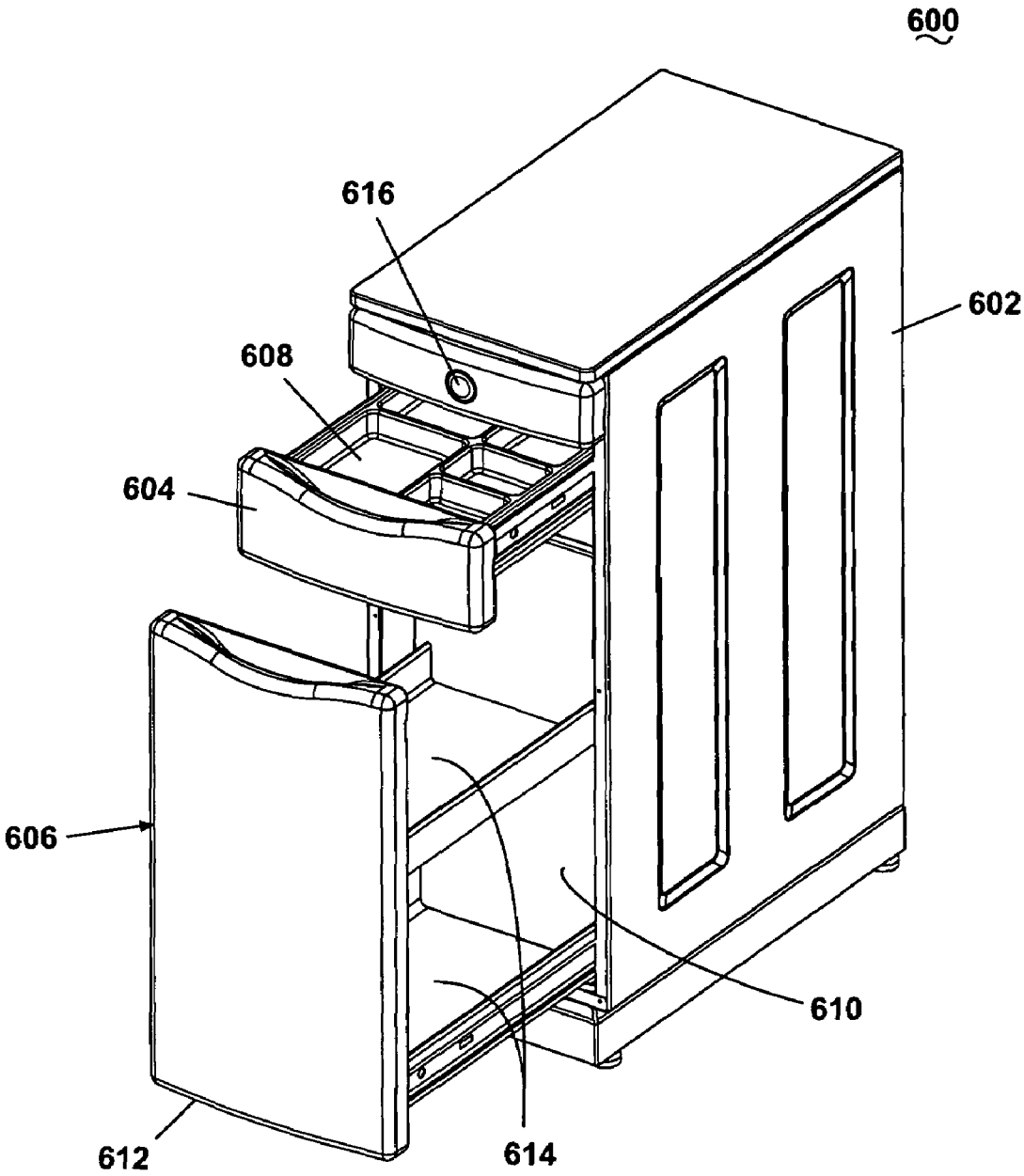
FIG. 32B is a perspective view of the storage function single height vertical module of FIG. 32A with the storage drawers in an opened position and the hanging rod in a retracted position.

FIGS. 32A and 32B illustrate another embodiment of a storage function single height vertical module 600 comprising an open-face cabinet 602 and vertically juxtaposed upper and lower drawers 604, 606 slidably mounted to the cabinet 602. Each of the drawers 604, 606 is movable between a closed position, as shown in FIG. 32A, where the drawer 604, 606 closes the open face of the cabinet 602, and an opened position, as illustrated in FIG. 32B, where the drawer 604 extends forwardly from the cabinet 602. The upper drawer 604 is a conventional open-top storage drawer and is illustrated as holding a compartmentalized storage tray 608. The lower drawer 606 comprises a generally U-shaped drawer frame 610 mounted to a drawer front 612. The drawer frame 610 includes a pair of vertically spaced shelves 614 for supporting various items in the lower drawer 606. The storage function single height vertical module 600 further comprises a hanging rod 616 movably mounted to the cabinet 602. As with the hanging rod 382 of the drying function intermediate height vertical module 350, the hanging rod 616 is movable between an extended position, as shown in FIG. 32A, where fabric items can be hung from the hanging rod 616, such as on a hanger, and a retracted position, as illustrated in FIG. 32B, where the hanging rod 616 is stored within the cabinet 602. Any type of actuator, such as a push-push type actuator, can be utilized to move the hanging rod 616 between the extended and retracted positions.

Figure 33A:
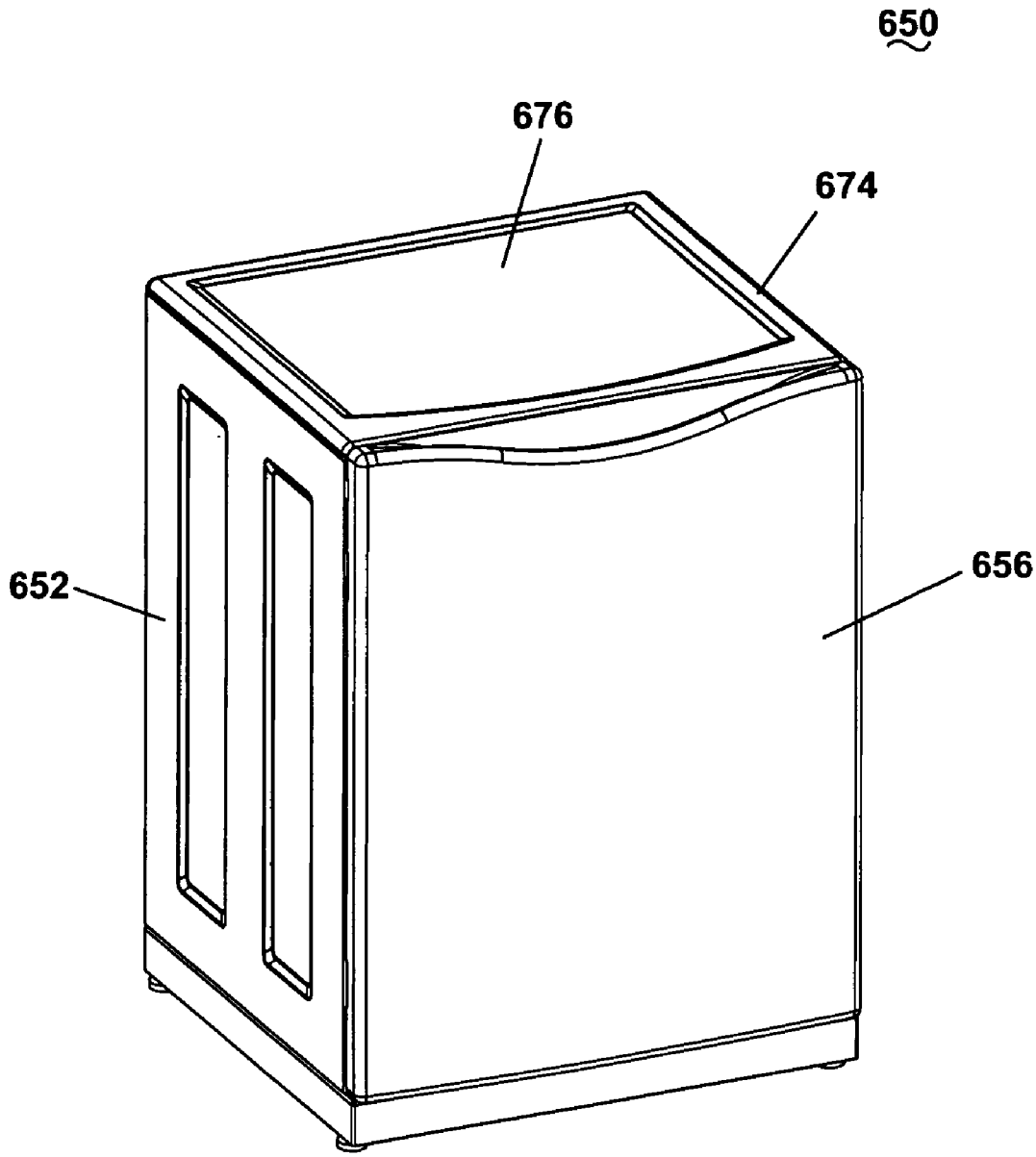
FIG. 33A is a perspective view of the single height cabinet module of FIG. 5A having a storage function and shown with a door in a closed position.
Figure 33B:
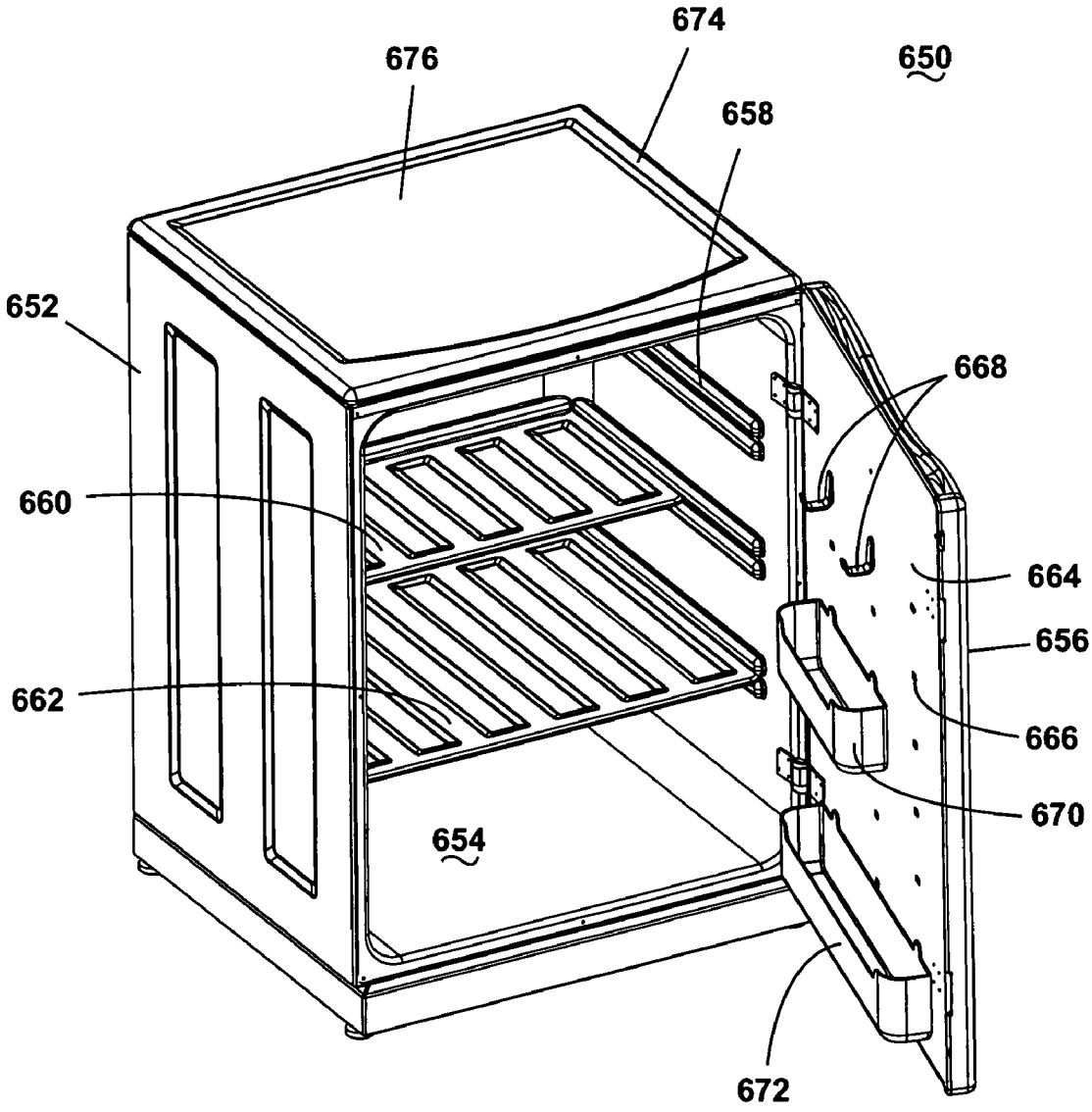
FIG. 33B is a perspective view of the storage function single height cabinet module of FIG. 33A with the door in an opened position.

FIGS. 33A and 33B illustrate an embodiment of a storage function single height cabinet module 650 comprising an open-face cabinet 652 defining a storage chamber 654 and a door 656 hingedly mounted to the cabinet 652. The door 656 is movable between a closed position, as shown in FIG. 33A, where the door 656 prevents access to the storage chamber 654, and an opened position, as illustrated in FIG. 33B, to allow access to the storage chamber 654. The cabinet 652 includes spaced pairs of tracks 658 that slidably receive removable shelves, such as a half depth shelf 660 and a full depth shelf 662. Additionally, the cabinet 652 further comprises a top 674 having a depression 676 that can be used for staging. The door 656 supports a peg board 664 having a plurality of holes 666 sized to receive pegs (not shown) of various support items to removably mount the support items to the peg board 664. Examples of the support items include hooks 668, a half width open-top storage unit 670, and a full width open-top storage unit 672. The peg board 664 is located on an inside surface of the door 656; thus, the support items are located in the storage chamber 654 when the door 656 is in the closed position.

Figure 34A:
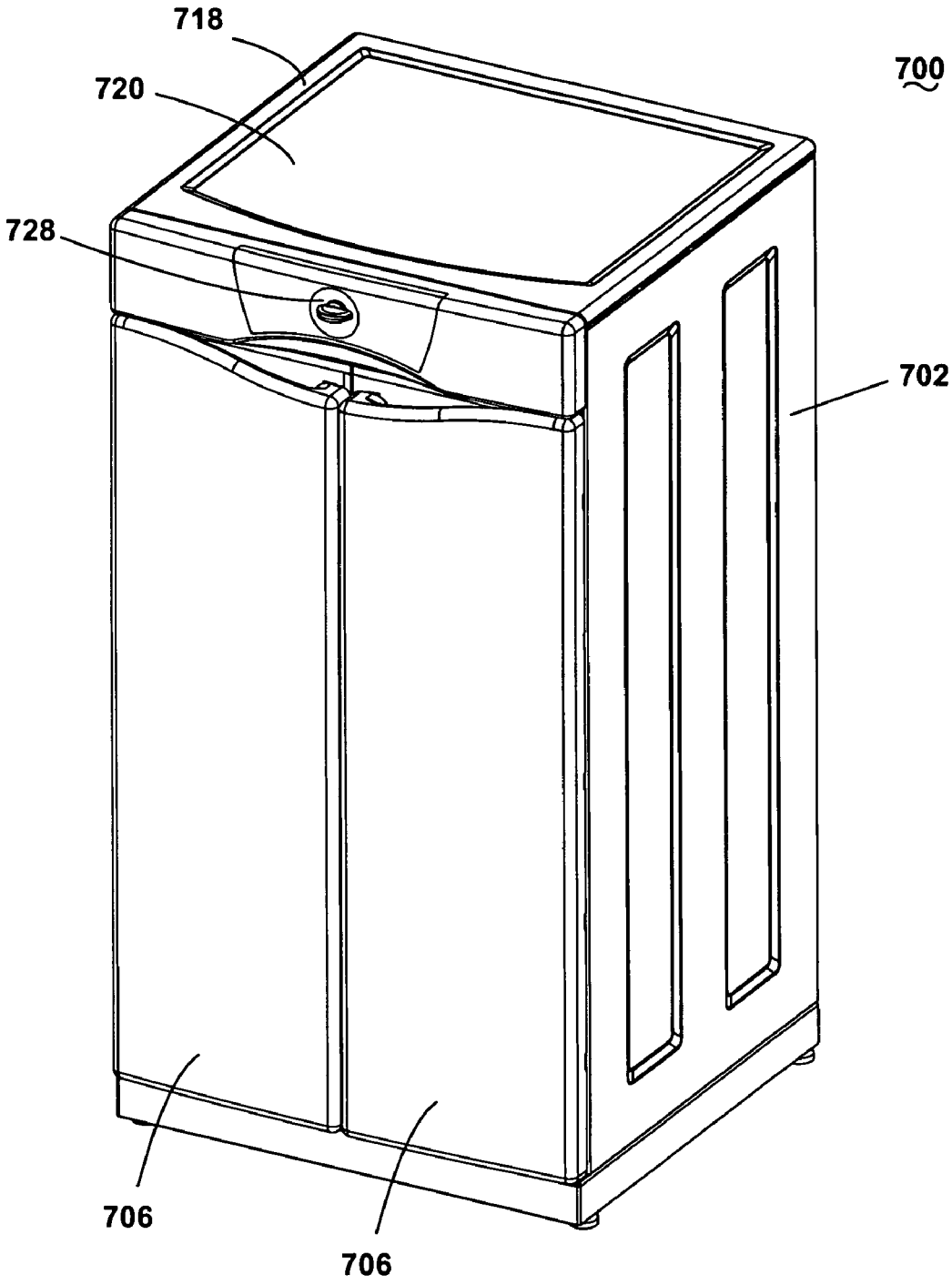
FIG. 34A is a perspective view of the intermediate height cabinet module of FIG. 5C having a drying function and shown with a pair of doors in a closed position.
Figure 34B:
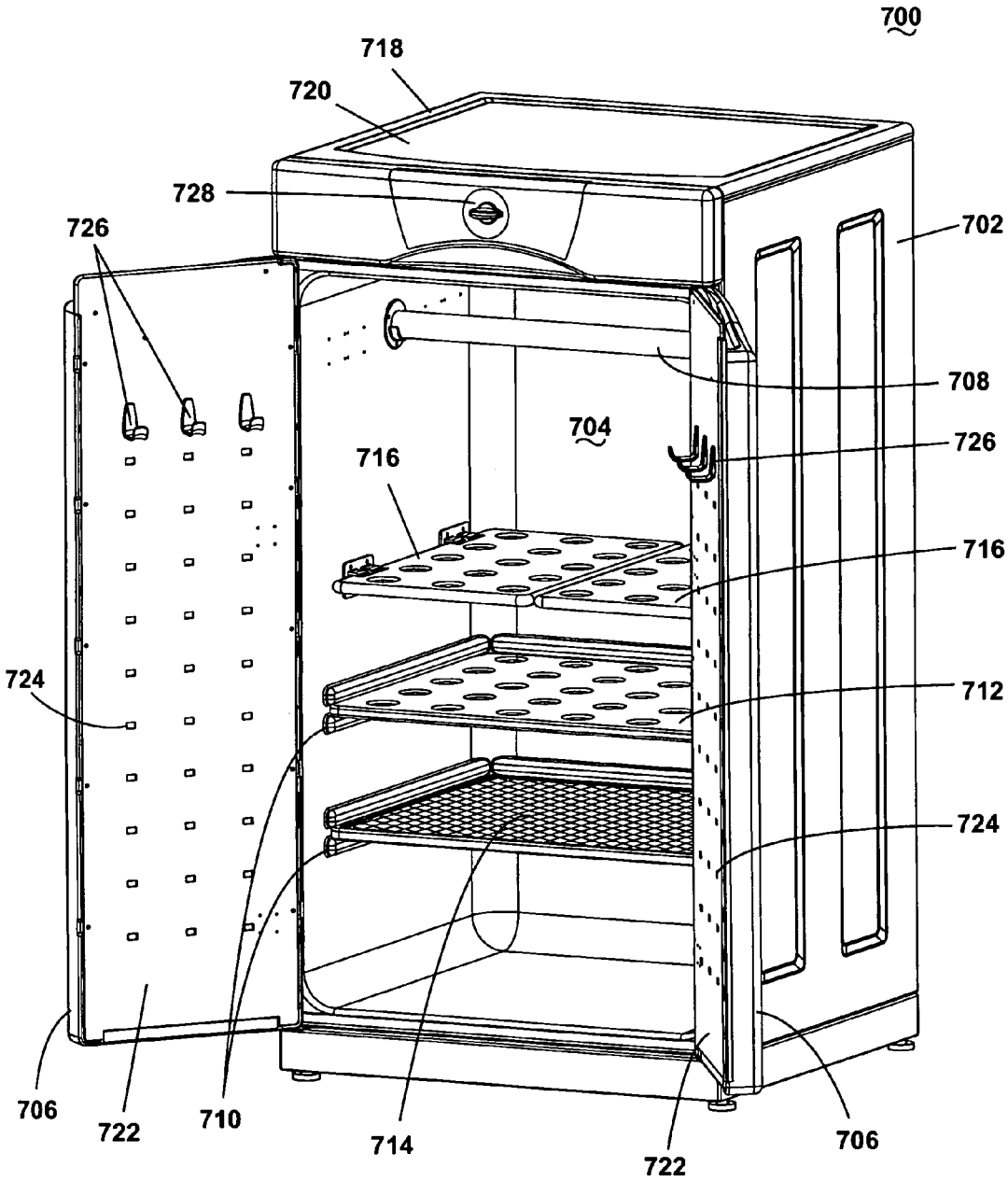
FIG. 34B is a perspective view of the drying function intermediate height cabinet module of FIG. 34A with the pair of doors in an opened position.

FIGS. 34A and 34B illustrate an embodiment of a drying function intermediate height cabinet module 700 comprising an open-face cabinet 702 defining a drying chamber 704 through which forced air can flow to dry fabric items and a pair of doors 706 hingedly mounted to the cabinet 702. The doors 706 are movable between a closed position, as shown in FIG. 34A, where the doors 706 close the drying chamber 704, and an opened position, as illustrated in FIG. 34B, where the doors 706 allow access to the drying chamber 704. The cabinet 702 includes a hanging bar 708 for hanging fabric items, such as by a hanger on the hanging bar 708. Additionally, fabric items can be supported on shelves. In the illustrated embodiment, the cabinet 702 comprises spaced pairs of tracks 710 for slidably mounting a perforated shelf 712 and a mesh shelf 714. Additionally, the cabinet 702 comprises a pair of hingedly mounted perforated shelves 716 that can be pivoted from a generally horizontal position, as shown in FIG. 34B, where the shelves 716 form a substantially continuous shelf, and a generally vertical position (not shown), where the shelves 716 are pivoted away from each other so that the shelves 716 do not interfere with fabric items hung from the hanging bar 708. Forced air can flow through all of the shelves 712, 714, 716. Additionally, the cabinet 702 further comprises a top 718 having a depression 720 that can be used for staging. The doors 706 each support a peg board 722 having a plurality of holes 724 sized to receive pegs of various support items, such as hooks 726, to removably mount the support items to the peg board 722. The peg boards 722 are each located on an inside surface of the respective door 706; thus, the support items are located in the drying chamber 704 when the door 706 is in the closed position. The user can select a desired drying cycle through a control panel 728 mounted on the cabinet 702 above the doors 706. The refreshing and/or sanitizing functions can be incorporated into the drying function intermediate height cabinet module 700 or can replace the drying function, if desired.

Figure 35A:
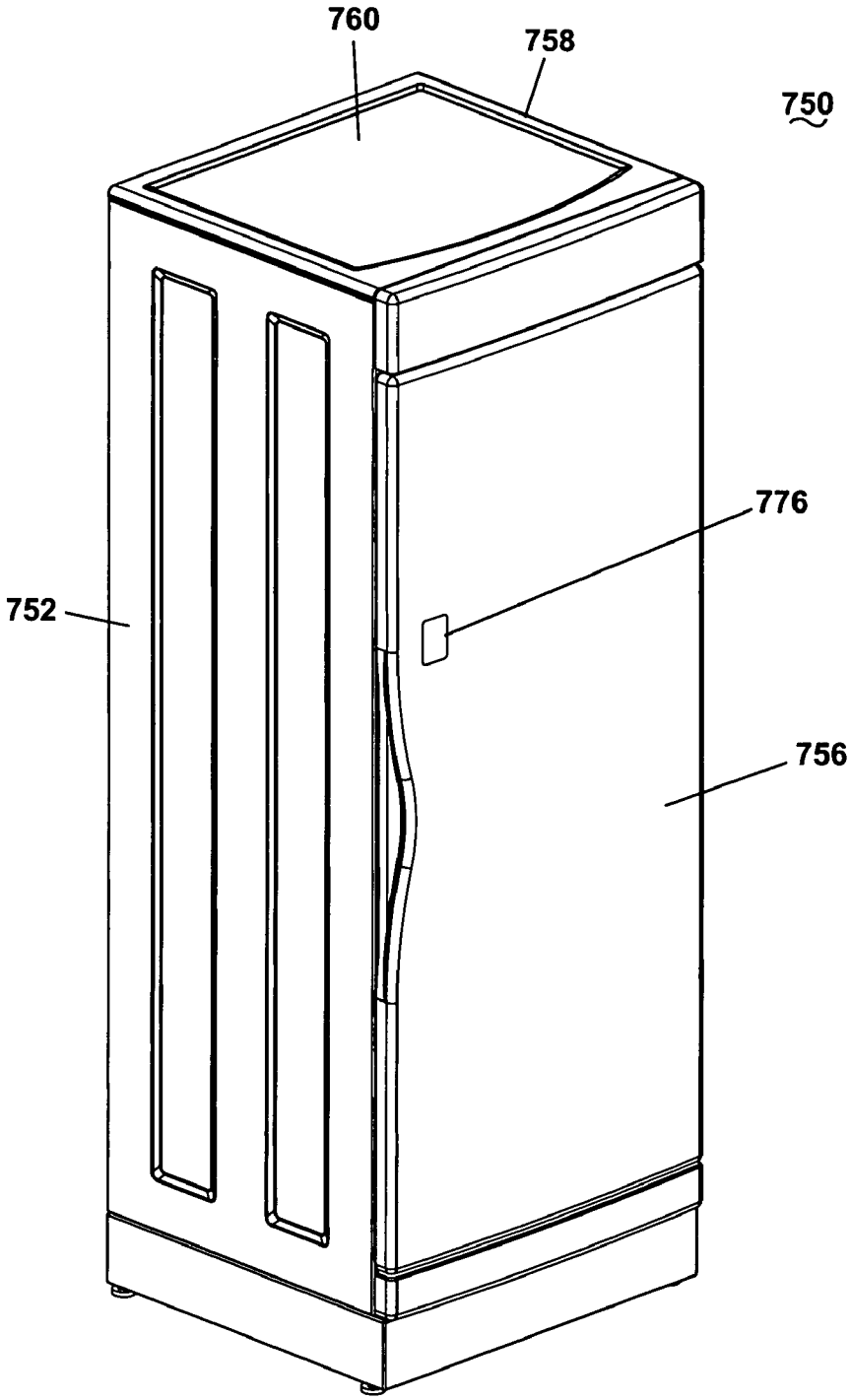
FIG. 35A is a perspective view of the double height cabinet module of FIG. 5E having a drying function and shown with a door in a closed position.
Figure 35B:
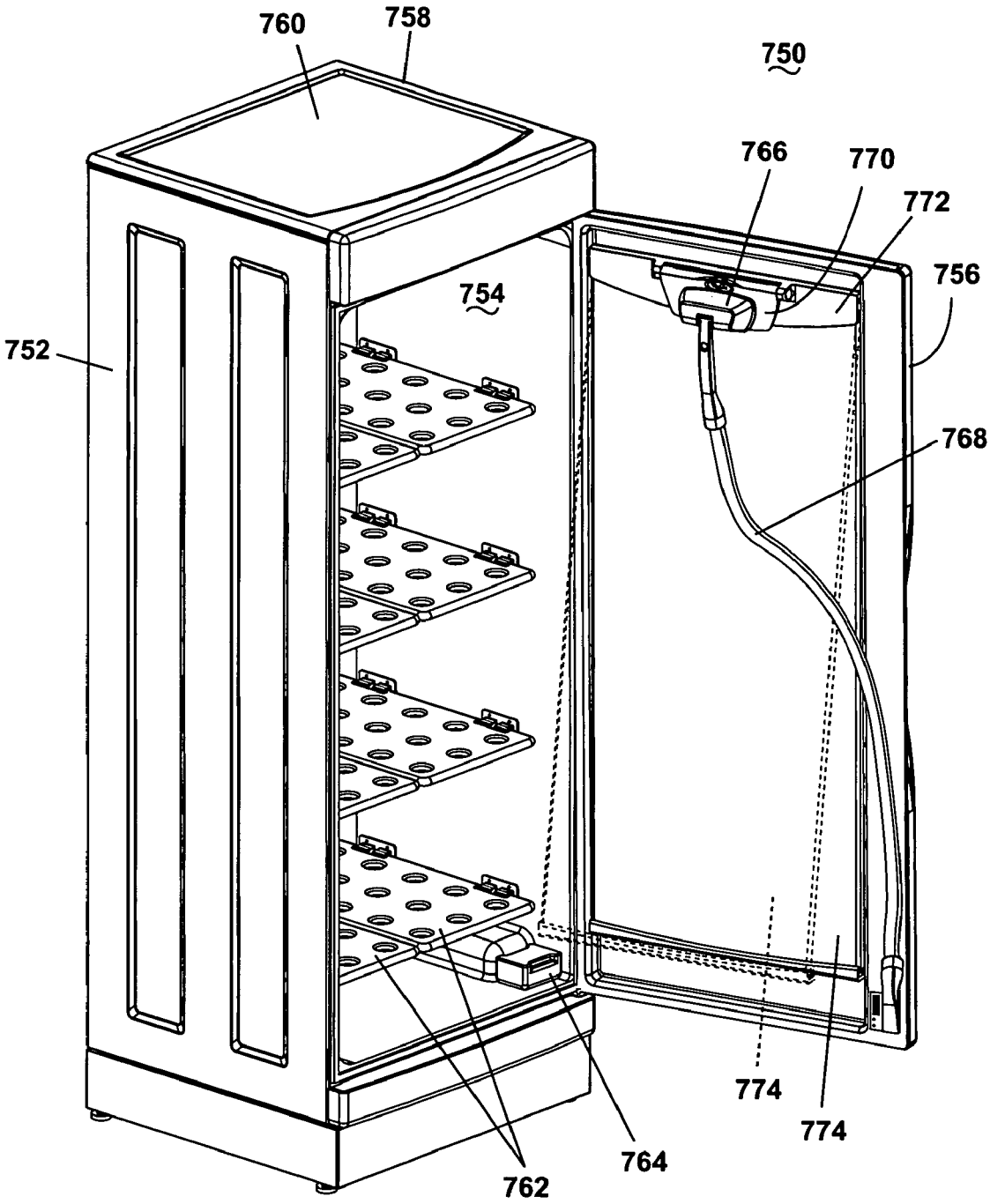
FIG. 35B is a perspective view of the drying function double height cabinet module of FIG. 35A with the door in an opened position.

FIGS. 35A and 35B illustrate an embodiment of a drying function double height cabinet module 750 comprising an open-face cabinet 752 defining a drying chamber 754 through which forced air can flow to dry fabric items and a door 756 hingedly mounted to the cabinet 752. The door 756 is movable between a closed position, as shown in FIG. 35A, where the door 756 closes the drying chamber 754, and an opened position, as illustrated in FIG. 35B, where the door 756 allows access to the drying chamber 754. The cabinet 752 comprises a top 758 having a depression 760 that can be used for staging. Inside the cabinet 752, several pairs of hingedly mounted perforated shelves 762 similar to the hinged perforated shelves 716 shown with respect to the drying function intermediate cabinet module 700 of FIGS. 34A and 34B can be utilized to support fabric items to be dried. The shelves 762 can be pivoted from a generally horizontal position, as shown in FIG. 35B, where each of the pairs of shelves 762 form a substantially continuous shelf, and a generally vertical position, where the shelves 762 in each pair are pivoted away from each other so that the shelves 762 do not interfere with fabric items hung from a hanging bar in the cabinet 752. Below the shelves 762, the cabinet 752 houses a water reservoir 764 that can be removed to be emptied or filled with water. The water reservoir 764 is fluidly coupled with a steam generator that generates steam from the water in the water reservoir 764 for delivery to a hand-held steam tool 766 fluidly coupled to the steam generator through a hose 768. The steam tool 766 is removably mounted to a steamer tool support 770 located on an inside surface of the door 756. In particular, the steamer tool support 770 is attached to a pivot plate 772 that pivotally mounts a steamer board 774 to the door 756. The steamer board 774 is pivotable between a generally vertical position, as shown in solid lines in FIG. 35B, against the door 756 and an inclined position, as shown in phantom in FIG. 35B, where a lower end of the steamer board 774 is pivoted away from the door 756 such that the steamer board 774 is ergonomically positioned for comfortable hand-steaming of fabric items supported by the steamer board 774. The steamer board 774 can be secured in the inclined position by a movable spacer located at a lower end of the steamer board 774 between the steamer board 774 and the door 756. The user can select a desired drying cycle and control operation of the steam generator through a control panel 776 mounted on an outside surface of the door 756. The refreshing and/or sanitizing functions can be incorporated into the drying function double height cabinet module 750 or can replace the drying function, if desired.

The storage function single height cabinet module 650, the drying function intermediate height cabinet module 700, and the drying function double height cabinet module 750 comprise some common elements. For example, each of these cabinet modules 650, 700, 750 has an open-face housing that defines an interior space and at least one door that selectively closes the open face of the housing. The function of the horizontal modules 200, 250, 300 is at least partially formed by or carried out in the interior space and/or the door. Additionally, it is within the scope of the invention for the cabinet modules 650, 700, 750 to comprise a drawer slidably mounted for movement relative to the interior space, as with several of the exemplary horizontal and vertical modules shown in FIGS. 24A-32B.

Figure 36A:
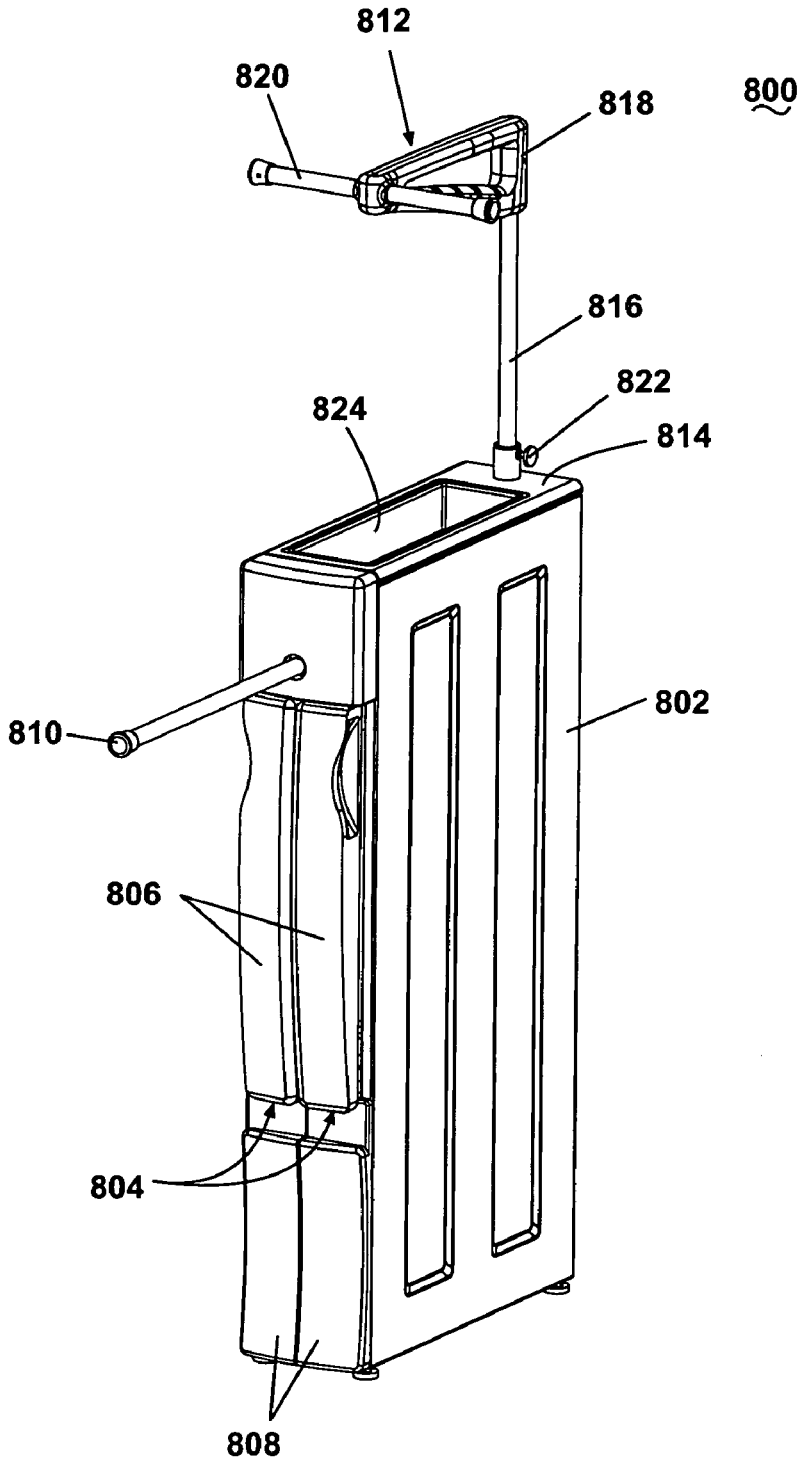
FIG. 36A is a perspective view of the intermediate height vertical module of FIG. 3A having a shelving function and shown with a pair of shelves in a retracted position.
Figure 36B:
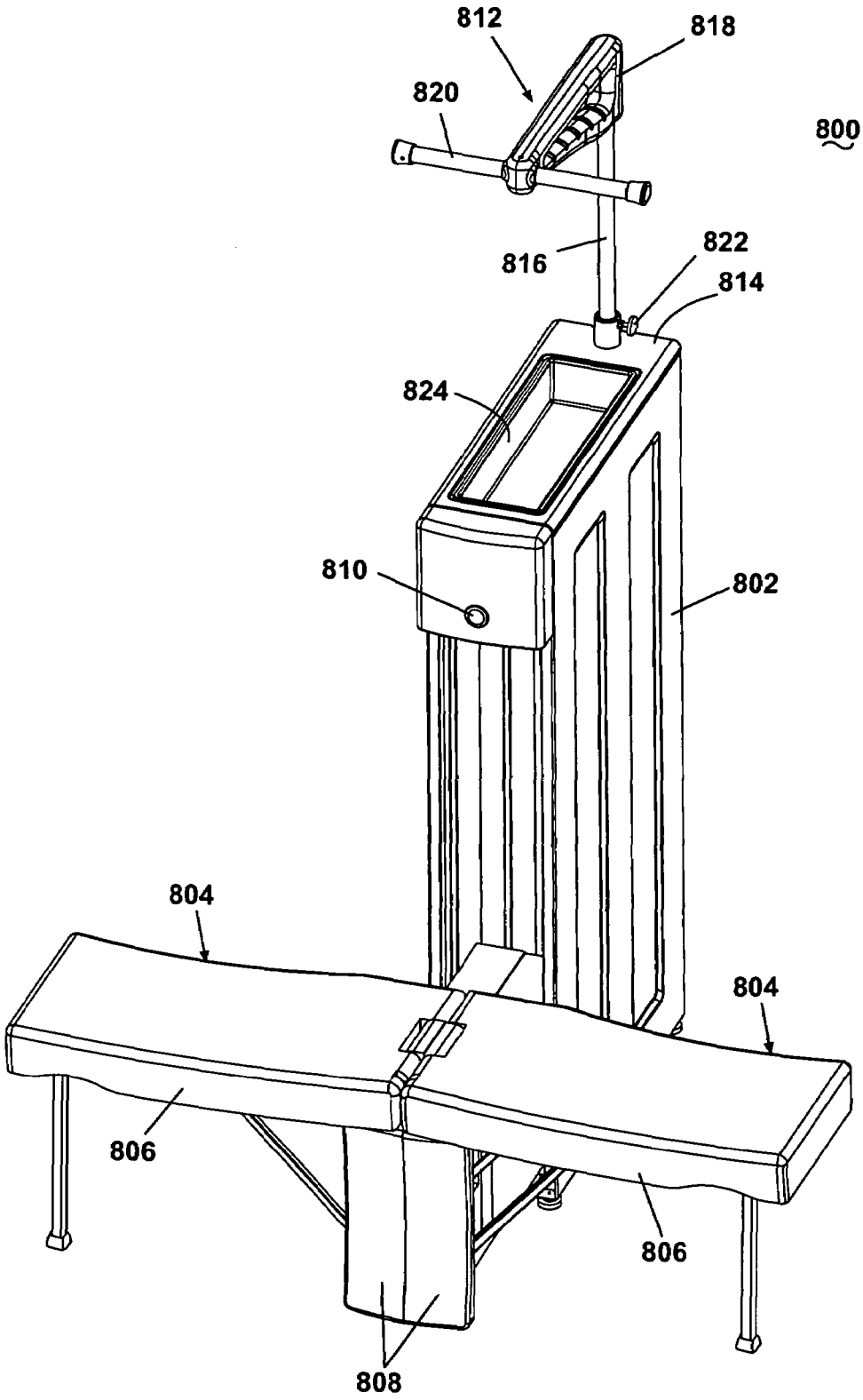
FIG. 36B is a perspective view of the shelving function intermediate height vertical module of FIG. 36A with the pair of shelves in an extended position.

FIGS. 36A and 36B illustrate an embodiment of one of the modules 20 having the shelving function. The module 20 in these figures is a shelving function intermediate height vertical module 800 comprising an open-face cabinet 802 and a pair of horizontally juxtaposed shelves 804 slidably mounted to the cabinet 802. Each of the shelves 804 comprises an upper, shelf portion 806 and a lower, base portion 808. The shelf portion 806 is pivotable between a generally vertical position, as shown in FIG. 36A, where the shelf portion 806 and the base portion 808 are vertically aligned and substantially colinear, and a generally horizontal position, as illustrated in FIG. 36B, where the shelf portion 806 is oriented substantially parallel to the ground and perpendicular to the base portion 808. When the shelf portion 806 is in the vertical position, the shelf 804 can be slid into a retracted position, as illustrated in FIG. 36A, where the shelf 804 is received within the cabinet 802. From the retracted position, the shelf 804 can be slid forwardly from the cabinet 802 to an extended position so that the shelf portion 806 can be pivoted from the vertical position to the horizontal position, as shown in FIG. 36B, so that items can be set upon the shelf portion 806. The shelves 804 can be adapted to slide between the retracted and extended positions independently or together. While the shelving function intermediate height vertical module 800 can be utilized in any suitable configuration with the laundry appliances 10, the shelving function intermediate height vertical module 800 is especially suited for use between two horizontally arranged laundry appliances 10 such that the shelf portions 806 can be extended and placed in the horizontal position in front of both of the laundry appliances 10 (i.e., one of the shelf portions 806 in front of each of the laundry appliances 10).

The shelving function intermediate height vertical module 800 also incorporates the hanging and storage functions.

Similar to the drying function intermediate height vertical module 350 and the storage function single height vertical module 600, the shelving function intermediate height vertical module 800 comprises a hanging rod 810 movably mounted to the cabinet 802 between an extended position, as shown in FIG. 36A, where fabric items can be hung from the hanging rod 810, such as on a hanger, and a retracted position, as illustrated in FIG. 36B, where the hanging rod 810 is stored within the cabinet 802. Any type of actuator, such as a push-push type actuator, can be utilized to move the hanging rod 810 between the extended and retracted positions. Additionally, the hanging function is also carried out by a hanging T-bar 812 mounted to a top 814 of the cabinet 802. The hanging T-bar 812 comprises a post 816 slidably mounted to the top 814, a generally triangular body 818 at an upper end of the post 816, and a generally horizontal bar 820 mounted at a forward end of the body 818. Fabric items can be hung, such as on a hanger, from the bar 820, and the height of the bar 820 relative to the top 814 can be adjusted by sliding the post 816 upward or downward and securing the post 816 in a desired position by a clamp 822. For the storage function, the top 814 forms an open-top cavity 824 that can be used for staging. The shelving function intermediate height vertical module 800 is described in more detail in application Ser. No. 11/323,658, filed concurrently herewith, and titled "Modular Laundry System with Shelf Module," which is incorporated herein by reference in its entirety.

More detailed descriptions of some of the exemplary vertical modules, variations of the exemplary vertical modules, and other exemplary vertical modules are given in application Ser. No. 11/323,867, filed concurrently herewith, and titled "Vertical Laundry Module," and application Ser. No. 11/322,943, filed concurrently herewith, and titled "Vertical Laundry Module with Backsplash," which are incorporated herein by reference in their entirety.

In addition to the laundry appliances 10 and the modules 20, the modular laundry system can incorporate accessories, such as work surfaces. The work surfaces can be positioned on top of one or more of the laundry appliances 10 or modules 20 to adapt the top of the laundry appliances 10 or modules 20 for the user to perform various tasks or functions. The work surfaces can be rigid or flexible and can include various features. For example, the work surface can include a non-skid surface or can comprise a hygienic material, such as by being made of, impregnated with, or coated with a hygienic material, that kills or prevents proliferation of germs, microbes, fungus, and the like. A more detailed description of the work surfaces is presented in application Ser. No. 11/323,220, filed concurrently herewith, and titled "Modular Laundry System with Work Surface," application Ser. No. 11/322,773, filed concurrently herewith, and titled "Modular Laundry System with Segmented Work Surface," application Ser. No. 11/322,741, filed concurrently herewith, and titled "Modular Laundry System with Work Surface Having a Functional Insert," and application Ser. No. 11/322,740, filed concurrently herewith, and titled "Modular Laundry System with Work Surface Having a Functional Element," which are incorporated herein by reference in their entirety. Examples of the work surfaces are illustrated in FIGS. 37A-39B.

Figure 37A:
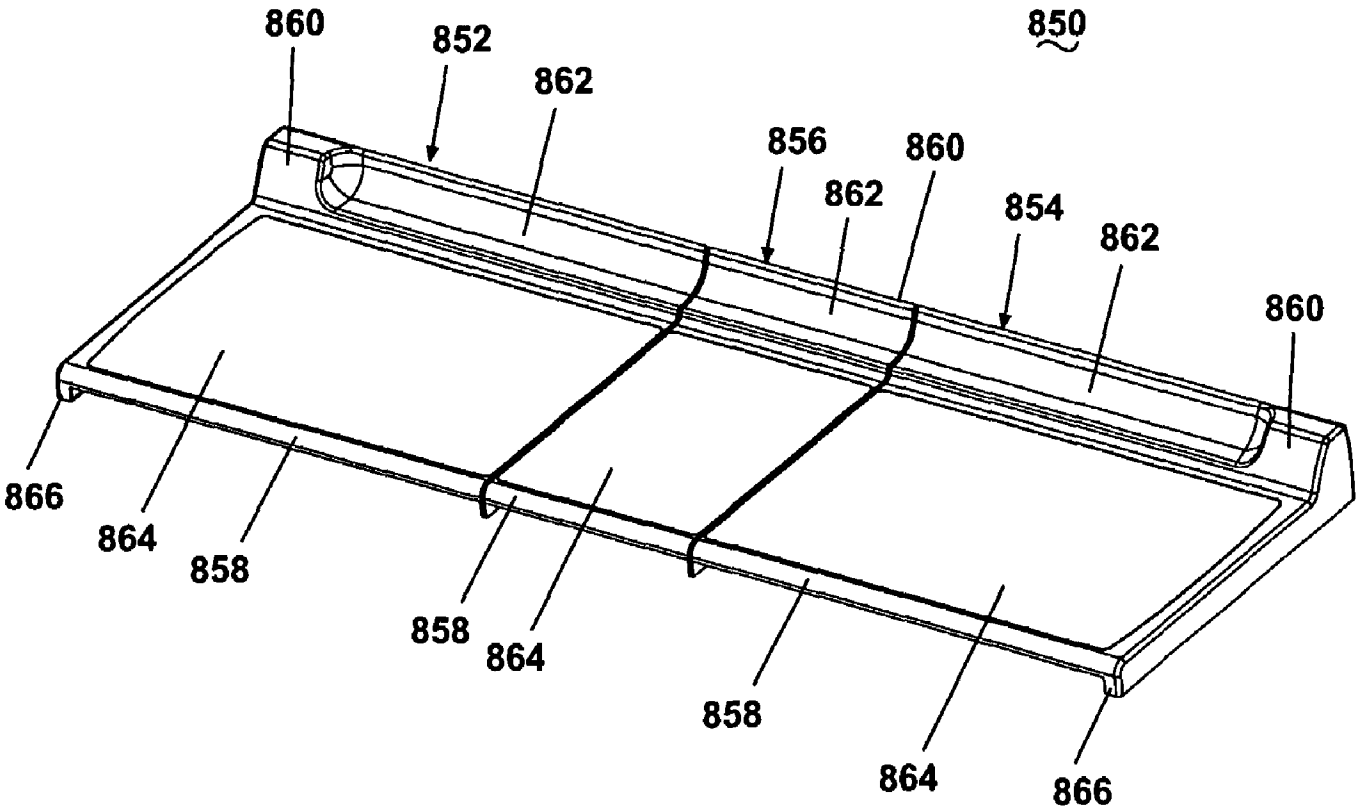
FIG. 37A is a perspective view of a segmented work surface in an assembled condition.
Figure 37B:
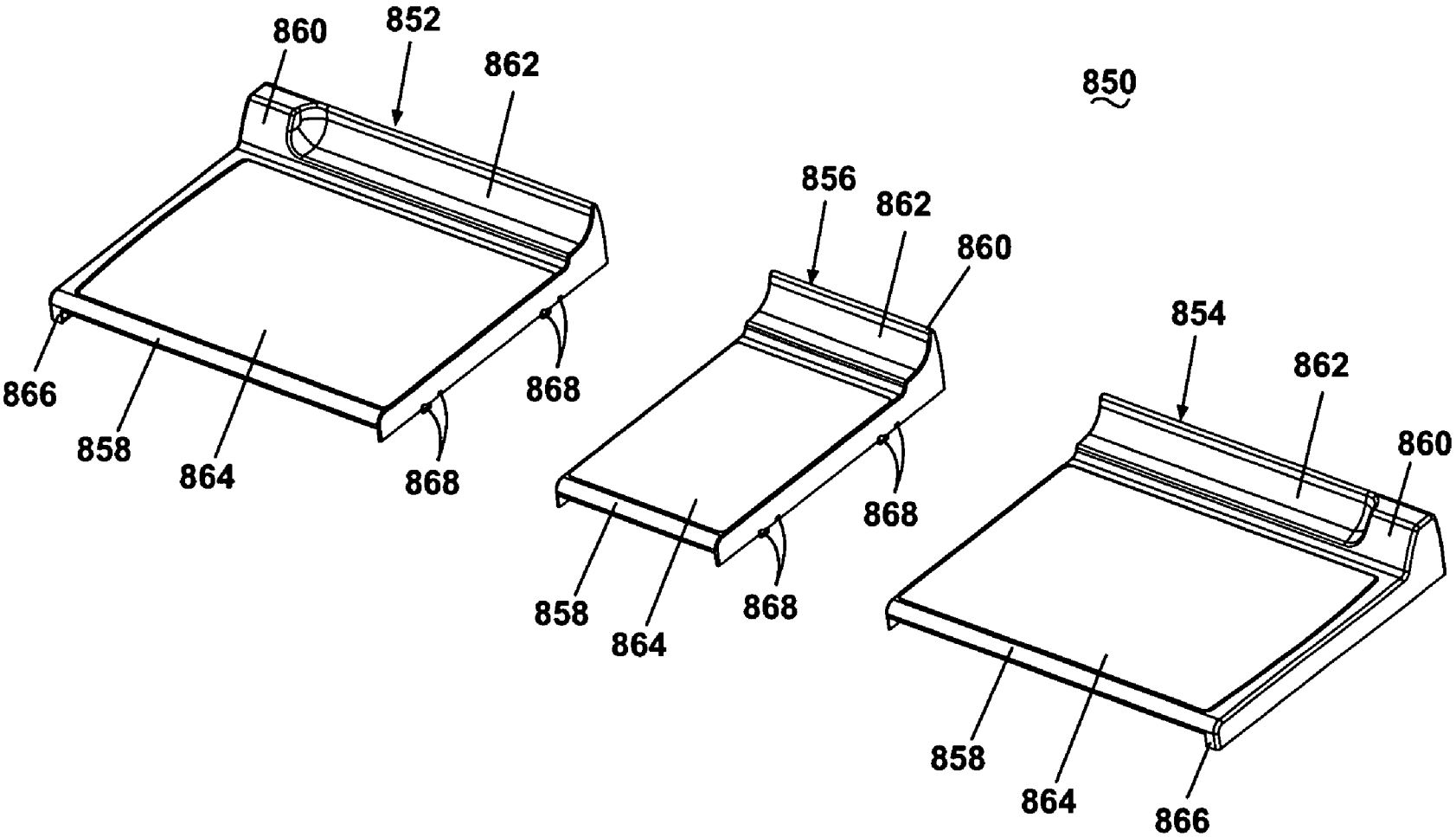
FIG. 37B is a perspective view the segmented work surface of FIG. 37A in a disassembled condition.

FIGS. 37A and 37B depict an embodiment of a segmented work surface 850 comprising first and second laundry appliance segments 852, 854 and a module segment 856 that can be positioned between the first and second laundry appliance segments 852, 854. The first and second laundry appliance segments 852, 854 are each sized to be positioned on top of the laundry appliance 10, while the module segment 856 is sized to be positioned on top of the module 20. Each of the segments 852, 854, 856 comprises a platform 858 and an integral backsplash 860 in which is formed a recess 862 that can be used for staging. The segments 852, 854, 856 further comprise a functional insert 864, such as a mat, which can have a texture corresponding to the type of task or function to be performed on the work surface, that extends across the platform 858. Furthermore, the laundry appliance segments 852, 854 each have a depending flange 866 along one side edge to facilitate positioning the segmented work surface 850 on the laundry appliances 10 and to prevent lateral movement of the segmented work surface 850 relative to the laundry appliances 10. The segments 852, 854, 856 each comprise couplers for connecting the segments 852, 854, 856 together to form a generally unitary work surface, as shown in FIG. 37A. The segments 852, 854, 856 can also be separated, as illustrated in FIG. 37B, so that the segmented work surface 850 can be configured according to the laundry appliances 10 and the modules 20 used in the modular laundry system. For example, all three of the segments 852, 854, 856 can be employed when the module 20 is positioned between the laundry appliances 10, or just the first and second laundry appliance segments 852, 852 can be used if no module 20 is disposed between the laundry appliances 10. The segmented work surface 850 is not limited to having three segments; the segmented work surface 850 can include any number of segments having sizes corresponding to the laundry appliances 10 and the modules 20 used in the modular laundry system.

Figure 38:
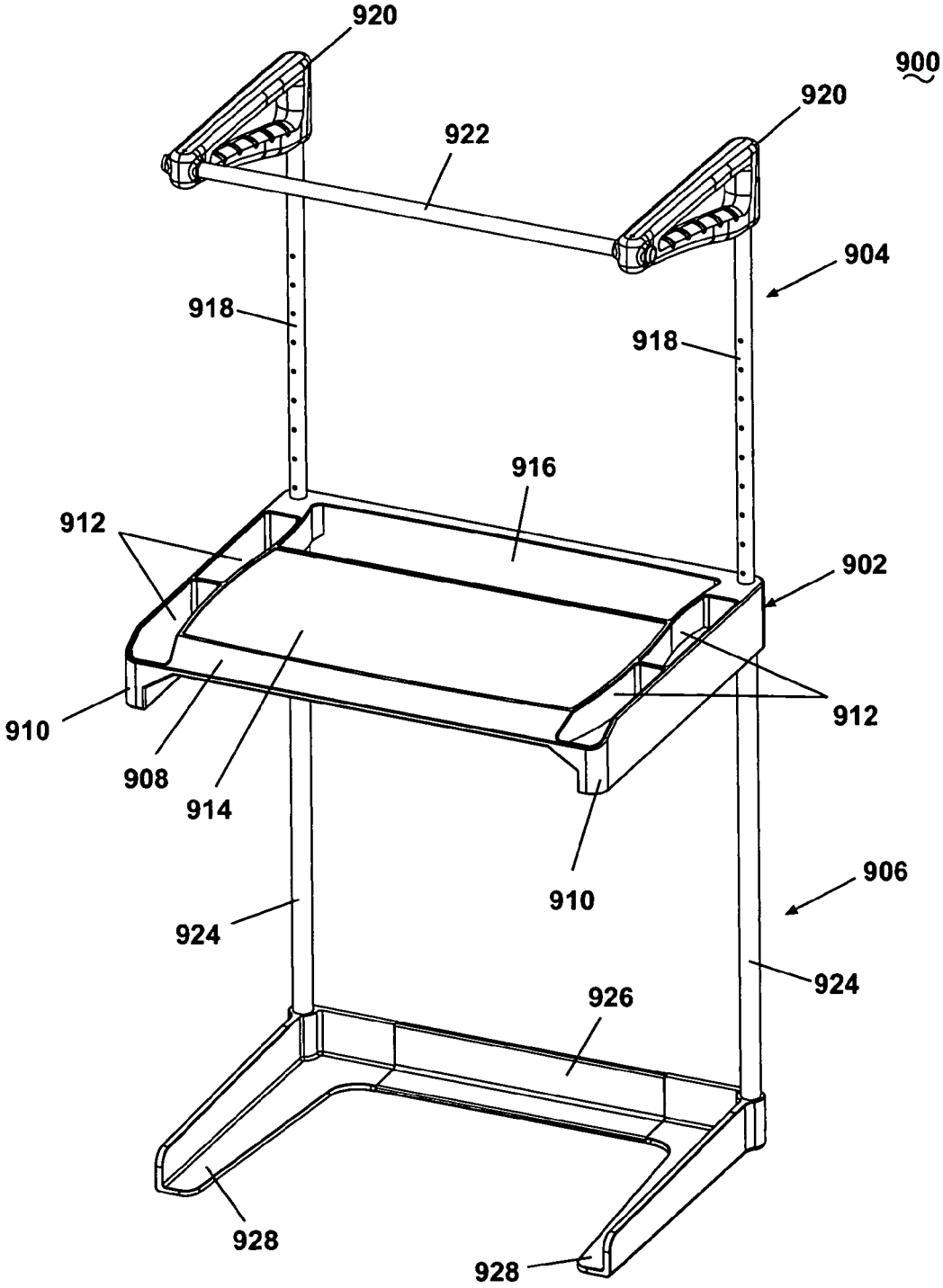
FIG. 38 is a perspective view of a single laundry appliance work surface.

FIG. 38 shows an embodiment of another accessory in the form of a single laundry appliance work surface 900 comprising a work surface 902 and a hanging bar assembly 904 supported by a floor mount 906. The work surface 902 is sized to fit on top of one of the laundry appliances 10 and comprises a work surface platform 908 extending between depending flanges 910. A plurality of open-top cavities 912 located above the flanges 910 at the sides of the work surface platform 908 can be used for staging, and a functional insert 914, such as a mat, which can be textured corresponding to the type of task or function to be performed on the work surface, extends across the work surface platform 908. Furthermore, the work surface 902 forms an elongated opening or aperture 916 along a rear edge to accommodate a backsplash of the laundry appliance 10. The hanging bar assembly 904 comprises a pair of posts 918, a body 920 mounted at an upper end of each of the posts 918, and a hanging bar 922 extending between the bodies 920. The floor mount 906 comprises a pair of posts 924 that are mounted in a base 926 that rests on the floor. The posts 922 of the floor mount 906 and the posts 918 of the hanging assembly 904 meet at the work surface 902, and the height of the hanging bar 922 can be adjusting by sliding the posts 918 relative to the posts 924 of the floor mount 906. The base 926 includes a pair of feet 928 that can be partially positioned beneath the laundry appliance 10 when the single laundry appliance work surface 900 is used with the laundry appliance 10. In other words, the laundry appliance 10 is received between the feet 928 of the base 926 and the work surface 902.

Figure 39A:
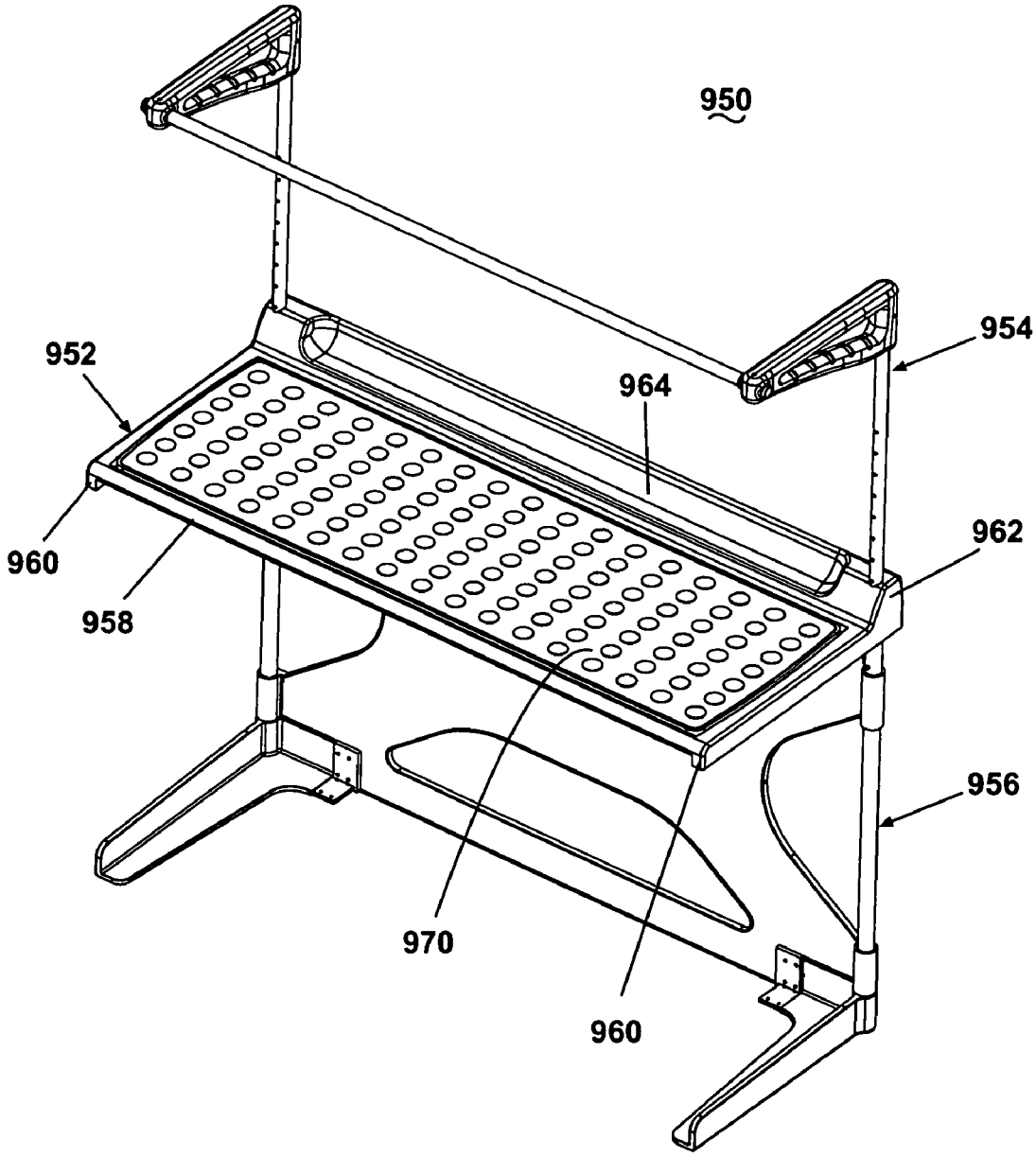
FIG. 39A is perspective view of a double laundry appliance work surface having a removable work surface shown with a first side facing upwards.
Figure 39B:
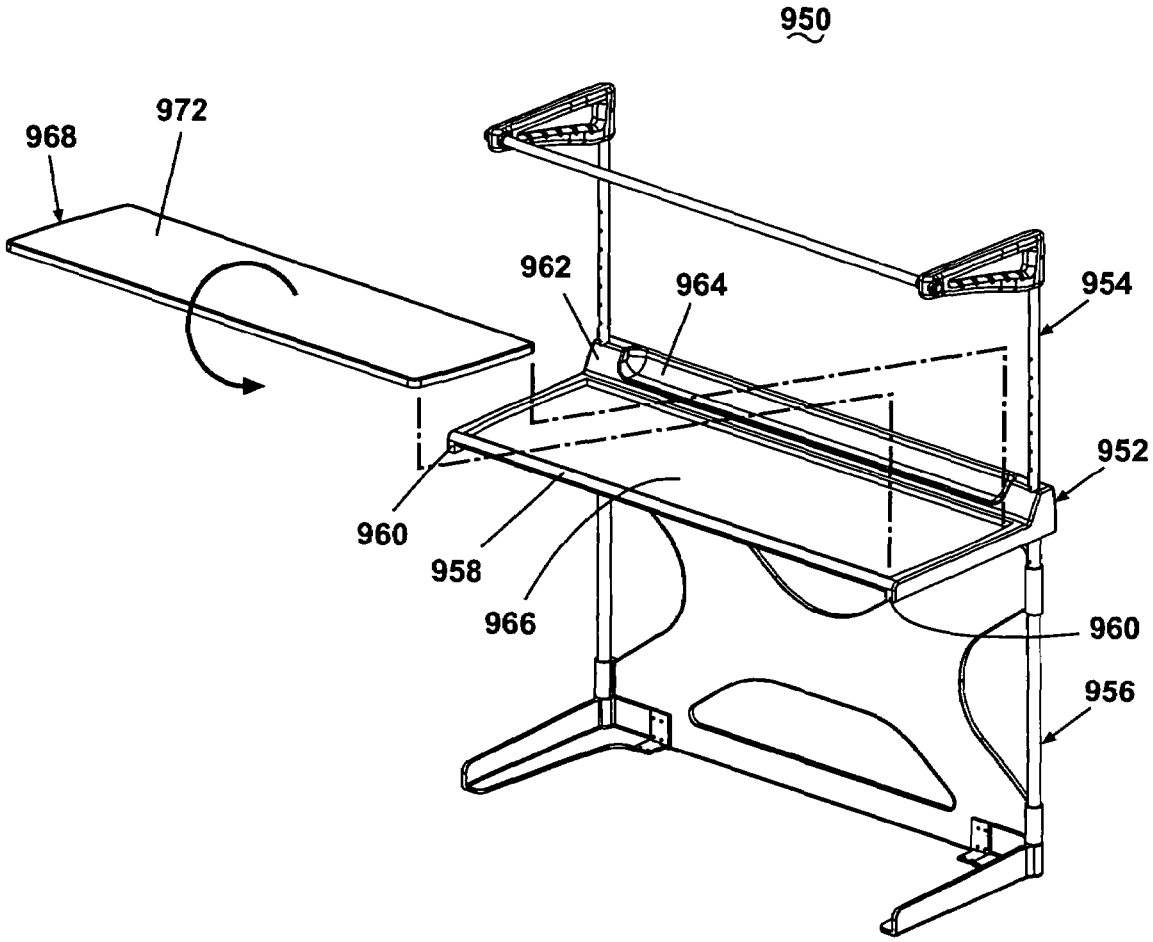
FIG. 39B is a perspective view of the double laundry appliance work surface of FIG. 39A with the removable work surface being flipped over so that a second side is facing upwards.

FIGS. 39A and 39B illustrate another accessory embodiment in the form of a double laundry appliance work surface 950 comprising a work surface assembly 952, a hanging bar assembly 954, and a floor mount 956. The hanging bar assembly 954 and the floor mount 956 are substantially identical to those of the single laundry appliance work surface 950, except that the hanging bar assembly 954 and the floor mount 956 are adapted to fit two of laundry appliances 10 in a side-by-side arrangement. The work surface assembly 952 comprises a work surface platform 958 extending between depending flanges 960. An integral backsplash 962 with a staging recess 964 is formed along a rear edge of the work surface platform 958. The work surface platform 958 includes a depression 966 sized to receive a removable functional insert 968. The functional insert 968 comprises a first side 970 having a first surface configured for performing a first function on the functional insert 968 and a second side 972 having a second surface different than the first surface and configured for performing a second function on the functional insert 968. For example, one of the first and second sides 970, 972 can be suited for ironing, while the other of the first and second sides 970, 972 can be utilized for cutting fabrics for sewing patterns. The functional insert 968 can be positioned with the first side 970 facing upwards, as shown in FIG. 39A, for performing the first function, or the functional insert 968 can be removed and flipped over, as depicted in FIG. 39B, so that the second side 972 faces upwards for performing the second function.

While the single and double laundry appliance work surfaces 900, 950 have been shown and described as being sized for use with a single laundry appliance 10 or two side-by-side laundry appliances 10, the work surfaces 900, 950 can be sized for use with one or more of the modules 20, more than two of the laundry appliances 10, or any combination of any quantity of horizontally arranged laundry appliances 10 and modules 20. Additionally, the single and double laundry appliance work surfaces 900, 950 have been shown and described as incorporating the hanging function, but it is within the scope of the invention to omit the hanging function for the work surfaces 900, 950.

FIGS. 40A-46B illustrate exemplary implementations of the modular laundry system employing the exemplary modules of FIGS. 24A-36B and the work surface accessories of FIGS. 37A-39B. FIGS. 40A-46B also include the schematics of the core and customized configurations corresponding the implementations of the modular laundry system. The implementations shown in FIGS. 40A-46B are provided for illustrative purposes and are not intended to limit the invention in any manner. Numerous implementations of the modular laundry system can be derived from the laundry appliances 10 and the modules 20.

Figure 40A:
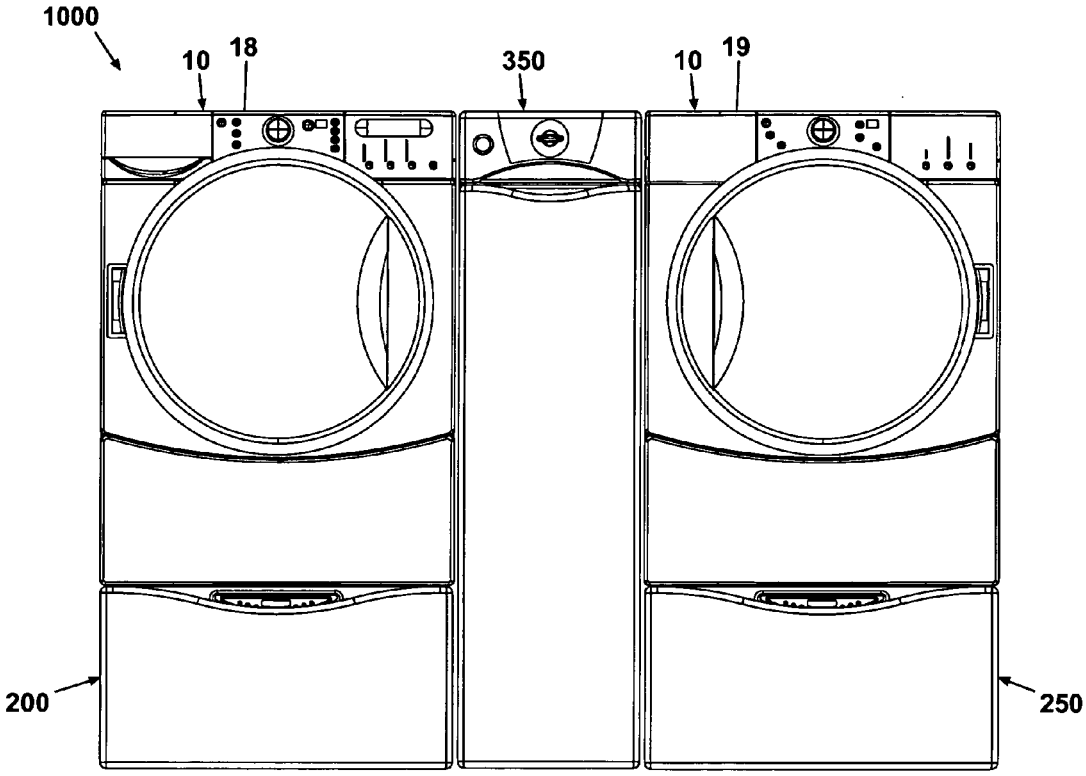
FIG. 40A is a front view of an implementation A of the modular laundry system.
Figure 40B:
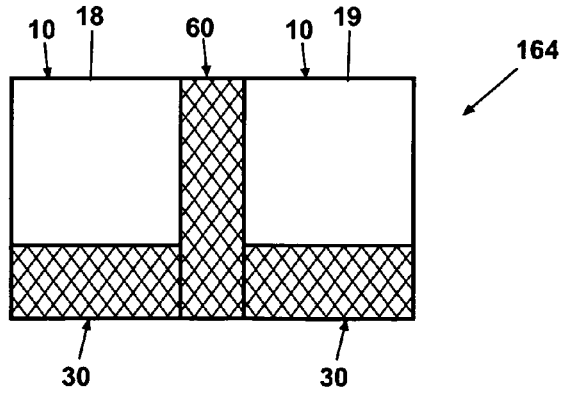
FIG. 40B is a schematic view of the customized configuration M of FIG. 20B, which corresponds to the implementation A of FIG. 40A.
Figure 40C:
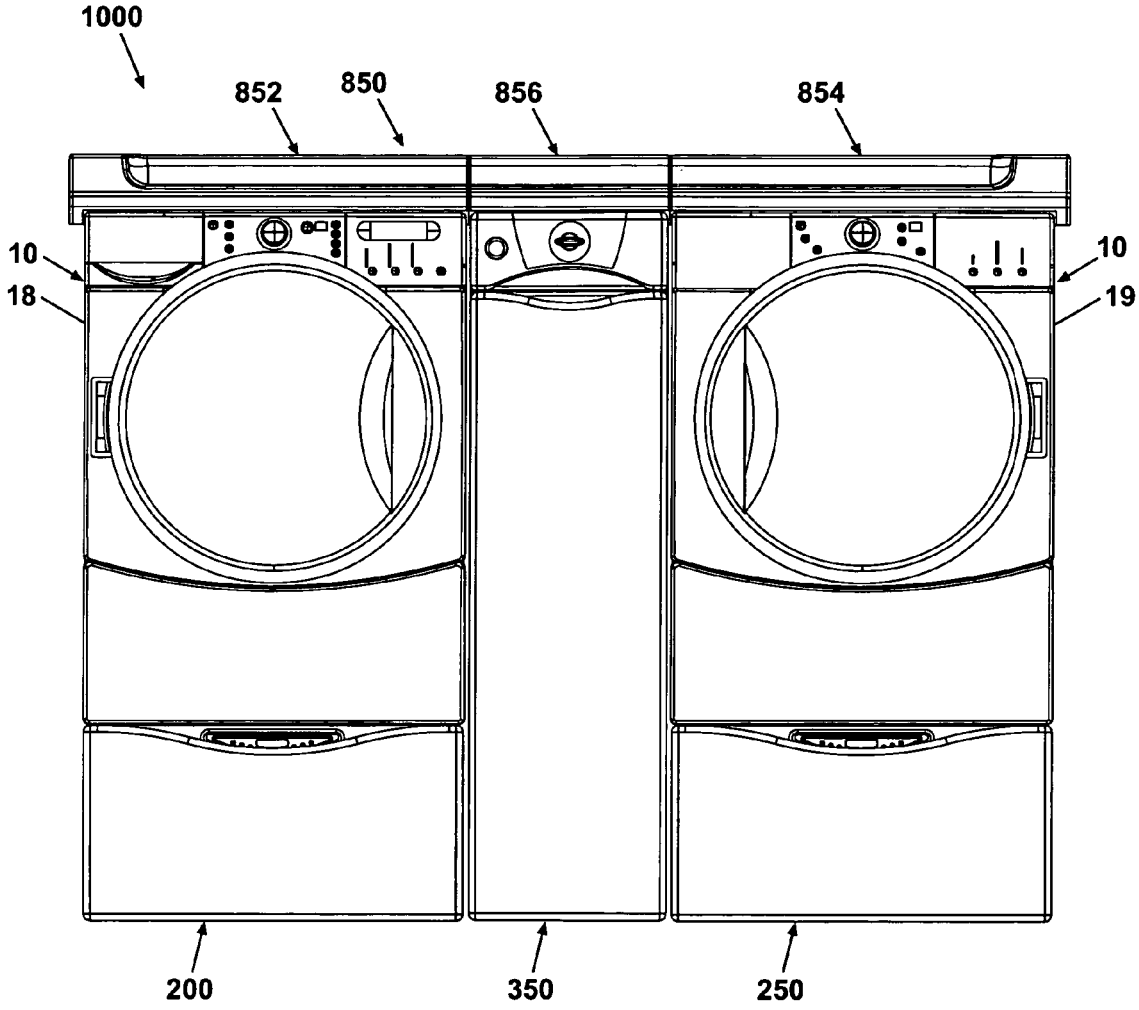
FIG. 40C is a front view of the implementation A of FIG. 40A incorporating the segmented work surface of FIG. 37A.

An implementation A 1000 shown in FIG. 40A corresponding to the customized configuration M 164 of FIG. 20B and reproduced in FIG. 40B comprises the first laundry appliance 18 in the form of a front-loading washing machine vertically stacked above the washing function single width horizontal module 200, the second laundry appliance 19 in the form of a front-loading dryer vertically stacked above the drying function single width horizontal module 250, and the drying function intermediate height vertical module 350 positioned between the laundry appliances 18, 19. The segmented work surface 850 can readily be incorporated into the implementation A 1000, as shown in FIG. 40C.

Figure 41A:
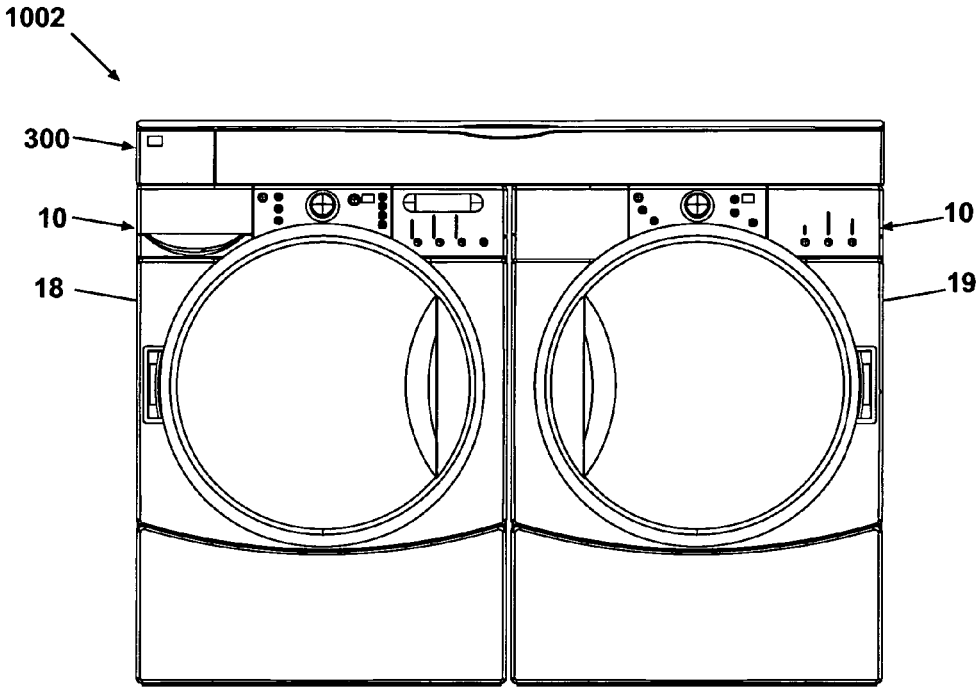
FIG. 41A is a front view of an implementation B of the modular laundry system.
Figure 41B:
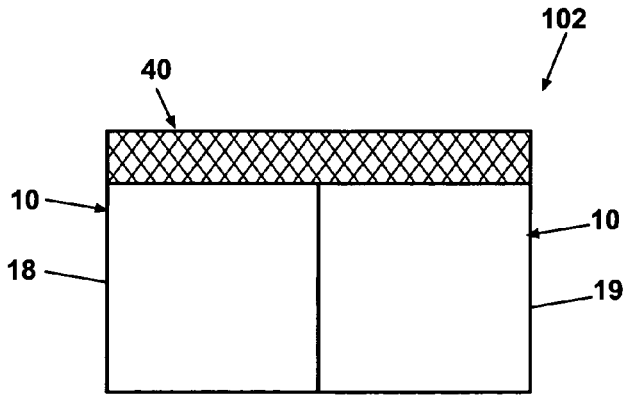
FIG. 41B is a schematic view identical to FIG. 10 of the core configuration B, which corresponds to the implementation B of FIG. 41A.
Figure 41C:
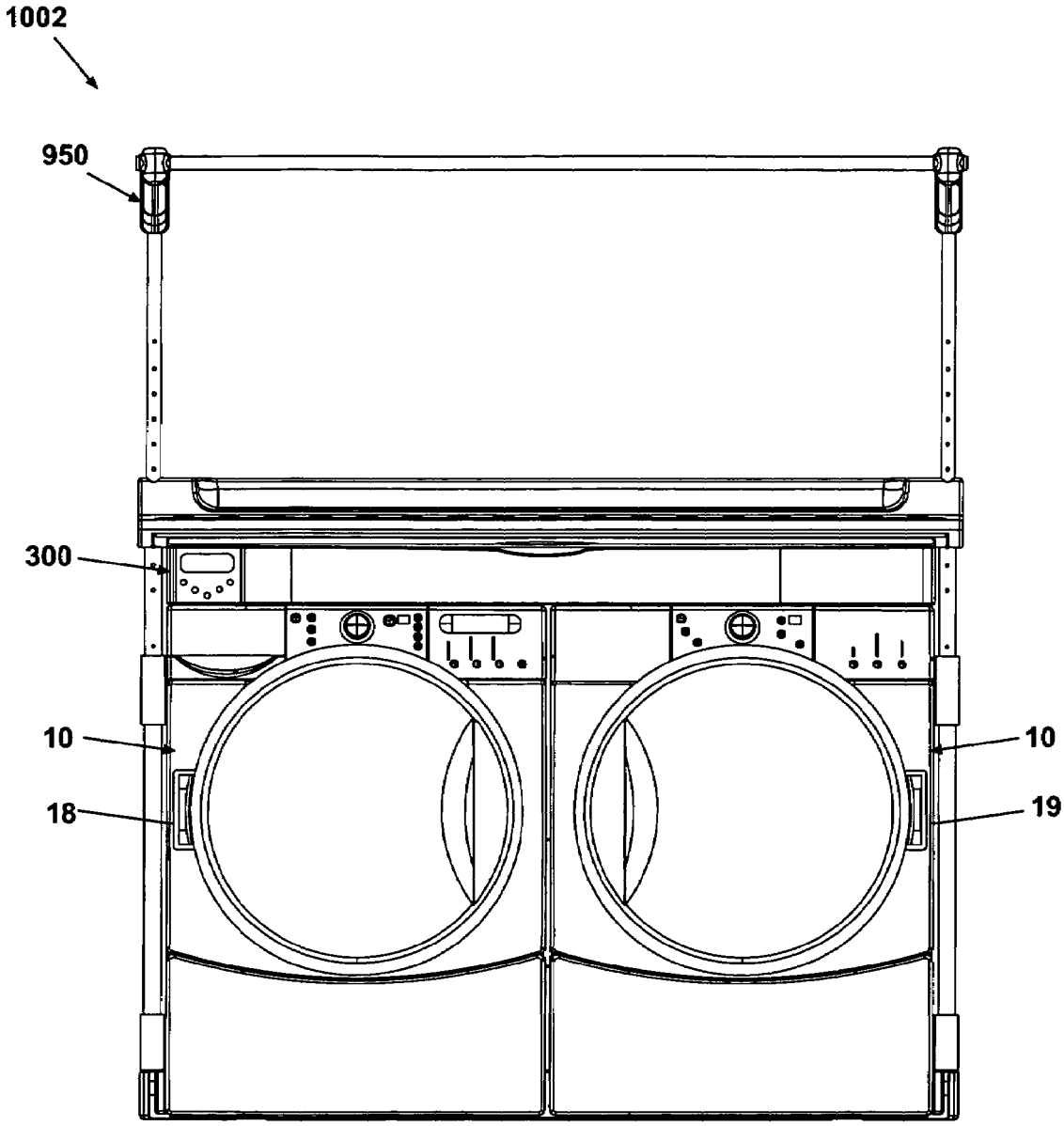
FIG. 41C is a front view of the implementation B of FIG. 41A incorporating the double laundry appliance work surface of FIG. 39A.

FIG. 41A shows an implementation B 1002 corresponding to the core configuration B 102 of FIG. 9 and reproduced in FIG. 41B. The implementation B 1002 comprises the first laundry appliance 18 in the form of the front-loading washing machine in side-by-side relationship with the second laundry appliance 19 in the form of the front-loading dryer and the drying function double width horizontal module 300 vertically stacked above the laundry appliances 18, 19. The double laundry appliance work surface 950 with the three segments 852, 854, 856 can readily be incorporated into the implementation B 1002, as shown in FIG. 41C.

Figure 42A:
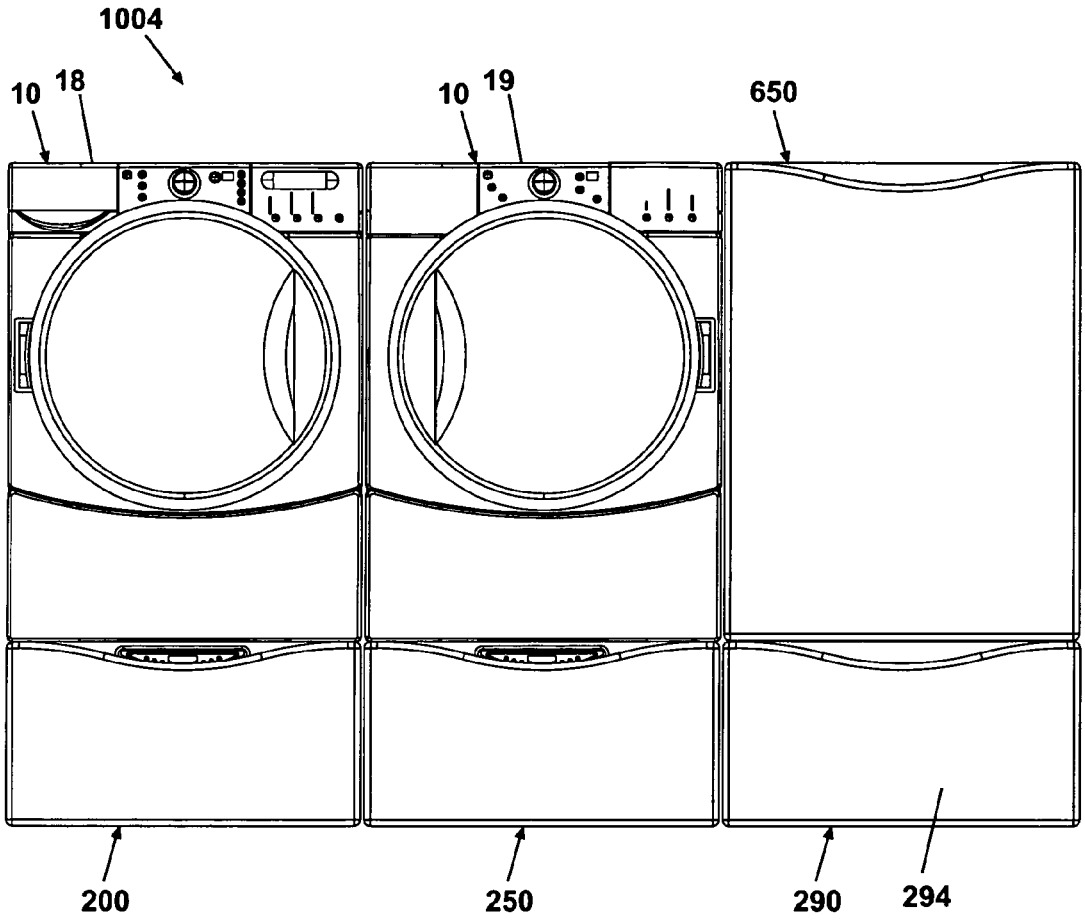
FIG. 42A is a front view of an implementation C of the modular laundry system.
Figure 42B:
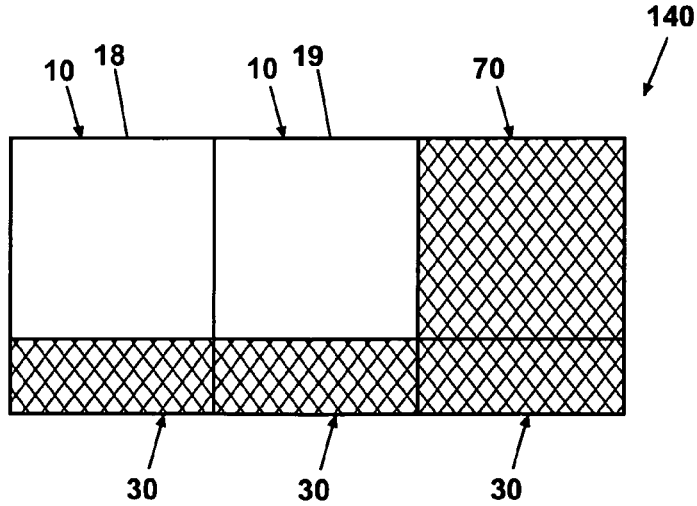
FIG. 42B is a schematic view of the customized configuration A of FIG. 16A, which corresponds to the implementation C of FIG. 42A.
Figure 42C:
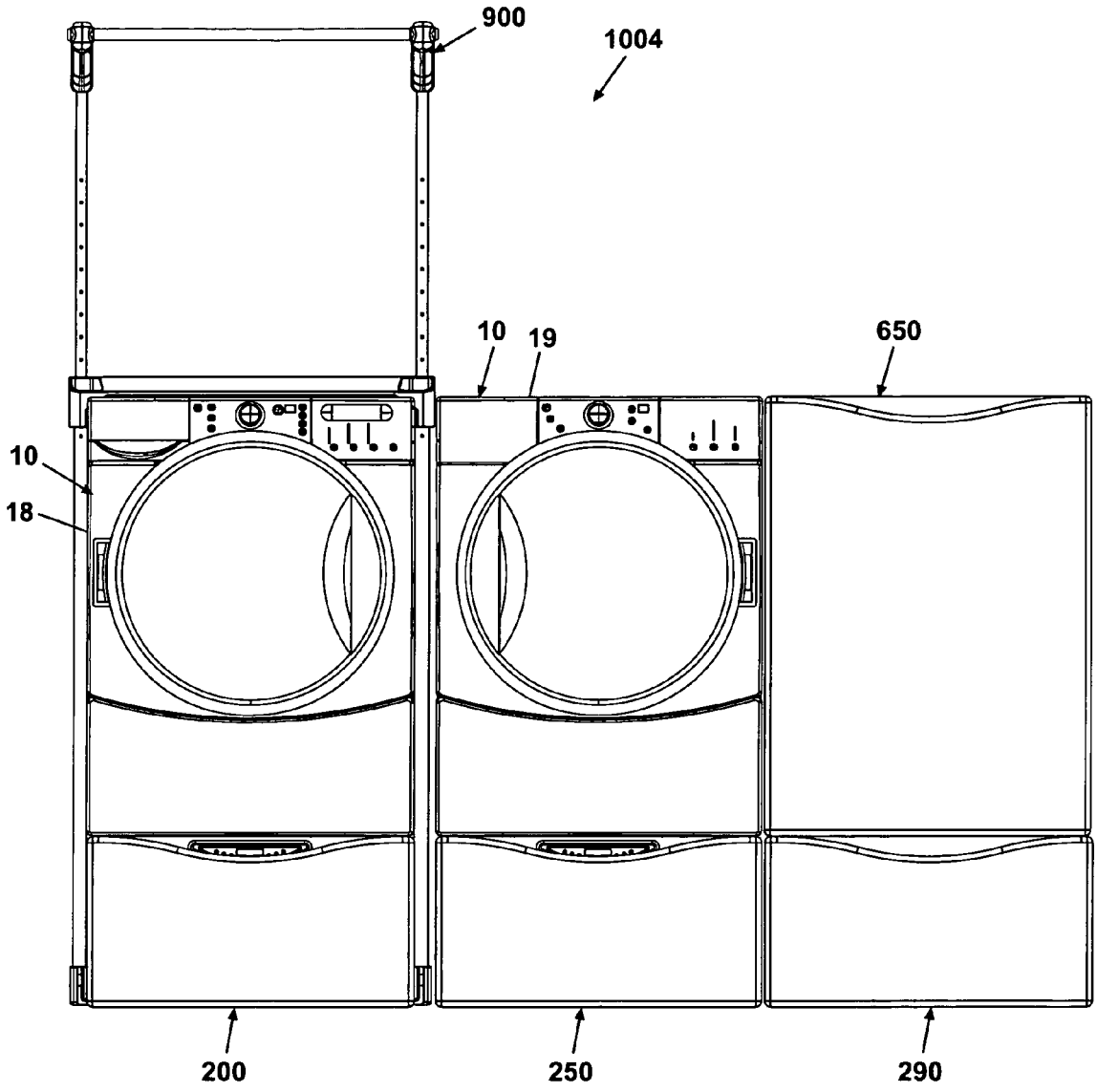
FIG. 42C is a front view of the implementation C of FIG. 42A incorporating the single laundry appliance work surface of FIG. 38.

An implementation C 1004 shown in FIG. 42A corresponding to the customized configuration A 140 of FIG. 16A and reproduced in FIG. 42B comprises the first laundry appliance 18 in the form of the front-loading washing machine vertically stacked above the washing function single width horizontal module 200 and the second laundry appliance 19 in the form of the front-loading dryer vertically stacked above the drying function single width horizontal module 250, similar to the implementation A 1000. However, the implementation C 1004 further comprises the storage function single height cabinet module 650 vertically stacked above a storage function single width horizontal module 290. The storage function single height cabinet module 650 and the storage function single width horizontal module 290 are positioned adjacent to the second laundry appliance 19 and the drying function single width horizontal module 250, respectively. The storage function single width horizontal module 290 is similar to the washing and drying function single width horizontal modules 200, 250 in that it comprises an open-face cabinet (not shown) and a drawer 294, but the drawer 294 is adapted for storage. The single laundry appliance work surface 900 can readily be incorporated into the implementation C 1004, as shown in FIG. 42C.

Figure 43A:
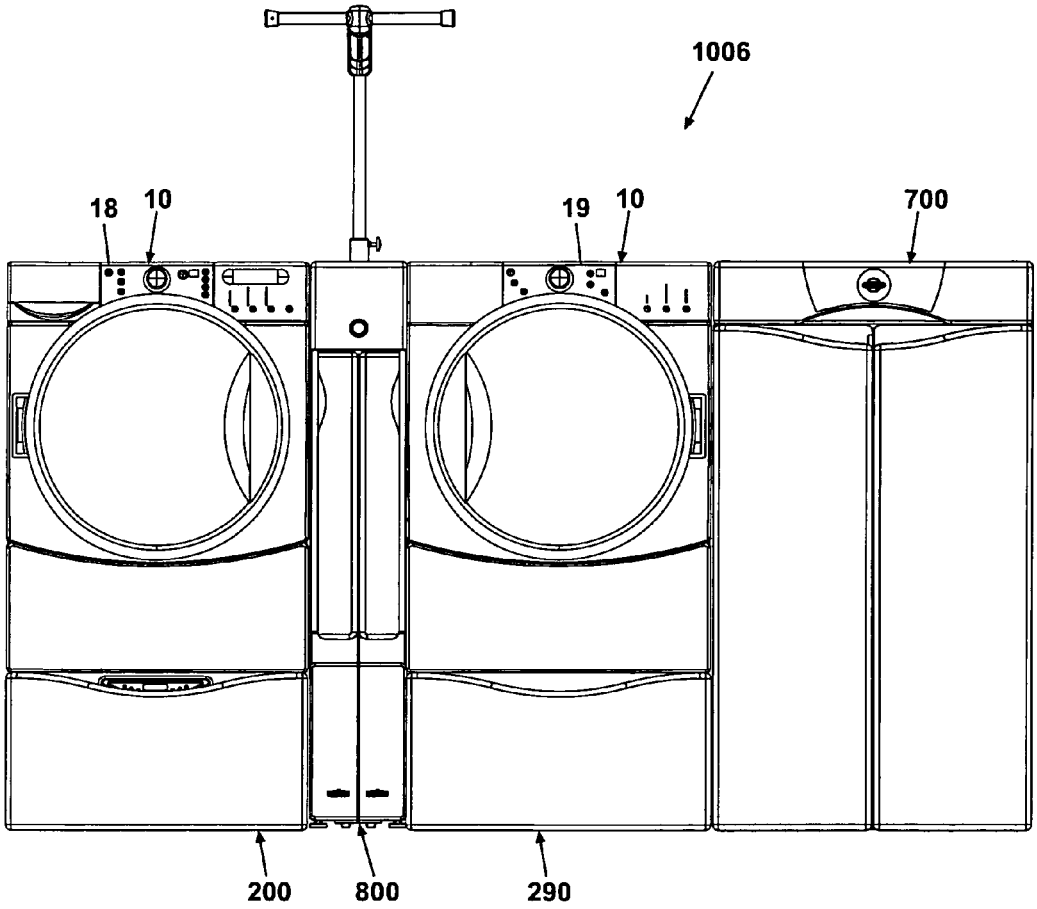
FIG. 43A is a front view of an implementation D of the modular laundry system.
Figure 43B:
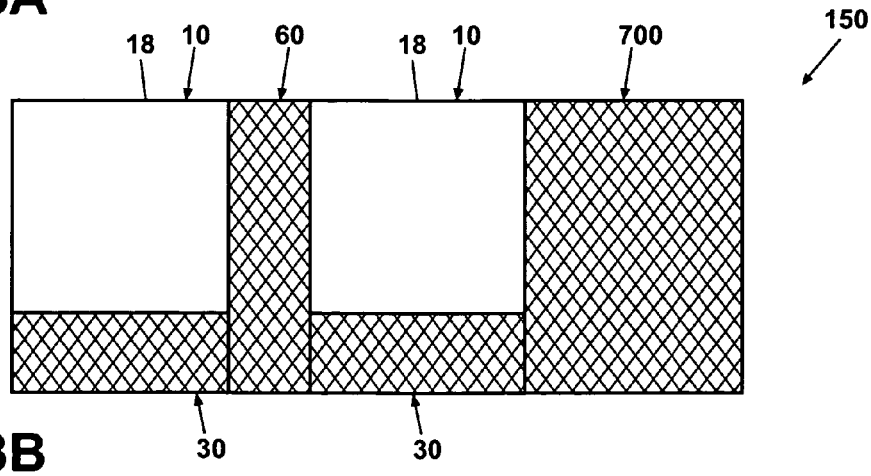
FIG. 43B is a schematic view of the customized configuration F of FIG. 18B, which corresponds to the implementation D of FIG. 43A.

FIG. 43A shows an implementation D 1006 corresponding to the customized configuration F 150 of FIG. 18B and reproduced in FIG. 43B. The implementation D 1006 comprises the first laundry appliance 18 in the form of the front-loading washing machine horizontally arranged with the second laundry appliance 19 in the form of the front-loading dryer. The first laundry appliance 18 is vertically stacked above the wash function single width horizontal module 200, and the second laundry appliance 19 is vertically stacked above the storage function single width horizontal module 290. The shelving function intermediate height vertical module 800 is positioned between the laundry appliances 18, 19, and the drying function intermediate height cabinet module 700 is located adjacent to the second laundry appliance 19. Although not shown, the work surface accessory can be incorporated into the implementation D 1006.

Figure 44A:
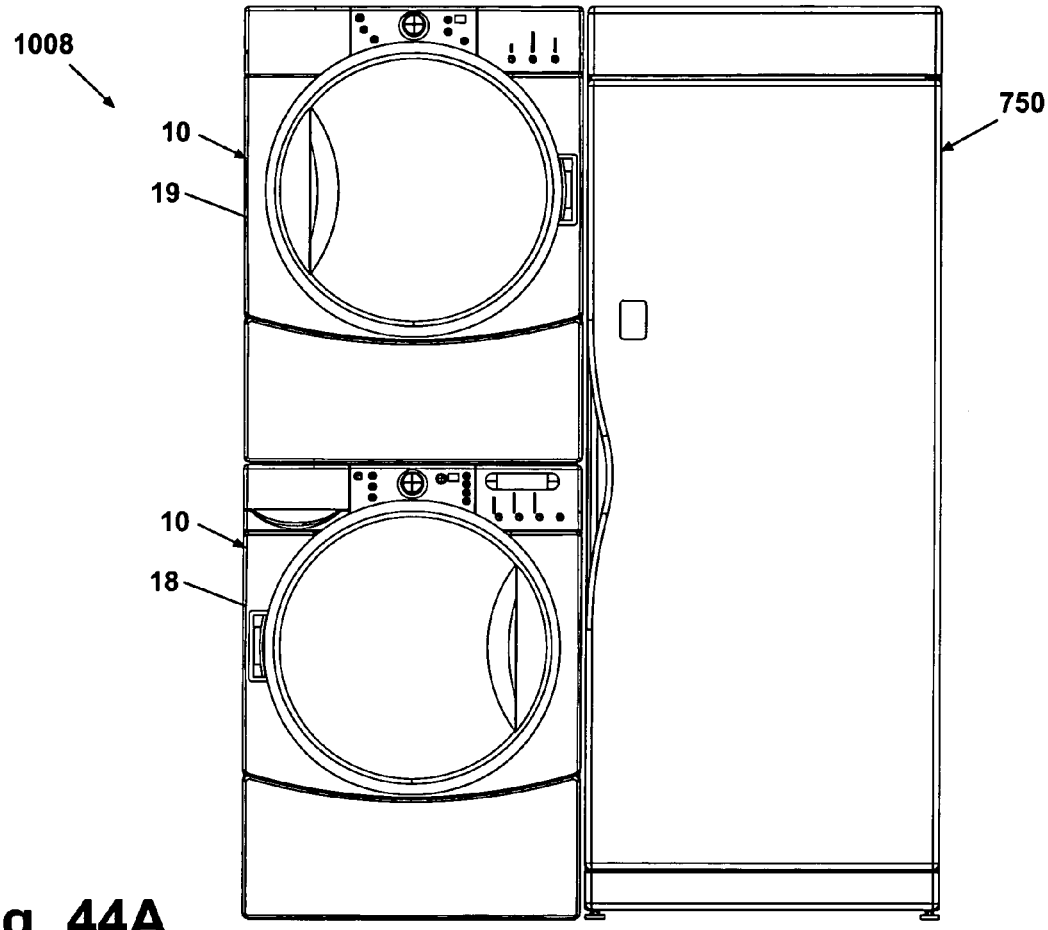
FIG. 44A is a front view of an implementation E of the modular laundry system.
Figure 44B:
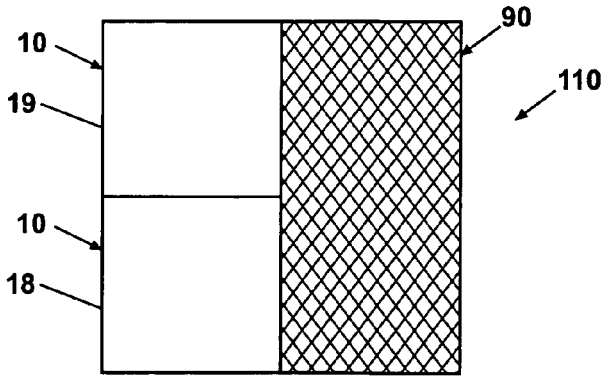
FIG. 44B is a schematic view identical to FIG. 12A of the core configuration F, which corresponds to the implementation E of FIG. 44A.

An implementation E 1006 shown in FIG. 44A corresponding to the core configuration F 110 of FIG. 12A and reproduced in FIG. 44B comprises the first laundry appliance 18 in the form of a front-loading washing machine vertically stacked below the second laundry appliance 19 in the form of a front-loading dryer and the drying function double height cabinet module 750 positioned adjacent to the laundry appliances 18, 19.

Figure 45A:
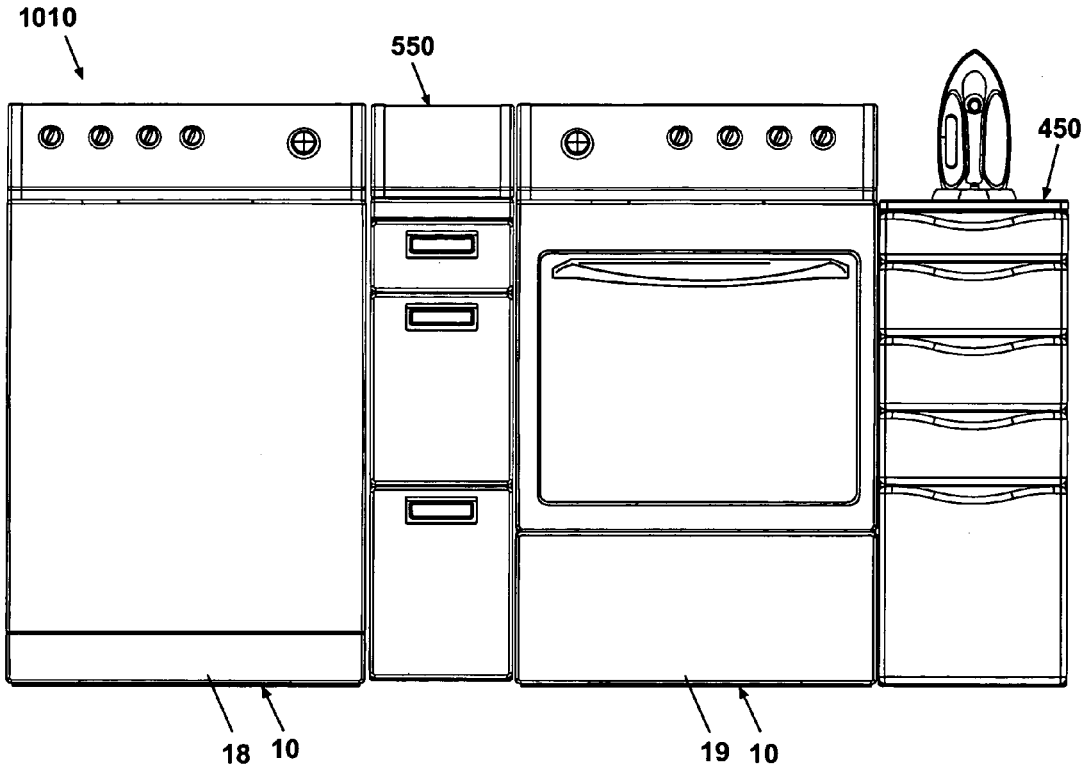
FIG. 45A is a front view of an implementation F of the modular laundry system.
Figure 45B:
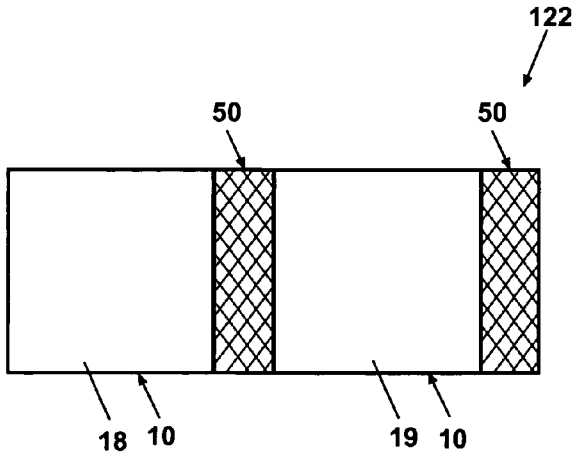
FIG. 45B is a schematic view of the core configuration L of FIG. 14A, which corresponds to the implementation F of FIG. 45A.
Figure 45C:
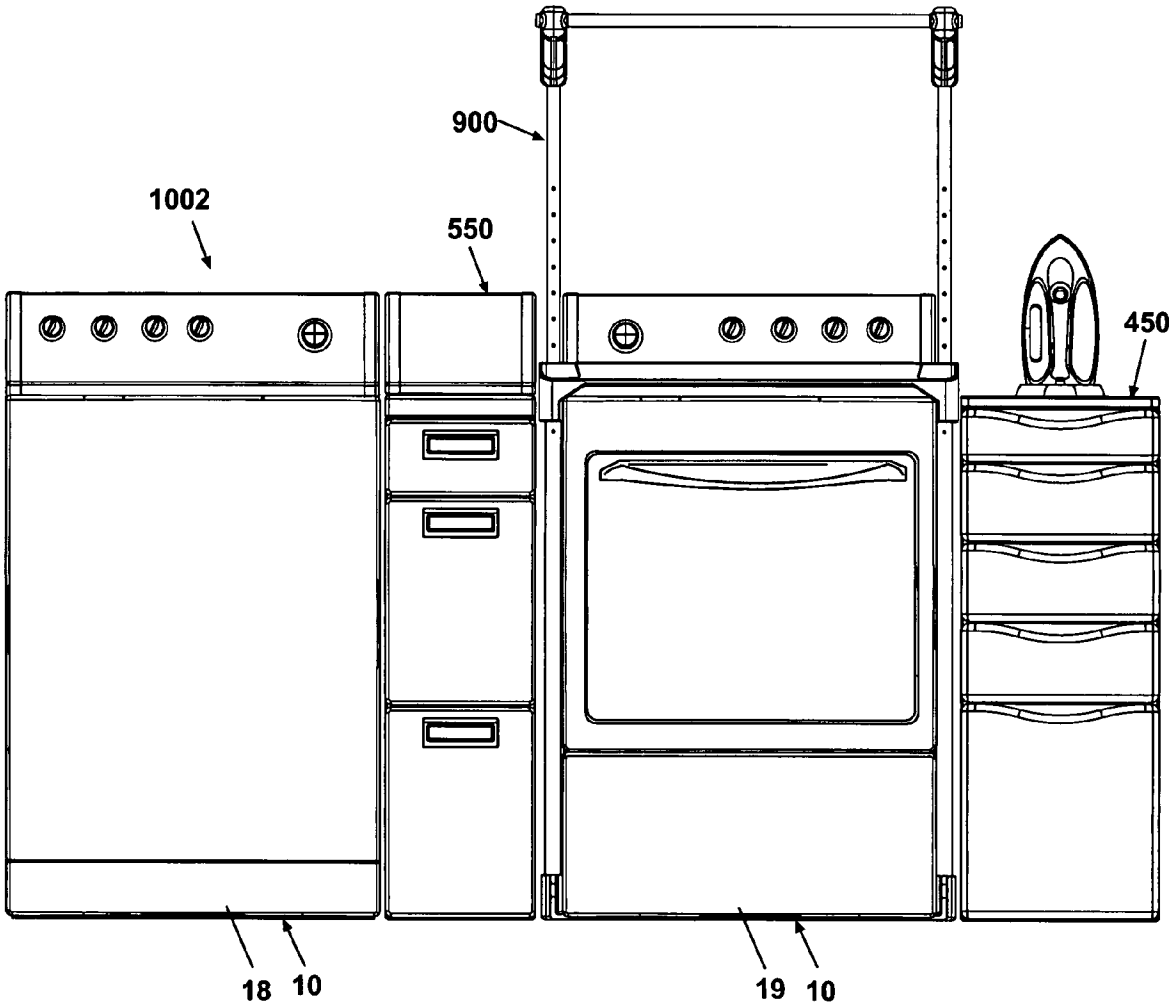
FIG. 45C is a front view of the implementation F of FIG. 45A incorporating the single laundry appliance work surface of FIG. 38.

FIG. 45A illustrates an implementation F 1010 corresponding to the core configuration L 122 of FIG. 14A and reproduced in FIG. 45B with one of the single height vertical modules 50 horizontally arranged between the laundry appliances 18, 19 and the other of the single height vertical modules 50 positioned to the right of the second laundry appliance 19. The implementation F 1010 comprises the first laundry appliance 18 in the form of a top-loading washing machine with a backsplash horizontally arranged with the second laundry appliance 19 in the form of a front-loading dryer with a backsplash. The storage function single height vertical module 550 is positioned between the laundry appliances 18, 19, and the ironing single height vertical module 450 is located adjacent to the second laundry appliance 19. The single laundry appliance work surface 900 can readily be incorporated into the implementation F 1010, as shown in FIG. 45C.

Figure 46A:
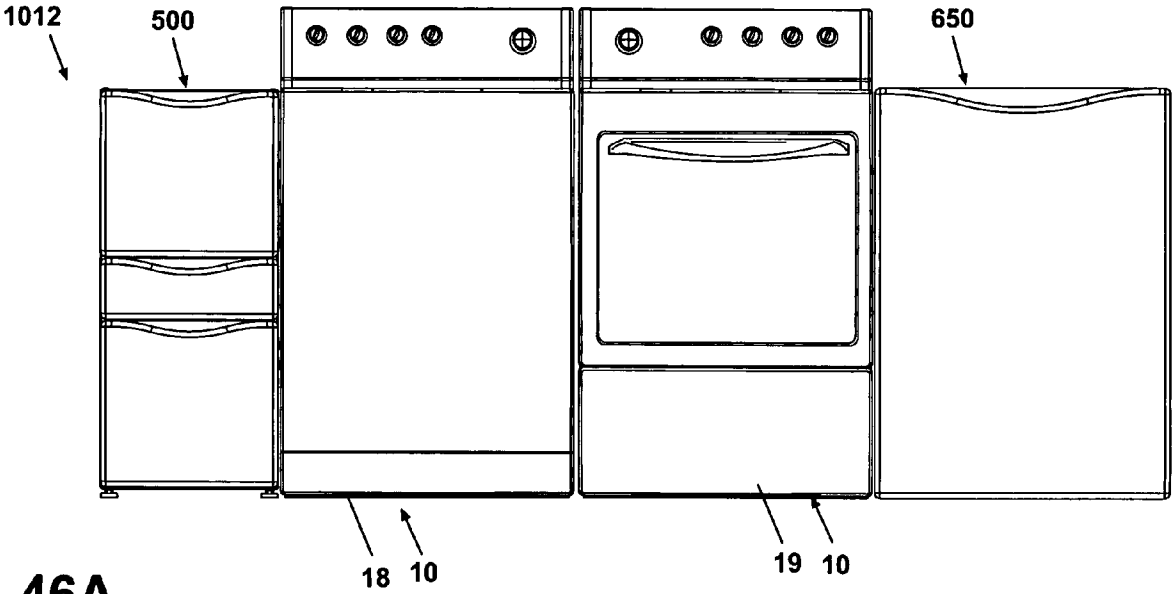
FIG. 46A is a front view of an implementation G of the modular laundry system.
Figure 46B:
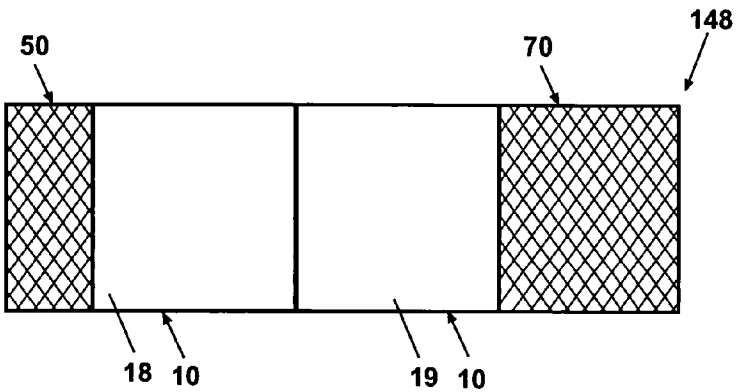
FIG. 46B is a schematic view of the customized configuration E of FIG. 18A, which corresponds to the implementation G of FIG. 46A.

An implementation G 1012 shown in FIG. 46A corresponding to the customized configuration E 148 of FIG. 18A and reproduced in FIG. 46B comprises the first laundry appliance 18 in the form of the top-loading washing machine horizontally arranged with the second laundry appliance 19 in the form of the top-loading dryer. The sink function single height vertical module 500 is positioned to the left of the first laundry appliance 18, and the storage function single height cabinet module 650 is located to the right of the second laundry appliance 19. Although not shown, the work surface accessory can be incorporated into the implementation G 1012.

Utilization of the modular laundry system can be accomplished in at least two ways: with geometry as a primary driver or with function as a primary driver. In the former case, the configuration of the laundry appliances 10 and the modules 20 is initially determined by selecting one of the core configurations A-R 100-134 or building any customized configuration from the core configurations A-R 100-134. The determination of the configuration can be based on the spatial limitations of the laundry area or a desired overall appearance of the laundry appliances 10 and the modules 20. Selecting the core configuration or the customized configuration to spatially optimize the laundry area determines whether the modules 20 that are to be used with the laundry appliances 10 of the modular laundry system are the horizontal modules 30, 40, 1050, 1060, 1070, the vertical modules 50, 60, and/or the cabinet modules 70, 80, 90. Once the module type is known, the user can select particular modules depending on the desired functions for the modules 20. For example, if the selected configuration is the core configuration A 100, then the user must select two of the single width horizontal modules 30, which could be the washing function single width horizontal module 200 and the drying function single width horizontal module 250. By utilizing the modular laundry system in this manner, the laundry area can incorporate as much functionality as possible within a given or limited space.

Alternatively, when the laundry area does not have spatial limitations, such as in a large room, when a new home is being designed and built, or when the laundry area is being renovated, function of the modules 20 can be the primary driver. In this case, the user can select the modules 20 based on the desired functions and arrange them according to any of the core configurations A-R 100-134 or any customized configuration that includes the selected modules 20. For example, if the user selects the sink and storage functions, then the user identifies the modules 20 that have these functions, such as the sink function single height vertical module 500 and the storage function single height cabinet module 650. Once the modules 500, 650 having the desired functions are identified, then the modules 500, 650 can be arranged according to the customized configuration E 148. When function is the primary driver and the laundry area is not limited spatially, the laundry area can include as much functionality as desired, and the modules 20 that bring the desired functionality to the laundry area can be arranged relative to the laundry appliances 10 and to each other in an aesthetically pleasing and efficient manner.

Regardless of whether the driver is the geometry or the function, the modular laundry system provides a system for spatially and functionally optimizing the laundry area. By utilizing the core configurations or building upon the core configurations to create the customized configurations and utilizing the modules 20 having laundry care and non-laundry care functions, the modular laundry system can be employed to provide desired functionality within a given laundry area. Further, the implementations of the modular laundry system bring an aesthetically coherent appearance to the laundry area without sacrificing functionality.

The aesthetically coherent appearance can be enhanced by configuring the laundry appliances 10 and the modules 20 in the modular laundry system to have matching designs. When the laundry appliances 10 and the modules 20 match one another, not only does the modular laundry system provide an aesthetically pleasing appearance, but a consumer is more likely to purchase multiple items from the modular laundry system to create a coherent appearance in the laundry area rather than purchasing a hodgepodge of gadgets to fulfill their laundry care and non-laundry care functional needs in the laundry area. Various items can be added to the laundry appliances 10 and the vertical modules 20 to contribute to the aesthetically coherent appearance. For example, mats having a matching color/pattern and/or texture can be placed on top of the laundry appliances 10 and the modules 20. The mats can cover one or more of the laundry appliances 10 and/or modules 20.

The modular laundry system can also be adapted to prevent transference of vibration between the laundry appliance 10 and the module 20 and/or between adjacent laundry appliances 10 or adjacent modules 20. Consequently, vibration caused by operation of one of the laundry appliances 10 and/or one of the modules 20 does not transfer to other laundry appliances 10 and modules 20 in the modular laundry system. Thus, the other laundry appliances 10 and modules 20 remain relatively stationary, and any items supported by the laundry appliances 10 and the modules 20 will not shake or fall from the respective laundry appliances 10 and the modules 20. The modular laundry system can incorporate any suitable means for damping vibration or preventing transference of vibration. For example, vibration dampening or isolation pads can be positioned between adjacent components of the modular laundry system. The isolation pads can be made of a material, such as rubber, that dampens vibrations. Alternatively, the vibration dampening or isolation pads can be incorporated into the work surfaces, as described in the aforementioned and incorporated patent applications that disclose work surfaces.

Figure 47:
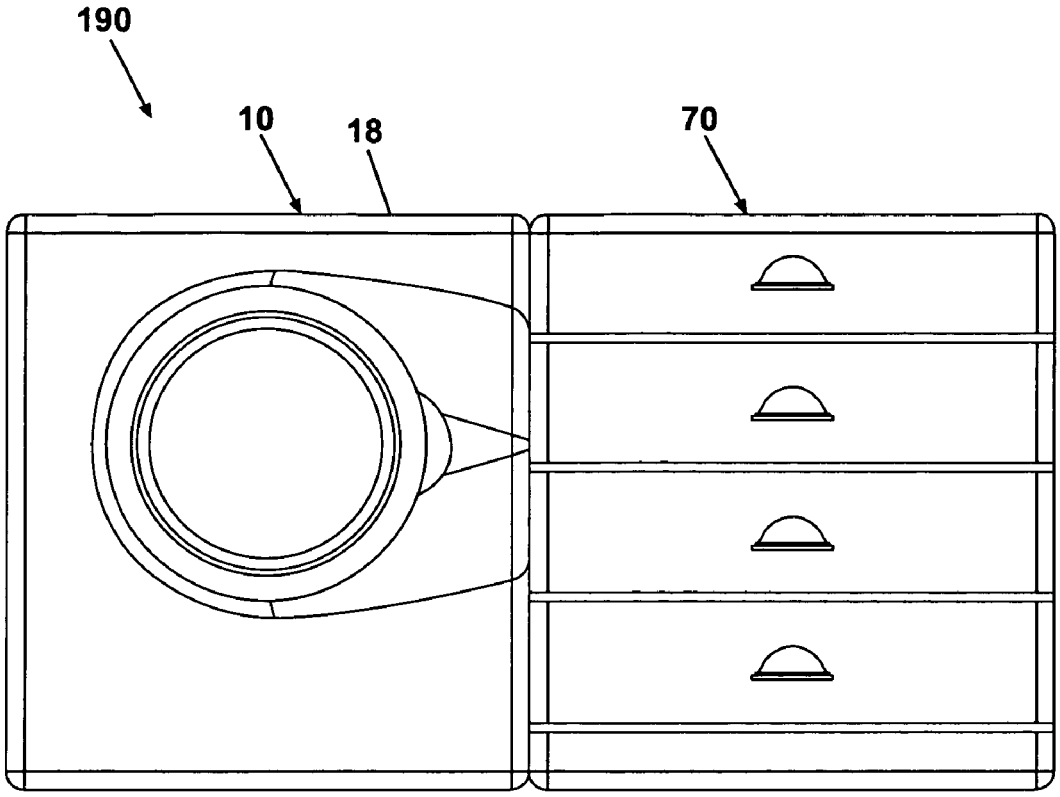
FIG. 47 is a schematic view of a modified core configuration C based on the core configuration C of FIG. 11A.

As stated above, the modular laundry system comprises at least of the appliances 10 and at least one of the modules 20. However, the core configurations A-R 100-134 have been shown and described as comprising two of the laundry appliances 10. It is within the scope of the invention to remove one of the laundry appliances from the core configurations A-R 100-134 to result in one of the laundry appliances 10, except where both of the laundry appliances 10 are required to vertically support the module 20. For example, one of the laundry appliances 10 of the core configuration B 102 of FIG. 9 cannot be removed if the double width horizontal module 30 is vertically stacked above the laundry appliances 10. However, one of the laundry appliances 10 can be removed if the double width horizontal module 40 is vertically stacked below the laundry appliances 10. An example of modifying the core configurations by removing the laundry appliance 10 is shown in FIG. 47. In FIG. 47, the second laundry appliance 19 has been removed from the core configuration C 104 of FIG. 11A to form a modified core configuration C 190. The modified core configuration C 190, therefore, comprises the first laundry appliance 18 horizontally arranged with the single height cabinet module 70.

Figure 48:
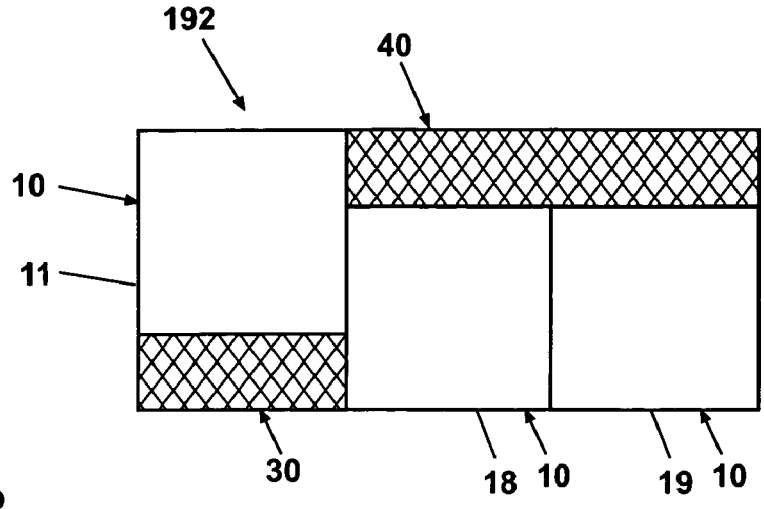
FIG. 48 is a schematic view of a modified core configuration B based on the core configuration B of FIG. 9.

Similarly, it is within the scope of the invention to add one or more additional laundry appliances 10 to the core configurations A-R 100-134 to result in three or more of the laundry appliances 10. When adding one or more additional appliances 10 to result in three or more of the laundry appliances 10, the added laundry appliances 10 can be vertically or horizontally arranged relative to the existing laundry appliances 10. An example of modifying the core configurations by adding one of the laundry appliances 10 is shown in FIG. 48. In FIG. 48, a third laundry appliance 11 stacked with the single width horizontal module 30 has been added from the core configuration B 102 of FIG. 9 to form a modified core configuration B 192.

Figure 49:
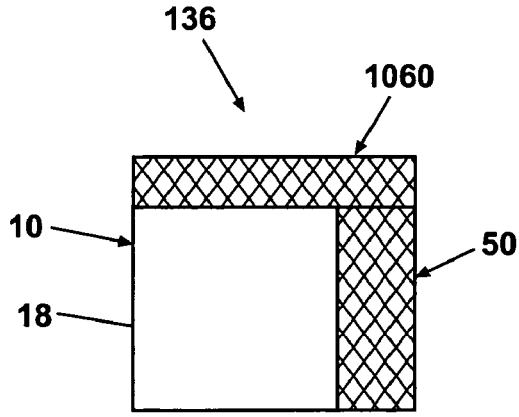
FIG. 49 is a schematic view of a core configuration S formed by one of the laundry appliances of FIG. 1A and one of the single height vertical modules of FIG. 3A in a horizontal arrangement and one of the intermediate width horizontal modules of FIG. 4C stacked with the laundry appliance and the single height vertical module.
Figure 50:
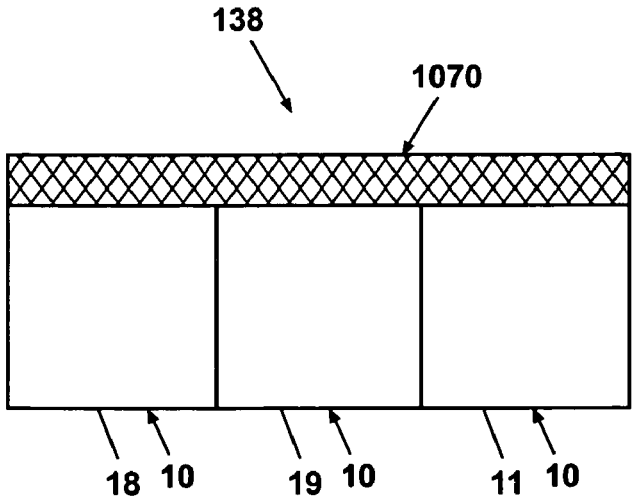
FIG. 50 is a schematic view of a core configuration T formed by three of the laundry appliances of FIG. 1A in a horizontal arrangement and one of the greater than double width horizontal modules of FIG. 4E stacked with the laundry appliances.

Additionally, it is within the scope of the invention for the modular laundry system to comprise core configurations other than the core configurations A-R 100-134. The core configurations can be other configurations comprising two of the laundry appliances 10, such as the arrangement shown in FIGS. 7A and 7B, comprising only one of the laundry appliances 10, or comprising more than two of the laundry appliances 10. An example of a core configuration comprising one of the laundry appliances 10 is shown schematically in FIG. 49. FIG. 49 illustrates a core configuration S 136 comprising one of the laundry appliances 10 and the single height vertical module 50 horizontally arranged and the intermediate width horizontal module 1060 stacked with the laundry appliance 10 and the single height vertical module 50. FIG. 50 schematically illustrates an example of a core configuration have more than two laundry appliances. A core configuration T 138 comprises three of the laundry appliances 10, the first, second, and third laundry appliances 18, 19, 11, horizontally arranged and the greater than double width horizontal module 1070 stacked with the three laundry appliances 10. Alternatively, at least one or both of the second and third laundry appliances 19, 11 can be replaced with the single height vertical module 50 or the single height cabinet module 70. Additionally, the greater than double width horizontal module 1070 can be as wide as the collective width of the three laundry appliances 10, as shown in FIG. 50, or less wide than the collective width.

Figure 51:
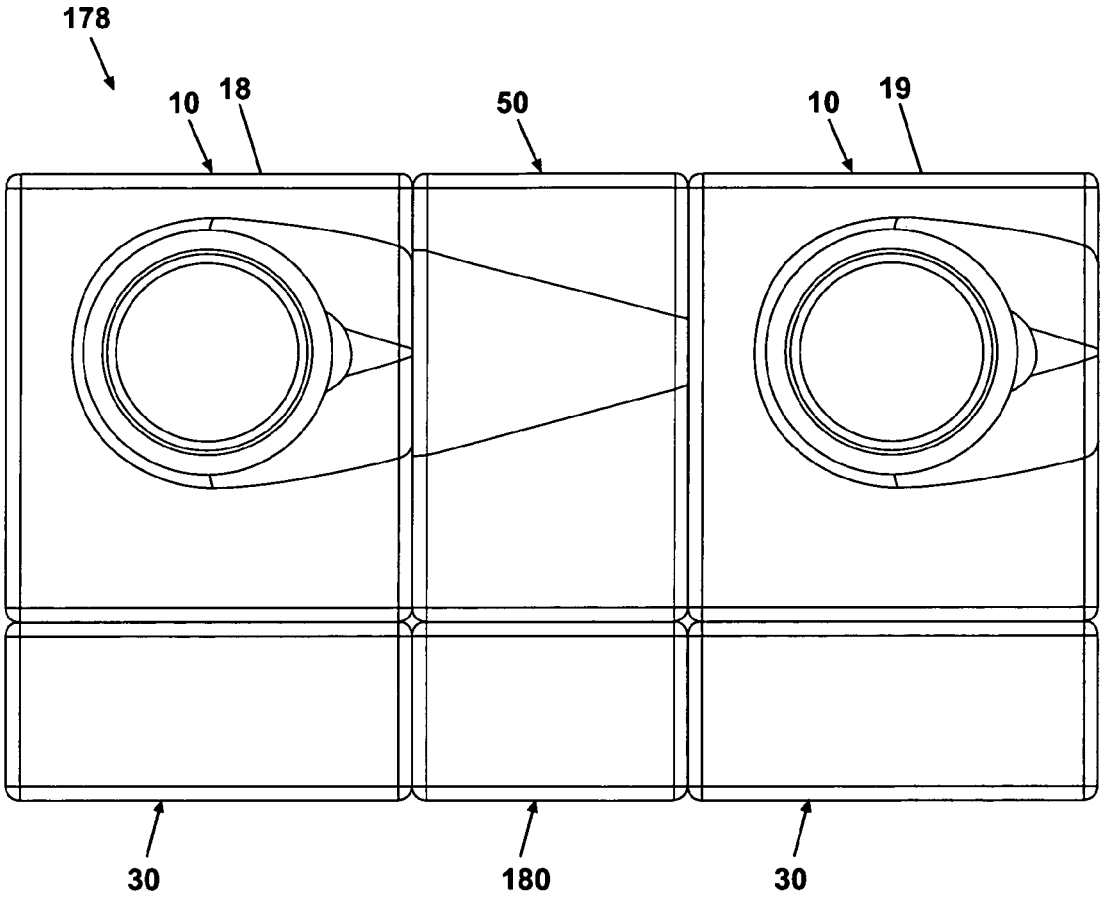
FIG. 51 is a schematic view of a customized configuration T formed from the core configuration A of FIG. 8A.

In the above description of the modules 20, it was stated that it is within the scope of the invention to add height to the modules 20 with a base or pedestal so that the modules 20 conform to the respective height requirements. It is also within the scope of the invention to add a base or pedestal below or above the single height vertical module 50 to convert the single height vertical module 50 to the intermediate height vertical module 60 or the double height vertical module or below or above the single height cabinet module 70 to convert the single height cabinet module 70 to the intermediate height cabinet module 80 or the double height cabinet module 90. For example, a customized configuration T 178, which is illustrated schematically in FIG. 51, can be constructed from the core configuration A 100 of FIG. 8A by adding the single height vertical module 50 and supporting the single height vertical module 50 with a base 180 to raise the height of the single height vertical module 50 and effectively convert the single height vertical module 50 to the intermediate height vertical module 60.

In addition to the current application, the modular laundry system is also described in the following related applications: application Ser. No. 11/323,125, filed concurrently herewith, and titled "Modular Laundry System with Horizontal Modules," application Ser. No. 11/322,715, filed concurrently herewith, and titled "Modular Laundry System with Horizontal Module Spanning Two Laundry Appliances," application Ser. No. 11/322,739, filed concurrently herewith, and titled "Modular Laundry System with Horizontal and Vertical Modules," application Ser. No. 11/323,075, filed concurrently herewith, and titled "Modular Laundry System with Vertical Module," application Ser. No. 11/323,147, filed concurrently herewith, and titled "Modular Laundry System with Cabinet Module," and application Ser. No. 11/322,742, filed concurrently herewith, and titled "Laundry Module for Modular Laundry System," which are incorporated herein by reference in their entirety.

While the invention has been specifically described in connection with certain specific embodiments thereof, it is to be understood that this is by way of illustration and not of limitation, and the scope of the appended claims should be construed as broadly as the prior art will permit.

What is claimed is:

1. A modular laundry system comprising:

a first laundry appliance;

a second laundry appliance horizontally or vertically arranged relative to the first laundry appliance;

a cabinet module having a width equal to the width of at least one of the first and second laundry appliances and a height equal to or greater than the height of the at least one of the first and second laundry appliances, and that is horizontally arranged relative to the first and second laundry appliances; and one or more functional elements located interiorly of the cabinet module, wherein any functional elements located interiorly of the cabinet module perform non-laundry care functions selected from a group consisting of storage, staging, garbage and recycling collection, shelving, laundry sorting, hanging, bulk dispensing, resource management, resource supply and/or recovery/reclamation, resource treatment, lighting, refrigeration, entertainment, pet care, data collection and communication, home automation, home security, home safety, power outlet, power supply, and module controller function;

wherein the first laundry appliance, the second laundry appliance, and the cabinet module are stand-alone units that are contiguously arranged to form a coherent modular system.

2. The modular laundry system according to claim 1, wherein the cabinet module is one of a single height cabinet module, an intermediate height cabinet module, and a double height cabinet module.

3. The modular laundry system according to claim 1 and further comprising a vertical module having a width less than to the width of at least one of the first and second laundry appliances and horizontally arranged relative to the first and second laundry appliances and the cabinet module.

4. The modular laundry system according to claim 1 and further comprising a first single width horizontal module having a height less than the height of at least one of the first and second laundry appliances, and vertically arranged with at least one of the first laundry appliance, the second laundry appliance, and the cabinet module.

5. The modular laundry system according to claim 4, wherein the first single width horizontal module is vertically arranged with one of the first laundry appliance, the second laundry appliance, and the cabinet module, and further comprising a double width horizontal module having a height less than the height of at least one of the first and second laundry appliances, and vertically arranged with the other two of the first laundry appliance, the second laundry appliance, and the cabinet module.

6. The modular laundry system according to claim 4 and further comprising second and third single width horizontal modules, wherein each of the first laundry appliance, the second laundry appliance, and the cabinet module is vertically arranged with one of the first, second, and third single width horizontal modules.

7. The modular laundry system according to claim 1 and further comprising one of a horizontal module having a height less than the height of at least one of the first and second laundry appliances and a second cabinet module vertically arranged with at least one of the first and second laundry appliances to form a vertically arranged unit having a height that is about the same as a height of the cabinet module.

8. The modular laundry system according to claim 1 and further comprising a work surface extending across at least one of the first laundry appliance, the second laundry appliance, and the cabinet module.

9. The modular laundry system according to claim 8, wherein the work surface is removably mounted to at least one of the first laundry appliance, the second laundry appliance, and the cabinet module.

10. The modular laundry system according to claim 8, wherein the work surface comprises opposing sides with each side configured for performing an associated function.

11. The modular laundry system according to claim 8, wherein the work surface comprises an ironing surface.

12. The modular laundry system according to claim 8, wherein the work surface comprises a hygienic material.

13. The modular laundry system according to claim 8, where in the work surface comprises a hanging bar.

14. The modular laundry system according to claim 8, wherein the work surface comprises a non-skid surface.

15. The modular laundry system according to claim 1, wherein the first and second laundry appliances are horizontally arranged.

16. The modular laundry system according to claim 15, wherein the cabinet module is one of a single height cabinet module, an intermediate height cabinet module, and a double height cabinet module.

17. The modular laundry system according to claim 1, wherein the first and second laundry appliances are vertically arranged.

18. The modular laundry system according to claim 17, wherein the cabinet module is one of a single height cabinet module, an intermediate height cabinet module, and a double height cabinet module.

19. The modular laundry system according to claim 1, wherein the first laundry appliance is a washing machine, and the second laundry appliance is a dryer.

20. A modular laundry system comprising:

a first laundry appliance;

a second laundry appliance horizontally or vertically arranged relative to the first laundry appliance; and a cabinet module having a width equal to the width of at least one of the first and second laundry appliances and a height equal to or greater than the height of the at least one of the first and second laundry appliances, and that is horizontally arranged relative to the first and second laundry appliances, and comprises:

a chamber for receiving an article; and one or more functional elements located interiorly of the cabinet module, wherein at least one of the functional elements located interiorly of the cabinet module performs a refreshing function by exposing an article in the chamber to a refreshing medium to at least one of remove wrinkles and remove odors from the article;

wherein the first laundry appliance, the second laundry appliance, and the cabinet module are stand-alone units that are contiguously arranged to form a coherent modular system.

21. The modular laundry system according to claim 20, wherein the cabinet module is one of a single height cabinet module, an intermediate height cabinet module, and a double height cabinet module.

22. The modular laundry system according to claim 20, wherein the cabinet module further comprises a functional element having an associated non-laundry care function.

23. The modular laundry system according to claim 22, wherein the non-laundry care function is selected from a group comprising storage, garbage and recycling collection, shelving, laundry sorting, hanging, bulk dispensing, resource management, resource supply, resource recovery/reclamation, resource treatment, lighting, refrigeration, entertainment, pet care, data collection, data communication, home automation, home security, home safety, power outlet, and power supply.

24. The modular laundry system according to claim 20 and further comprising a vertical module having a width less than the width of at least one of the first and second laundry appliances and horizontally arranged relative to the first and second laundry appliances and the cabinet module.

25. The modular laundry system according to claim 20 and further comprising a first single width horizontal module having a height less than the height of at least one of the first and second laundry appliances, and vertically arranged with at least two of the first laundry appliance, the second laundry appliance, and the cabinet module.

26. The modular laundry system according to claim 20 and further comprising a double width horizontal module having a height less than the height of at least one of the first and second laundry appliances, and vertically arranged with at least two of the first laundry appliance, the second laundry appliance, and the cabinet module.

27. The modular laundry system according to claim 20 and further comprising second and third single width horizontal modules, wherein each of the first laundry appliance, the second laundry appliance, and the cabinet module is vertically arranged with one of the first, second, and third single width horizontal modules.

28. The modular laundry system according to claim 20 and further comprising one of a horizontal module having a height less than the height of at least one of the first and second laundry appliances and a second cabinet module configured to be vertically arranged with at least one of the first laundry appliance and the second laundry appliance to form a vertically arranged unit having a height that is about the same as a height of the cabinet module.

29. The modular laundry system according to claim 20 and further comprising a work surface configured to extend across at least one of the first laundry appliance, the second laundry appliance, and the cabinet module.

30. The modular laundry system according to claim 29, wherein the work surface is configured to be removably mounted to at least one of the first laundry appliance, the second laundry appliance, and the cabinet module.

31. The modular laundry system according to claim 29, wherein the work surface comprises opposing sides with each side configured for performing an associated function.

32. The modular laundry system according to claim 29, wherein the work surface comprises a non-skid surface.

33. The modular laundry system according to claim 29, wherein the work surface comprises an ironing surface.

34. The modular laundry system according to claim 29, wherein the work surface comprises a hygienic material.

35. The modular laundry system according to claim 29, wherein the work surface comprises a hanging bar.

36. The modular laundry system according to claim 20, wherein at least one other function element located interiorly of the cabinet module performs a sanitizing function.

37. The modular laundry system according to claim 20, wherein at least one other functional element located interiorly of the cabinet module performs a hand steaming function.

38. The modular laundry system according to claim 20, wherein at least one other functional element located interiorly of the cabinet module performs a drying function.

39. The modular laundry system according to claim 20, wherein the first laundry appliance is a washing machine, and the second laundry appliance is a dryer.

* * * * *

UNITED STATES PATENT AND TRADEMARK OFFICE

CERTIFICATE OF CORRECTION

PATENT NO. : 7,624,600 B2
APPLICATION NO. : 11/323221
DATED : December 1, 2009
INVENTOR(S) : Sunshine et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 667 days.

Signed and Sealed this

Twenty-sixth Day of October, 2010

David J. Kappos

David J. Kappos
*Director of the United States Patent and Trademark Office*